US010085526B2

(12) United States Patent
Jose

(10) Patent No.: US 10,085,526 B2
(45) Date of Patent: Oct. 2, 2018

(54) LOCKING SLIDER ASSEMBLY AND A METHOD FOR ITS MANUFACTURE

(71) Applicant: Boban Jose, San Ramon, CA (US)

(72) Inventor: Boban Jose, San Ramon, CA (US)

( * ) Notice: Subject to any disclaimer, the term of this patent is extended or adjusted under 35 U.S.C. 154(b) by 0 days.

(21) Appl. No.: 15/400,721

(22) Filed: Jan. 6, 2017

(65) Prior Publication Data

US 2017/0347759 A1 Dec. 7, 2017

Related U.S. Application Data

(63) Continuation-in-part of application No. 15/170,149, filed on Jun. 1, 2016, now Pat. No. 9,743,721, and a continuation-in-part of application No. 15/207,634, filed on Jul. 12, 2016, now Pat. No. 9,833,047.

(51) Int. Cl.

| | |
|---|---|
| ***A44B 19/30*** | (2006.01) |
| ***A44B 19/64*** | (2006.01) |
| ***A45C 13/10*** | (2006.01) |

(52) U.S. Cl.

CPC ..... *A44B 19/30* (2013.01); *A45C 13/103* (2013.01); *Y10T 24/2513* (2015.01); *Y10T 24/2598* (2015.01)

(58) Field of Classification Search

CPC ..... Y10T 24/2532; Y10T 24/2558; Y10T 24/255; Y10T 24/2541; Y10T 24/2513; Y10T 24/2598; Y10T 24/2511; Y10T 24/2563; Y10T 24/2566; Y10T 24/2187; Y10T 24/2102; Y10T 24/2194; A44B 19/24; A44B 19/26; B65D 33/2532; B65D 33/2558; B65D 33/255; B65D 33/2541; B65D 33/2591

See application file for complete search history.

(56) References Cited

U.S. PATENT DOCUMENTS

| | | | | |
|---|---|---|---|---|
| 853,566 A | | 5/1907 | Sparks | |
| 2,077,350 A | | 4/1937 | Gideon | |
| 2,416,783 A | | 3/1947 | Vallieres | |
| 2,517,178 A | | 8/1950 | Cheatham | |
| 2,538,616 A | | 1/1951 | Cross | |
| 2,620,535 A | | 12/1952 | Lajos | |
| 2,718,943 A | | 9/1955 | Braverman | |
| 3,108,347 A | * | 10/1963 | Morin | A44B 19/305 24/419 |

(Continued)

FOREIGN PATENT DOCUMENTS

| | | |
|---|---|---|
| CN | 103796542 A | 5/2014 |
| CN | 105054503 B | 5/2017 |

(Continued)

OTHER PUBLICATIONS

Search Report and Written Opinion dated Sep. 14, 2017 from International Serial No. PCT/US2017/035233 filed May 31, 2017.

(Continued)

*Primary Examiner* — Robert Sandy

(74) *Attorney, Agent, or Firm* — Law Office of Ilya Libenzon

(57) ABSTRACT

A locking slider assembly includes a slider including a follower; and a rail engaged to the follower, so that the follower can move along the rail when the assembly is in a first state and the follower cannot move along the rail when the assembly is in a second state.

22 Claims, 41 Drawing Sheets

(56) References Cited

U.S. PATENT DOCUMENTS

| | | | | |
|---|---|---|---|---|
| 3,606,372 | A | 9/1971 | Browning | |
| 3,814,220 | A | 6/1974 | Brody | |
| 4,146,045 | A | 3/1979 | Grant | |
| 4,160,496 | A | 7/1979 | Knight | |
| 4,221,402 | A | 9/1980 | Kazmark | |
| 4,538,709 | A | 9/1985 | Williams et al. | |
| 4,588,056 | A | 5/1986 | Bernbaum | |
| 4,795,186 | A | 1/1989 | Tyus | |
| 4,905,694 | A | 3/1990 | Will | |
| 5,189,764 | A * | 3/1993 | Herrington | A44B 19/30 24/384 |
| 5,265,307 | A | 11/1993 | Hull et al. | |
| 5,375,685 | A | 12/1994 | Plath | |
| 5,407,405 | A | 4/1995 | Oren | |
| 5,433,303 | A | 7/1995 | Chen | |
| 5,464,080 | A | 11/1995 | Liang | |
| 5,564,538 | A | 10/1996 | Sadow | |
| 5,699,886 | A | 12/1997 | Latshaw | |
| 5,806,143 | A | 9/1998 | Tsai | |
| 5,904,230 | A | 5/1999 | Peterson | |
| 5,924,533 | A | 7/1999 | Cnockaert et al. | |
| 6,024,264 | A | 2/2000 | Java | |
| 6,105,508 | A | 8/2000 | Ryburg | |
| 6,213,265 | B1 | 4/2001 | Wang | |
| 6,279,706 | B1 | 8/2001 | Mao | |
| 6,357,080 | B1 | 3/2002 | Tsai | |
| 6,470,533 | B1 | 10/2002 | Comstock | |
| 6,540,134 | B1 | 4/2003 | Rasche | |
| 6,543,796 | B1 | 4/2003 | Johnson et al. | |
| 6,564,426 | B1 | 5/2003 | Wang | |
| 6,698,925 | B2 | 3/2004 | Bentsen | |
| 6,776,300 | B2 | 8/2004 | Walsh et al. | |
| 6,898,823 | B2 | 5/2005 | Tsai | |
| 6,978,514 | B2 | 12/2005 | Kuo et al. | |
| 7,328,796 | B2 | 2/2008 | Brunson et al. | |
| 7,445,216 | B1 | 11/2008 | Chou | |
| 7,451,861 | B2 | 11/2008 | Bhavnani | |
| 7,617,956 | B1 | 11/2009 | Sabbah | |
| 7,832,532 | B2 | 11/2010 | Nykoluk et al. | |
| 7,845,508 | B2 | 12/2010 | Rothschild et al. | |
| 7,987,955 | B2 | 8/2011 | Puchalski | |
| 8,317,558 | B2 | 11/2012 | Bucknell et al. | |
| 8,613,349 | B1 | 12/2013 | Halko et al. | |
| 8,662,267 | B1 | 3/2014 | Hart et al. | |
| 8,869,960 | B2 | 10/2014 | Mangano | |
| 9,277,796 | B1 | 3/2016 | Elam | |
| 2002/0056736 | A1 | 5/2002 | Conte | |
| 2002/0084159 | A1 | 7/2002 | Hamlin | |
| 2002/0096410 | A1 | 7/2002 | Nykoluk | |
| 2003/0102195 | A1 | 6/2003 | Mittleman et al. | |
| 2003/0132079 | A1 | 7/2003 | Bellini | |
| 2004/0108345 | A1 | 6/2004 | Oh | |
| 2004/0181906 | A1 | 9/2004 | Kuo et al. | |
| 2004/0238304 | A1 | 12/2004 | Fisher | |
| 2005/0011043 | A1 | 1/2005 | Comstock | |
| 2005/0015932 | A1 | 1/2005 | Tsai | |
| 2005/0016809 | A1 | 1/2005 | Wu | |
| 2005/0082131 | A1 | 4/2005 | Fenton et al. | |
| 2005/0098402 | A1 | 5/2005 | Cohen | |
| 2005/0183914 | A1 | 8/2005 | Lin | |
| 2006/0037825 | A1 | 2/2006 | Dayton et al. | |
| 2006/0076203 | A1 | 4/2006 | Miller | |
| 2006/0118376 | A1 | 6/2006 | Godshaw et al. | |
| 2006/0272126 | A1 | 12/2006 | Burgess et al. | |
| 2007/0007801 | A1 | 1/2007 | Bishop | |
| 2007/0012593 | A1 | 1/2007 | Kitchens et al. | |
| 2007/0089952 | A1 | 4/2007 | Herbst et al. | |
| 2007/0164064 | A1 | 7/2007 | Nathan | |
| 2008/0078790 | A1 | 4/2008 | Bolling | |
| 2010/0051633 | A1 | 3/2010 | Porte et al. | |
| 2010/0089778 | A1 | 4/2010 | Park | |
| 2010/0192332 | A1 | 8/2010 | Blackford et al. | |
| 2010/0282556 | A1 | 11/2010 | Tseng et al. | |
| 2010/0313383 | A1 | 12/2010 | Lai | |
| 2011/0132708 | A1 | 6/2011 | DeLine et al. | |
| 2011/0209960 | A1 | 9/2011 | MacLean et al. | |
| 2012/0217109 | A1 | 8/2012 | King et al. | |
| 2012/0273314 | A1 | 11/2012 | Raymond et al. | |
| 2012/0325607 | A1 | 12/2012 | Webster et al. | |
| 2013/0032443 | A1 | 2/2013 | Soedomo | |
| 2013/0075213 | A1 | 3/2013 | Chen et al. | |
| 2013/0075214 | A1 | 3/2013 | Chen et al. | |
| 2013/0098410 | A1 | 4/2013 | Prasannakumar et al. | |
| 2013/0153351 | A1 | 6/2013 | House | |
| 2013/0175130 | A1 | 7/2013 | Liang | |
| 2013/0233362 | A1 | 9/2013 | Miller-Klerer | |
| 2013/0264160 | A1 | 10/2013 | Mediamolle | |
| 2014/0013548 | A1 | 1/2014 | Takani et al. | |
| 2014/0123445 | A1 | 5/2014 | Jung | |
| 2014/0151172 | A1 | 6/2014 | Diaz | |
| 2014/0238799 | A1 | 8/2014 | Sharma | |
| 2014/0245519 | A1* | 9/2014 | Ly | A44B 19/26 2/93 |
| 2014/0299428 | A1 | 10/2014 | Gadbois | |
| 2015/0047939 | A1 | 2/2015 | Chang | |
| 2015/0272291 | A1 | 10/2015 | Sener et al. | |
| 2015/0348347 | A1 | 12/2015 | Diz et al. | |
| 2016/0113388 | A1 | 4/2016 | Distefano | |

FOREIGN PATENT DOCUMENTS

| | | | |
|---|---|---|---|
| DE | 202009010549 | U1 | 10/2009 |
| RU | 2496395 | C2 | 10/2013 |
| WO | 0152687 | A | 7/2001 |
| WO | 2009027992 | A2 | 3/2009 |
| WO | 2009039154 | A1 | 3/2009 |
| WO | 2012177003 | A2 | 12/2012 |
| WO | 2013080236 | A1 | 6/2013 |

OTHER PUBLICATIONS

Search Report and Written Opinion dated May 13, 2016 from International Serial No. PCT/US2016/017464 filed Feb. 11, 2016.
Search Report and Written Opinion dated May 13, 2016 from International Serial No. PCT/US2016/017470 filed Feb. 11, 2016.
Search Report and Written Opinion dated May 13, 2016 from International Serial No. PCT/US2016/017475 filed Feb. 11, 2016.
Search Report and Written Opinion dated May 19, 2016 from International Serial No. PCT/US2016/017447 filed Feb. 11, 2016.
Search Report and Written Opinion dated Aug. 31, 2016 from International Serial No. PCT/US2016/036485 filed Jun. 8, 2016.
Search Report and Written Opinion dated Aug. 31, 2016 from International Serial No. PCT/US2016/036494 filed Jun. 8, 2016.

* cited by examiner

LOCKING SLIDER ASSEMBLY AND A METHOD FOR ITS MANUFACTURE

TECHNICAL FIELD

The device and methods disclosed herein relate generally to fasteners, and particularly to a locking slider assembly.

BACKGROUND ART

Slide fasteners such as zippers are used everywhere, on backpacks, handbags, luggage and clothing, as a versatile and reliable way to join two edges of fabric together. Hitherto, however, the convenience of zippers has come at a price: security. Zippers are difficult to lock, and the solutions presented thus far for securing zippers leave a lot to be desired. For instance, one popular way method for locking zippers on luggage is to padlock two sliders of a zipper together, which requires closing the zipper to the point of placing the sliders in close proximity, and attaching a padlock, presumably carried about the person of the user or in a pocket of the luggage item. This is quite inconvenient compared to the process of securing luggage with a latch, which can be performed in a single step without attaching any external equipment.

Therefore, there remains a need for a slide fastener that can be locked quickly and effectively.

SUMMARY

In one aspect, a locking slider assembly includes a slider having a follower. The assembly includes a rail engaged to the follower, so that the follower can move along the rail when the assembly is in a first state and the follower cannot move along the rail when the assembly is in a second state.

In a related embodiment, the follower includes a substantially rigid member attached to the slider. In a further embodiment, the follower also includes a biased portion. In another embodiment, the follower includes a substantially C-shaped projection attached to the slider. In an additional embodiment, the follower fits snugly over the rail. In a further embodiment, the rail has a first profile that allows the follower to slide along the rail when the assembly is in the first state and a second profile that does not allow the follower to slide along the rail when the assembly is in the second state.

In an additional embodiment, the rail has an exterior surface, and the assembly further includes an elongated actuator inside the rail and at least one member fixed to the actuator, the at least one member positioned to extend along the outside surface of the rail when the actuator moves in a first direction, and to retract into the rail through the at least one transverse opening when the actuator moves in a second direction. In a related embodiment, the at least one member further includes a plurality of members. In a further embodiment, the at least one member also includes at least one bristle. In a further embodiment still, the at least one member additionally includes a flexible piece of metal. In yet another embodiment, the at least one member further includes a flexible piece of polymer. In an additional embodiment, the actuator also includes at least one rigid bead fixedly strung on the actuator. In a related embodiment, the at least one rigid bead includes a member bead to which the at least one member is attached. In another embodiment, the at least one member and the at least one member bead form a monolithic whole.

Another embodiment includes a biasing means urging the at least one member into at least one of the extended position and the retracted position. In a further embodiment, the rail includes least one fulcrum that forces the at least one member into the extended position when the actuator is moved in the first direction. In another embodiment still, the rail also includes at least one fulcrum that forces the at least one member into the retracted position when the actuator is moved in the second direction. In another embodiment, the at least one member further includes a wedge cam, and the rail further comprises a follower. In another embodiment, the rail further includes a slit, and the follower further comprises an extension that inserts into the slit. In a further embodiment, the slider is incorporated in a slide fastener. In a further embodiment still, the assembly is incorporated in a portable container.

In another aspect, a method for manufacturing a locking sliding assembly includes producing a slider having a follower. The method includes assembling a rail having a first profile that allows the follower to slide along the rail and a second profile that does not allow the follower to slide along the rail. The method includes slidably attaching the follower to the rail.

In a related embodiment, the method further includes incorporating the rail in a portable container. In another embodiment, incorporating the rail in a portable container further includes enveloping the rail in a sleeve of flexible material and attaching the sleeve to the portable container. In an additional embodiment, the rail also includes a strip of flexible material, and incorporating the rail in a portable container further involves attaching the strip of flexible material to the portable container. In another embodiment, the portable container further includes at least one clip, and incorporating the rail in a portable container also involves inserting the rail in the at least one clip.

These and other features of the present invention will be presented in more detail in the following detailed description of the invention and the associated figures.

BRIEF DESCRIPTION OF THE DRAWINGS

The preceding summary, as well as the following detailed description of the disclosed system and method, will be better understood when read in conjunction with the attached drawings. It should be understood that the invention is not limited to the precise arrangements and instrumentalities shown.

DETAILED DESCRIPTION OF SPECIFIC EMBODIMENTS

Figure 1A:
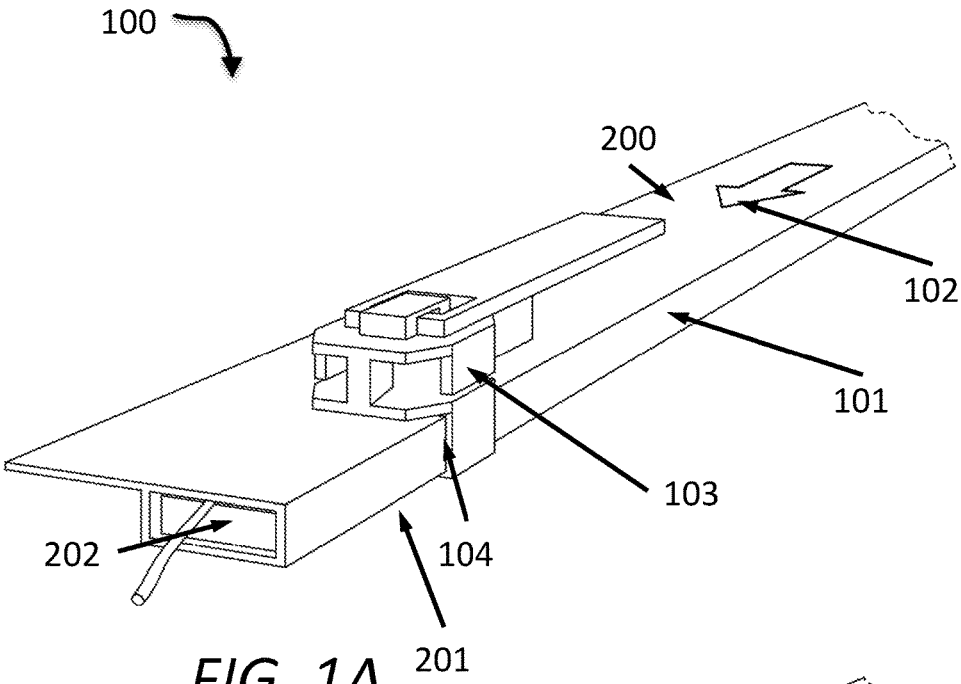
FIG. 1A is a schematic diagram illustrating an embodiment of a locking slider assembly as disclosed herein.

Embodiments of the disclosed locking slider assembly enable a user to secure one or more sliders in place on a slide fastener or similar device; the locking mechanism may lock the sliders in place regardless of the sliders' position along the slide fastener. Some embodiments enable the user to engage the locking mechanism by turning a toggle; the user may be able to lock the toggle in place, and may be able to lock multiple zippers with a single toggle.

FIGS. 1A-F depict some embodiments of a locking slider assembly 100. As an overview, the locking slider assembly includes a rail 101 having a travel direction 102. The locking slider assembly 100 includes a slider 103. The slider 103 includes a follower 104. The locking slider assembly 100 has a first state in which the follower 104 can travel along the rail and a second state in which the follower 104 cannot travel along the rail 101.

Figure 1B:
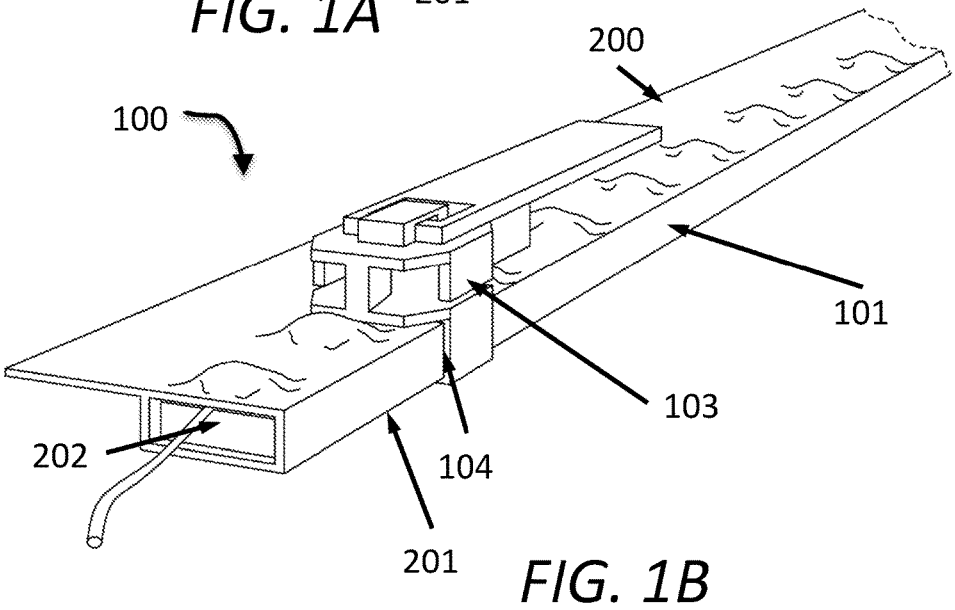
FIG. 1B is a schematic diagram illustrating an embodiment of a locking slider assembly as disclosed herein.
Figure 1C:
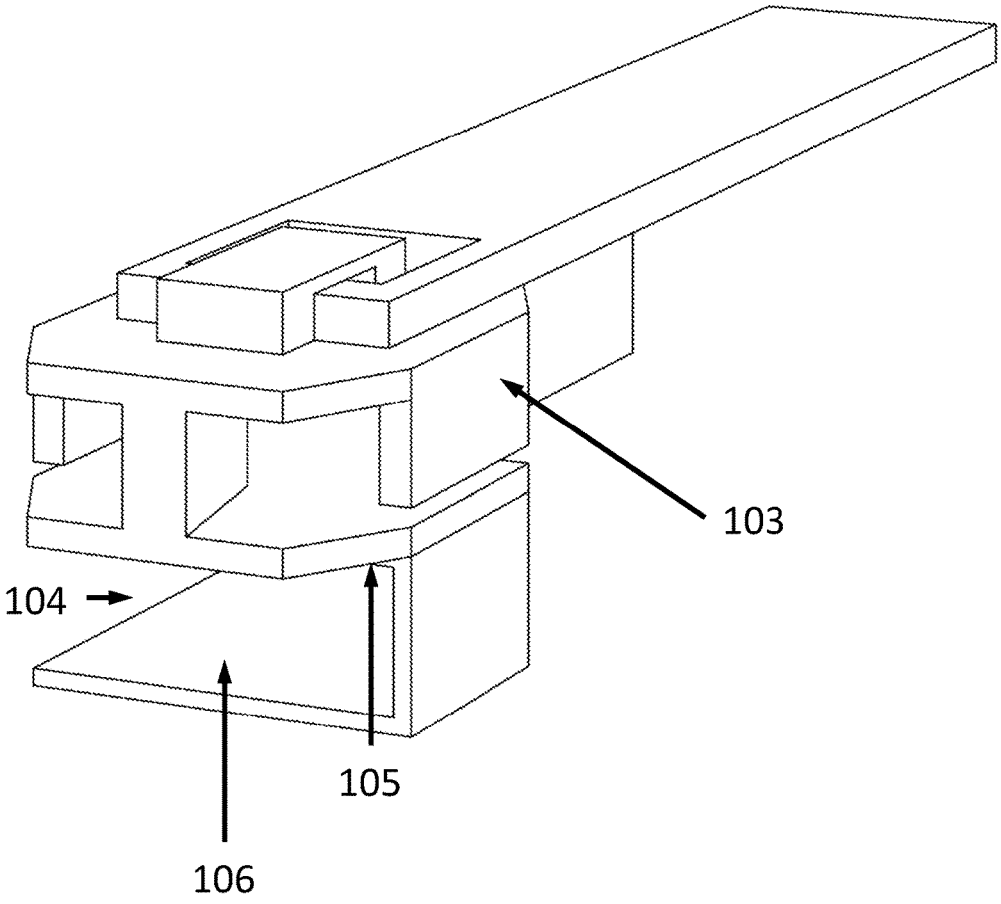
FIG. 1C is a schematic diagram illustrating an embodiment of a slider as disclosed herein.

Viewing FIGS. 1A-C in greater detail, the rail 101 may be an elongated structure along which the slider 103 can travel by sliding. The rail 101 may have a substantially uniform width and depth throughout its length, when in the first state. The rail 101 in the first state may have any suitable cross-sectional form. The cross-section of the rail 101 may have a substantially polygonal perimeter, which may be regular or irregular; for instance, the perimeter of the cross-section of the rail 101 may be substantially rectangular. The perimeter of the cross-section of the rail 101 may have a substantially curved form; for instance the perimeter may have a substantially circular or elliptical shape. The perimeter may combine straight and curved forms; for instance the perimeter may be substantially rectangular with rounded corners, or combine parts of an elliptical curve with polygonal straight portions. The length of the rail 101 may be arbitrarily great: for instance, the rail 101 may be as long as any slide fastener in which the locking slider assembly 100 is incorporated as described below.

The rail 101 may be composed of any suitable material or combination of materials. The rail 101 may be composed at least in part of substantially flexible material; for instance, the rail 101 may exhibit similar flexibility to a slide fastener in which the locking slider assembly 100 is incorporated as described in further detail below. The flexible material may include a natural polymer such as rubber or an artificial polymer such as a flexible or elastomeric plastic. The flexible material may include a natural or artificial textile material. The flexible material may include a natural or artificial membranous material, such as leather. The rail 101 may be composed in part of rigid material; for instance, the rail 101 may include one or more rigid sections. The rigid material may include without limitation metal, rigid plastic, wood, or fiberglass.

Figure 12A:
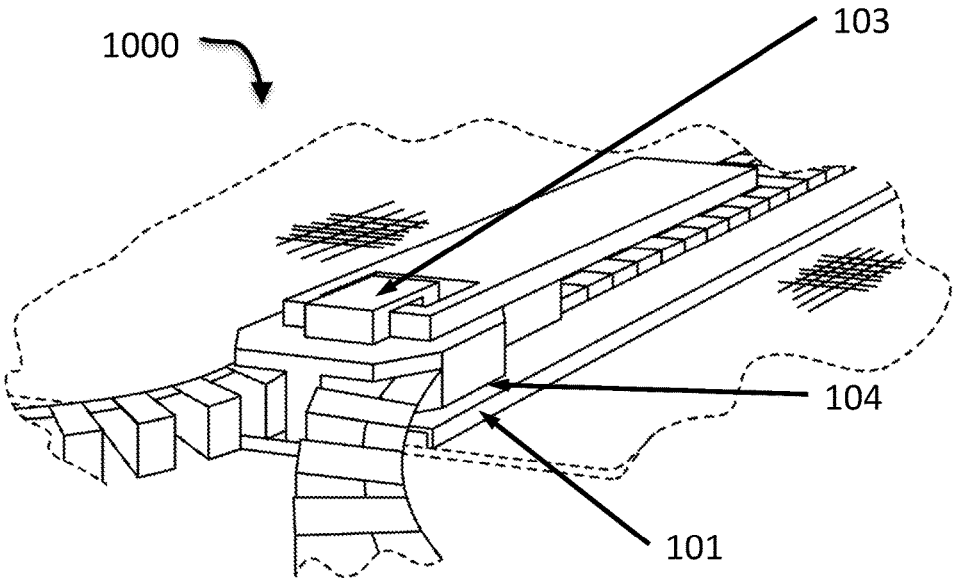
FIG. 12A is a schematic diagram illustrating an embodiment of a locking slider assembly as disclosed herein.
Figure 12B:
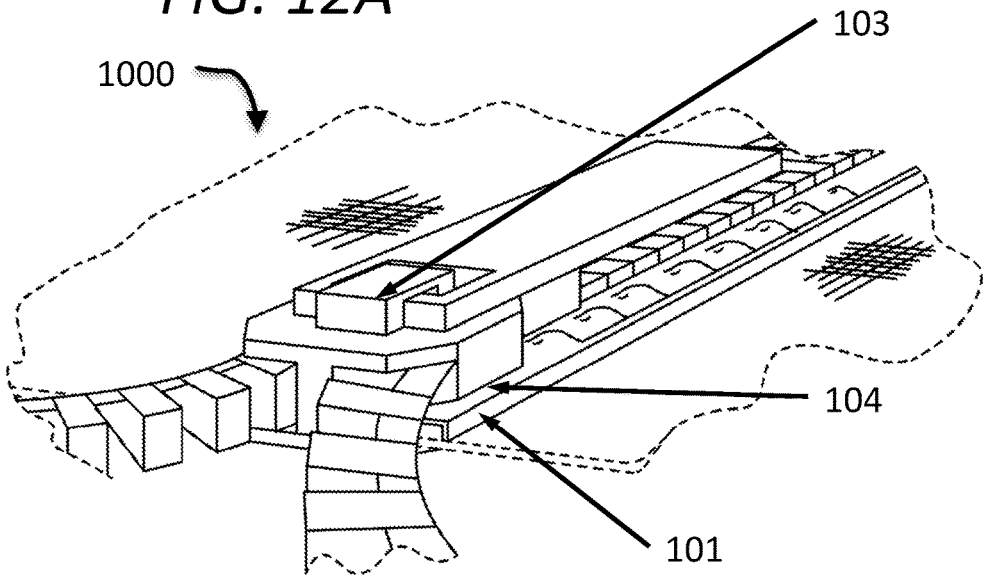
FIG. 12B is a schematic diagram illustrating an embodiment of a locking slider assembly as disclosed herein.
Figure 12C:
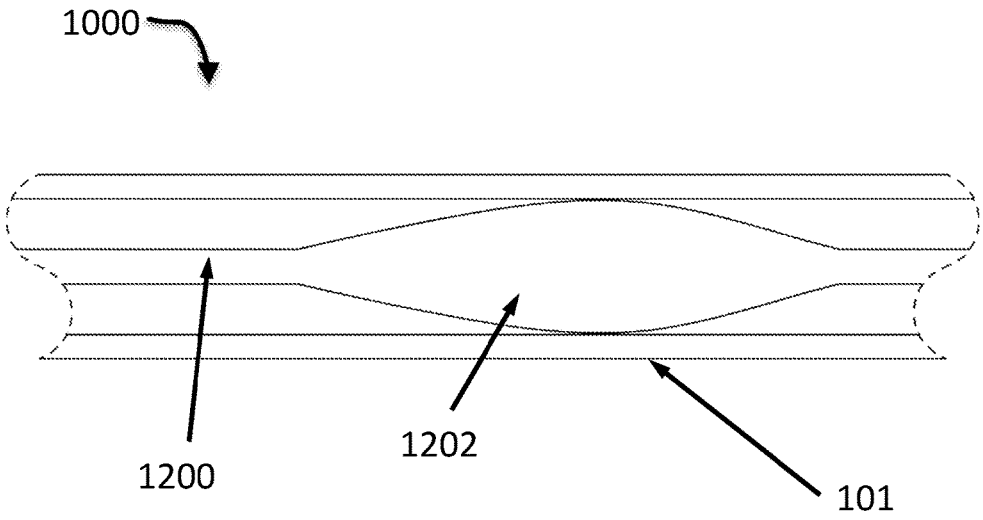
FIG. 12C is a schematic diagram illustrating an embodiment of a rail as disclosed herein.
Figure 12D:
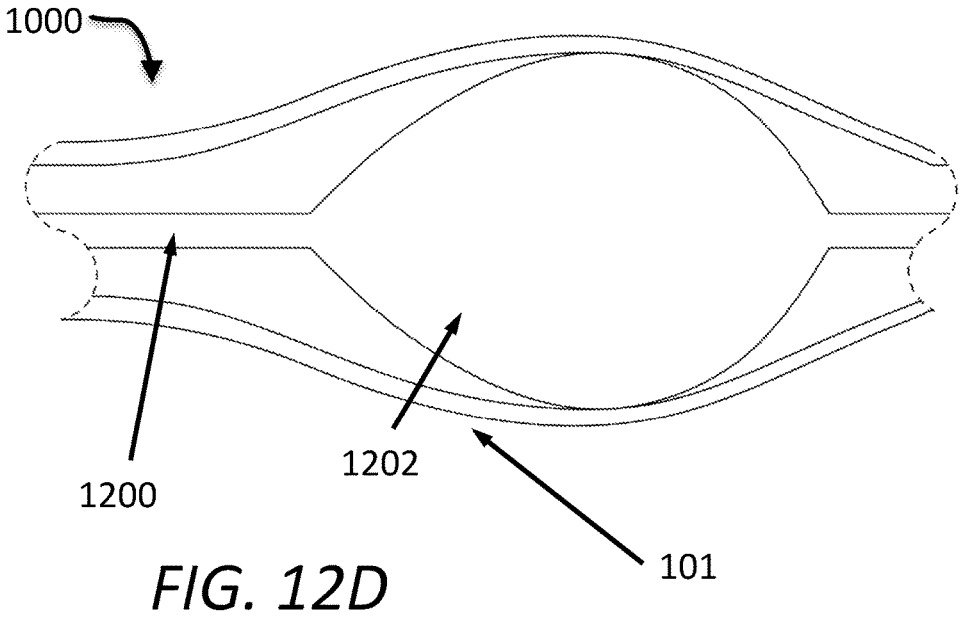
FIG. 12D is a schematic diagram illustrating an embodiment of a rail as disclosed herein.
Figure 12E:
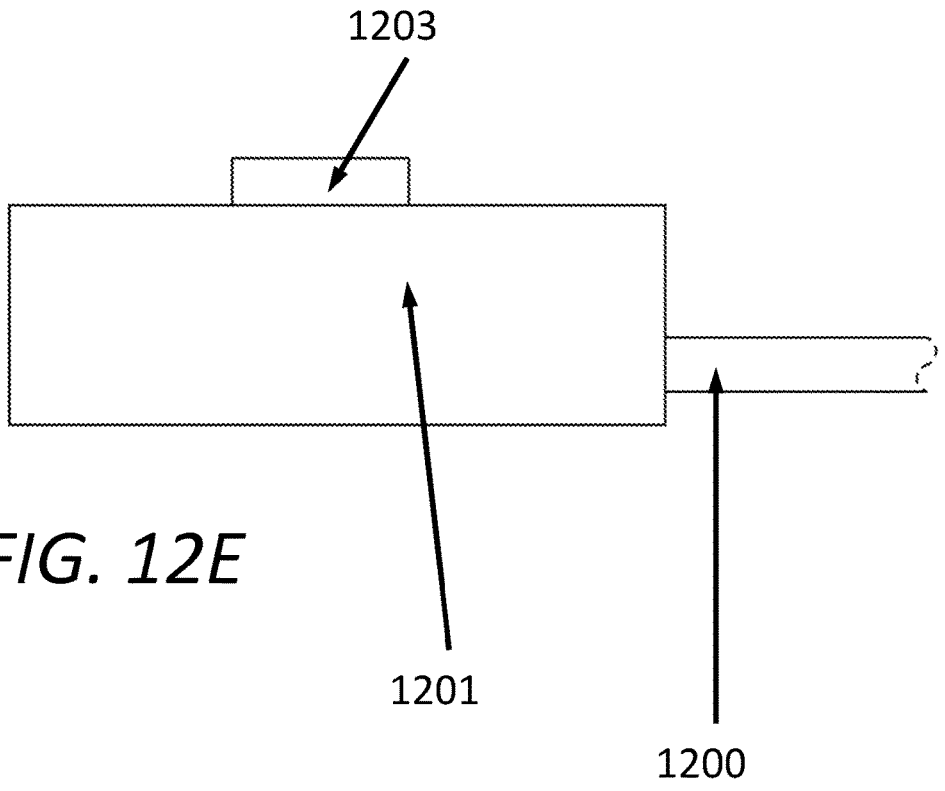
FIG. 12E is a schematic diagram illustrating an embodiment of a pressure actuator as disclosed herein.

The rail 101 may be below the slider 103 as shown for example in FIG. 1A, or the rail 101 may be inserted through the slider 103 as shown for instance in FIG. 12A. In the latter case, the follower 104 may be a portion of the slider 103, or in other words, the same component may function both as the slider 103 and the follower 103.

Figure 1D:
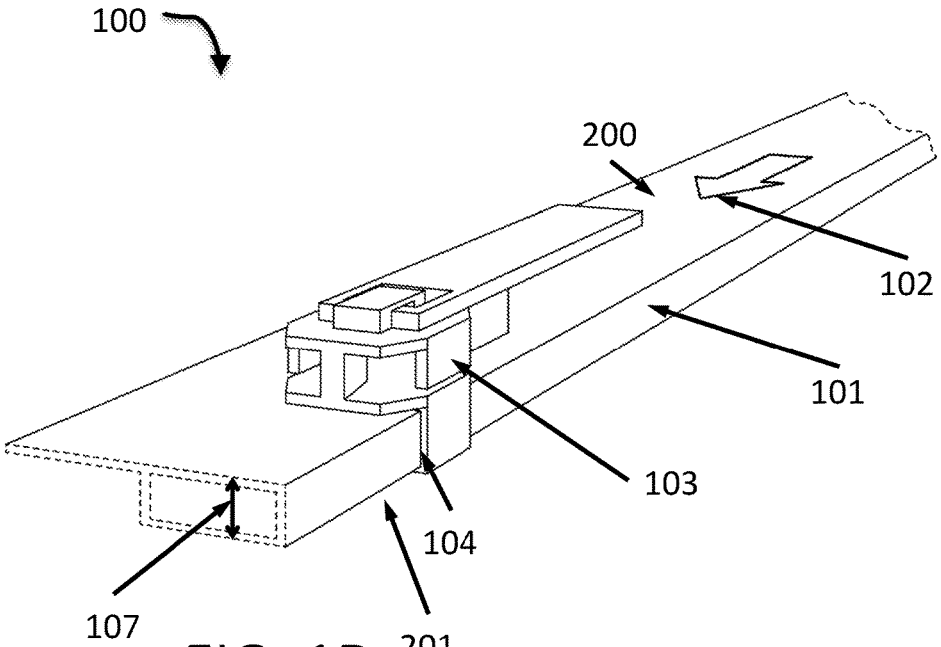
FIG. 1D is a schematic diagram illustrating an embodiment of a partially cross-sectioned locking slider assembly as disclosed herein.
Figure 1E:
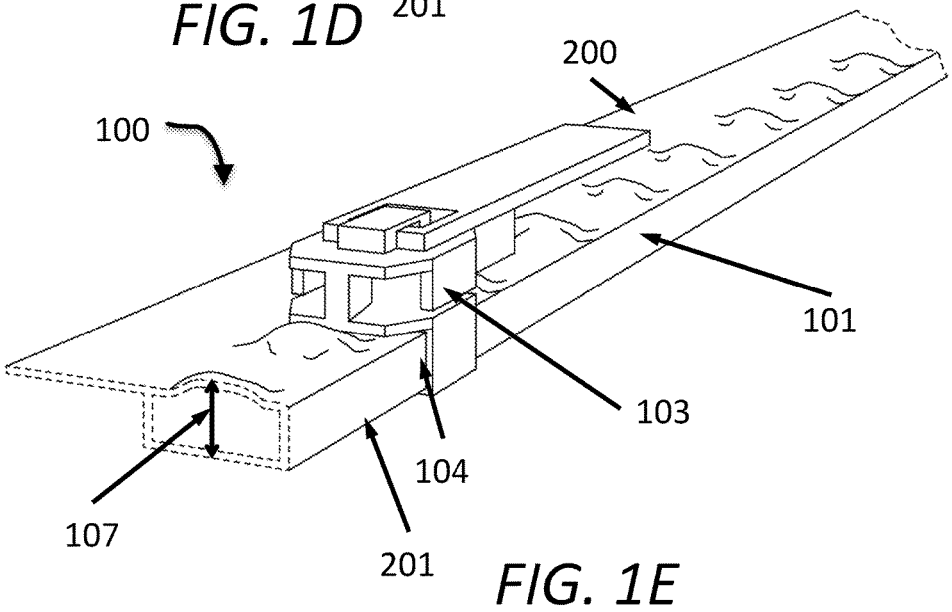
FIG. 1E is a schematic diagram illustrating an embodiment of a partially cross-sectioned locking slider assembly as disclosed herein.
Figure 1F:
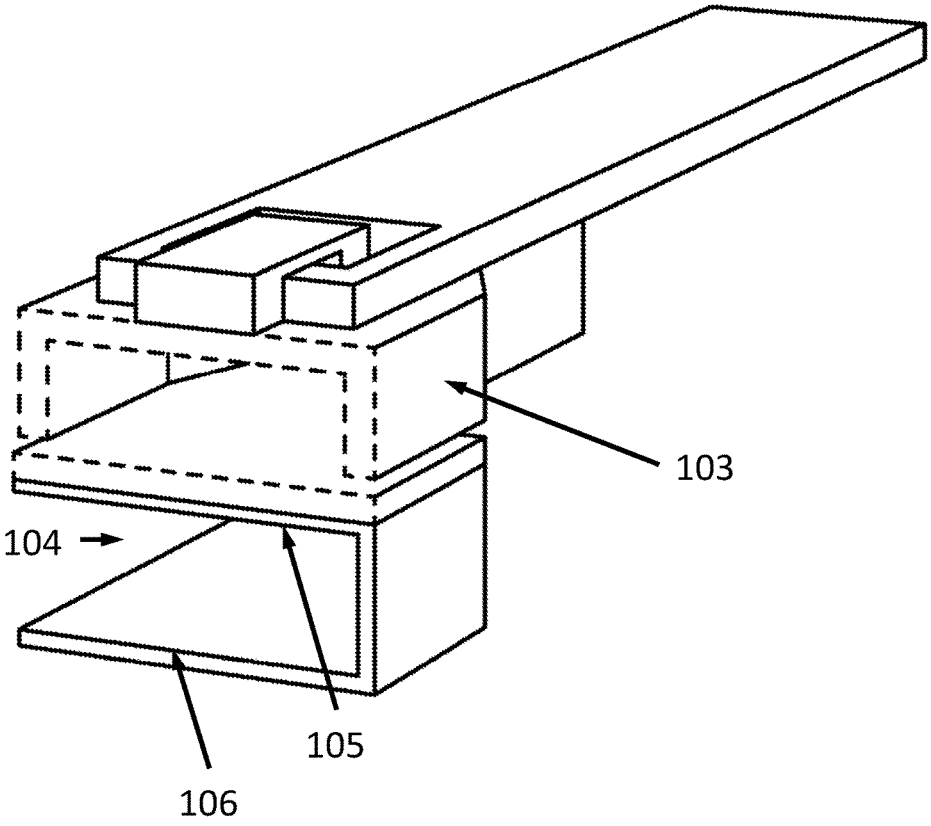
FIG. 1F is a schematic diagram illustrating an embodiment of a partially cross-sectioned slider as disclosed herein.

In some embodiments, the rail 101 has a first profile that allows the follower 104 to slide along the rail 101 when the assembly 100 is in the first state and a second profile that does not allow the follower 104 to slide along the rail 101 when the assembly 100 is in the second state. For example, in some embodiments the rail 101 has a cross-sectional dimension 107, as shown in FIGS. 1D-E. The rail 101 may be switchable between a first state in which the cross-sectional dimension 107 has a first value, as shown for example in FIGS. 1A and 1D and a second state in which the cross-sectional dimension 107 has a second value, as shown for instance in FIGS. 1B and 1E, the second value greater than the first value. The follower 104 may be slidably engaged to the rail by way of a slot. The slot may have a first surface 105 and a second surface 106. The first surface 105 and second surface 106 may be separated by a distance aligned with the cross-sectional dimension that is greater than the first value of the cross-sectional dimension and less than or equal to the second value of the cross-sectional dimension. As a result, the slot 104 may be able to slide over the rail 101 when the rail 101 is in the first state, and the slot 104 may be unable to slide over the rail 101 when the rail 101 is in the second state.

Figure 11A:
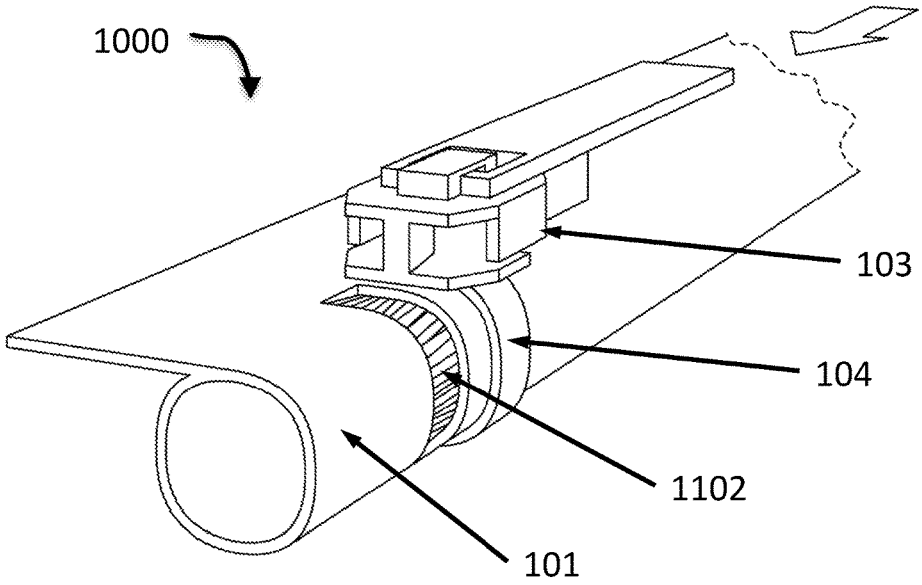
FIG. 11A is a schematic diagram illustrating an embodiment of a locking slider assembly as disclosed herein.
Figure 11B:
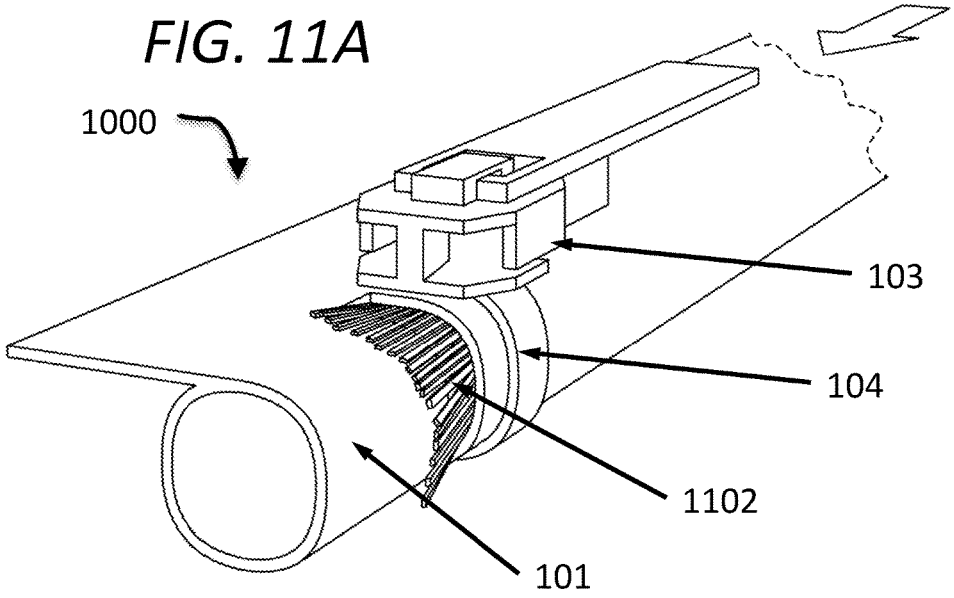
FIG. 11B is a schematic diagram illustrating an embodiment of a locking slider assembly as disclosed herein.
Figure 11C:
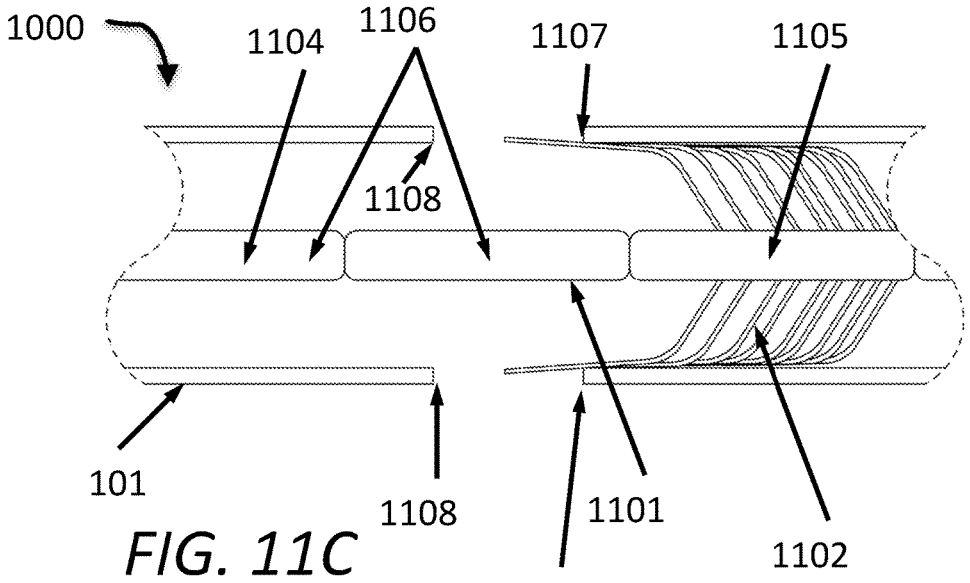
FIG. 11C is a schematic diagram illustrating an embodiment of a rail as disclosed herein.
Figure 11D:
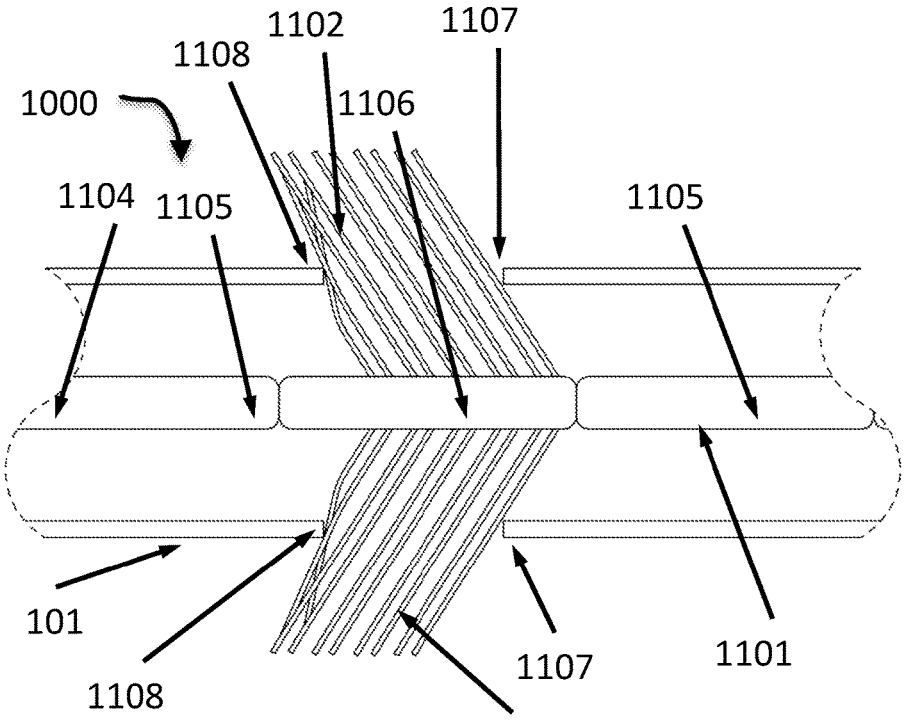
FIG. 11D is a schematic diagram illustrating an embodiment of a rail as disclosed herein.
Figure 11E:
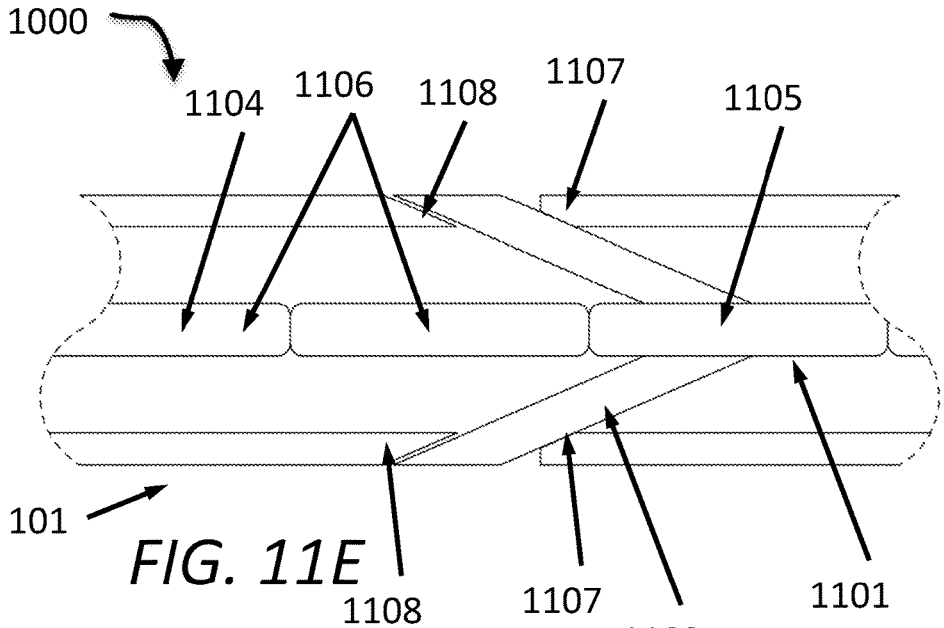
FIG. 11E is a schematic diagram illustrating an embodiment of a rail as disclosed herein.
Figure 11F:
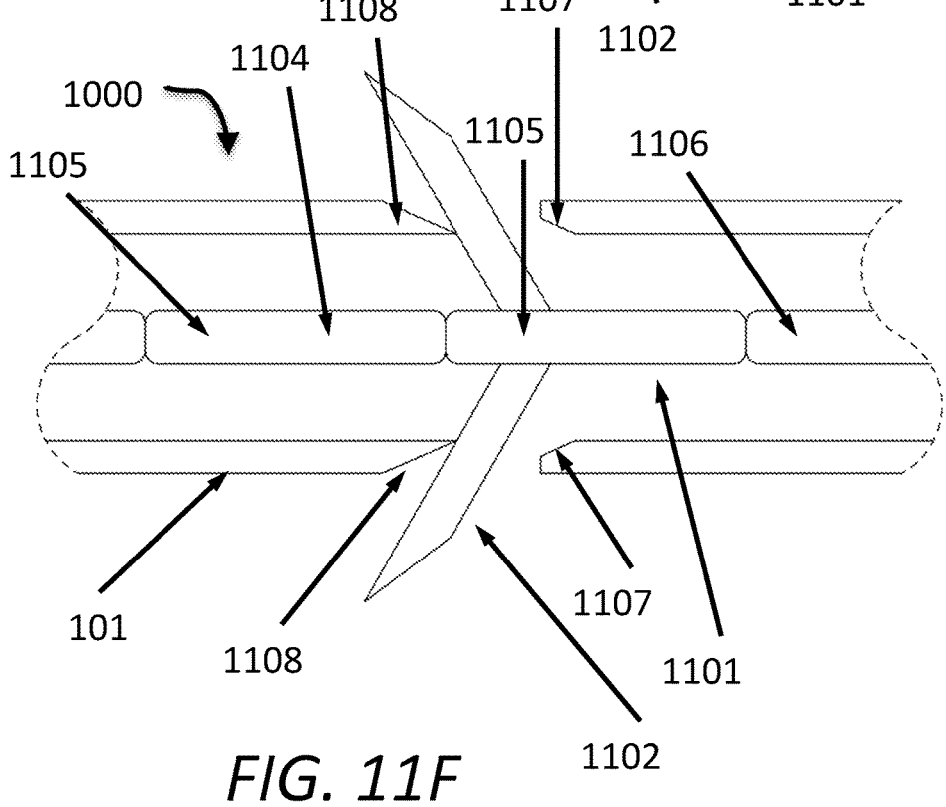
FIG. 11F is a schematic diagram illustrating an embodiment of a rail as disclosed herein.
Figure 11G:
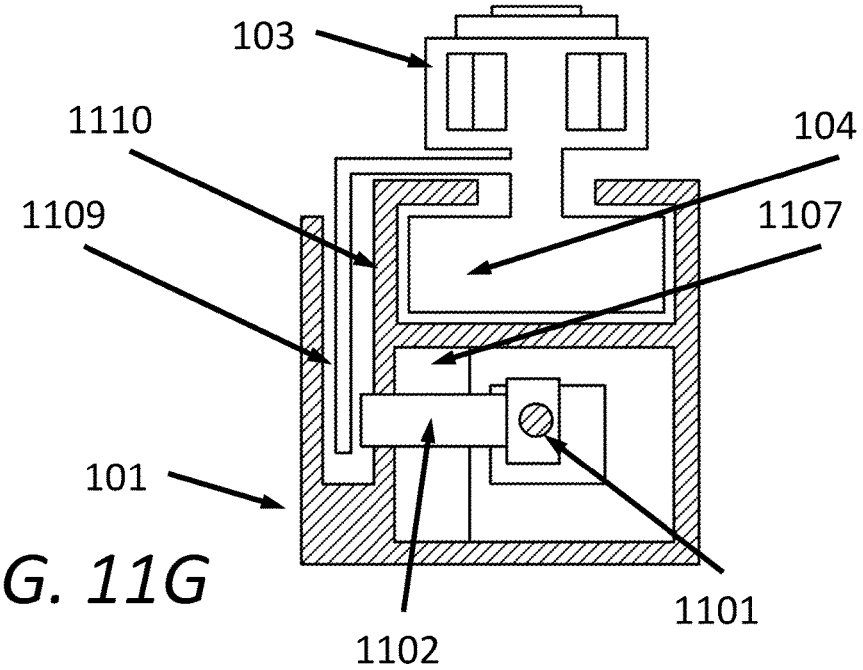
FIG. 11G is a cross-sectional view of an embodiment of the locking slider arrangement.
Figure 11H:
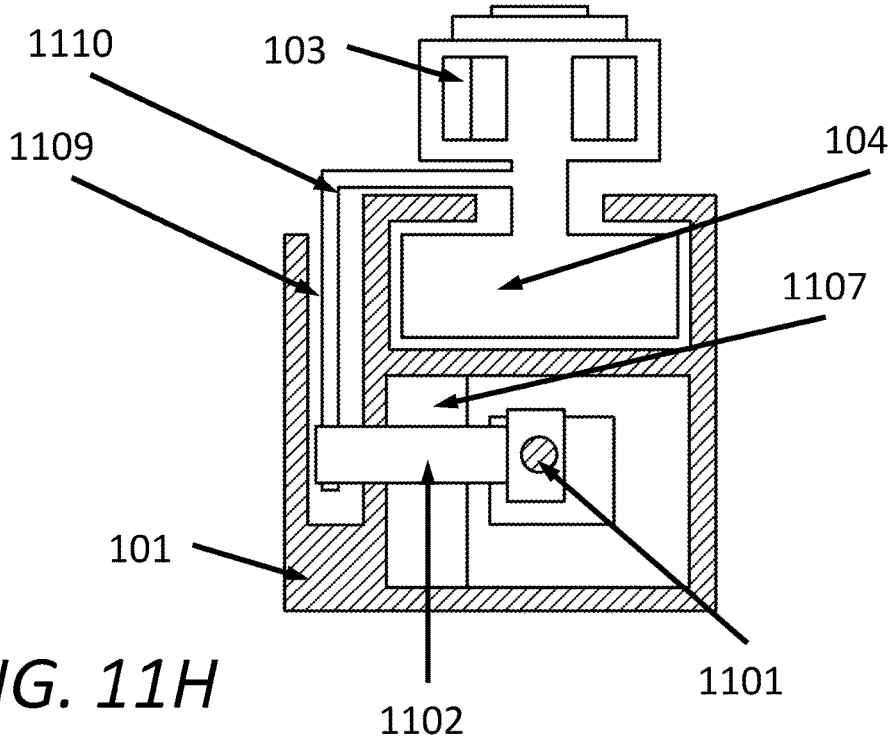
FIG. 11H is a cross-sectional view of an embodiment of the locking slider arrangement.

The rail 101 may have a slot 1109 into which an extension 1110 of the follower 104 inserts, as shown for instance in FIGS. 11G-H. In some embodiments, the rail 101 modifies its profile by modifying the slot 1109 to make the extension 1110 unable to slide through the slot 1109, for instance as described in further detail below in reference to FIGS. 11G-H.

In some embodiments as shown above, the follower 104 partially encircles the rail 101 to maintain the follower in contact with the rail; in other embodiments, the rail 101 includes a groove 1111 that retains the follower 104 in contact with the rail. For instance, the groove 1111 may have overhanging edges that retain a corresponding member 1112 of the follower that has projecting edges; the member 1112 may be a flanged or T-shaped projection, and the groove 1111 may have a similarly T-shaped cross-section, or a cross-section that admits the flanged member 1112 so that the latter is retained within the groove 1111.

The cross-sectional dimension may be any dimension substantially orthogonal to the travel direction 102; for instance, the cross-sectional dimension may be a height of the rail 101, for instance as illustrated in FIGS. 1A-B and 1D-E, a width of the rail 101, a diameter across the rail 101 as illustrated in FIGS. 2E-2H or any other dimension measurable between two points on a cross-section of the rail 101 where the cross-section is taken to be substantially orthogonal to the travel direction 102. The rail 101 may be switched between two states, as illustrated in FIGS. 1A-B and FIGS. 1D-E. The dimension 107 is greater in the second state, as illustrated for instance in FIGS. 1B and 1E than in the first state, as illustrated for example in FIGS. 1A and 1D; in other words, in the direction of measurement of the dimension 107 the rail 101 may expand when switching from the first state to the second state. The expansion may not be uniform along the length of the rail 101; for instance, the expansion may occur at a series of substantially evenly spaced locations along the rail 101, leaving the area between those locations relatively unchanged. In some embodiments, as illustrated for instance in FIGS. 2E-F, the dimension 107 expands without increasing the total circumference of the cross-section of the rail 101 where the expansion occurs; in other words, the increase in the dimension 107 is matched by a decrease in a second dimension, for instance turning the circular cross-section of a cylindrical tubular rail 101 into an elliptical cross-section, at least where the dimension 107 is being modified. In other embodiments, as illustrated for instance in FIGS. 2G-H, the total circumference of the cross-section increases when the dimension 107 increases; in other words, a second dimension may stay the same or increase as well.

FIGS. 2A-D depict side views of an embodiment of the rail 101 in the first and second states, respectively. In some embodiments, as shown in, the rail 101 includes a top surface 200. The rail 101 may include a bottom surface 201. In some embodiments, the height of the rail 101 is the distance from the bottom surface 201 to the top surface 200. The rail 101 may change its height from the first state to the second using a mechanism 202 disposed between the top surface and bottom surface that pushes the top and bottom surfaces apart to change the rail to the second state. In some embodiments, as shown in FIGS. 1A-B, the rail includes a tube having an exterior including the top surface and bottom surface and an interior containing the mechanism 202. In some embodiments, at least one of the top surface 200 and the bottom surface 201 is composed at least in part of flexible material. Returning to FIGS. 2A-B, the mechanism 202 may include at least one wedge cam 203. The wedge cam 203 may have a cam face 204 forming an angle with the top surface 200. The cam face 204 may alternatively form an angle with the bottom surface 201 or the bottom surface. The at least one wedge cam 203 may be constructed of substantially rigid material. The at least one wedge cam 203 may be attached to the rail 101 or may rest inside the rail 101. For instance, where the rail 101 is a tube, the at least one wedge cam 203 may rest inside the tube; the at least one wedge cam 203 may be attached to a surface of the interior of the tube. The at least one wedge cam 203 may be a part of an elongated structure such as a strip that sits inside the tube; the elongated structure may be attached to a surface of the interior of the tube. The at least one wedge cam 203 include a plurality of wedge cams; for instance, the at least one wedge cam 203 may include a plurality of wedge cams incorporated in a long strip of material that is placed inside the tube. The at least one wedge cam 203 may be a flat planar wedge; in other embodiments, the at least one wedge cam 203 has a conical or otherwise curved cam face 204; the cam face 204 may extend all the way around the wedge cam 203 when the wedge cam 203 is conical.

The mechanism 202 may include an actuator 205. In some embodiments, the actuator 205 is flexible; for instance, the actuator 205 may be or include a wire, such as a plastic or metal wire. The actuator 205 may include or be a string or yarn. The actuator 205 may include or be a cable, such as a cable suitable for use in bicycle brakes or similar devices.

The actuator 205 may be slidable over the at least one wedge cam 203; for example, the actuator may rest on top of the at least one wedge cam 203. The actuator 205 may have at least one bead 206. In some embodiments, a bead 206 is a physical object, attached to the actuator 205, that has a greater cross-sectional area than the actuator 205. In some embodiments, the actuator passes through the bead 206; for instance, the bead 206 may have a hole through it, through which the actuator 205 is strung, similarly to a necklace. The bead 206 and actuator 205 may also be manufactured together; for instance, the bead 206 and actuator 205 may be extruded or molded together. In some embodiments, the at least one bead 206 is affixed to the actuator 205; in other words, the bead 206 may not slide along the actuator 205. The at least one bead 206 may have any shape, including a substantially spherical shape, a spheroidal shape, a regular or irregular polyhedral shape, or any combination of curved and polyhedral forms; for instance, the at least one bead 206 may have a form that presents a concave surface to a convex cam face 204, or the bead 206 may have a form that presents a convex surface to a concave cam face 204. The at least one bead 206 may be a plurality of beads; there may be a bead resting near each wedge cam 203. In some embodiments, sliding the actuator 205 in a first direction 207 causes the at least one bead 206 to travel up the wedge cam 203 and push the upper surface 200 and lower surface apart 201. The upper surface 200, lower surface 201 or both may deform where each bead 206 is riding up the cam surfaces 203, increasing the height of the rail 101 at that point; in some embodiments, increasing the height of the rail 101 at least at one point along the rail 101 is increasing the height of the rail. The result of the actuator 205 being pulled or pushed in the first direction 207 thus may be to create a series of lumps or similar protrusions in the top surface 200 or bottom surface 201 of the rail, blocking the slot 104 from sliding over the rail, for instance as illustrated in FIG. 1B. In some embodiments, the mechanism 202 includes more than one actuator 205 with beads 206; the plurality of actuators 202 may be coupled in parallel so that a force pulling one in the first direction pulls the others as well. As a result, the rail 101 may expand in more than one dimension at the same time.

Figure 2A:
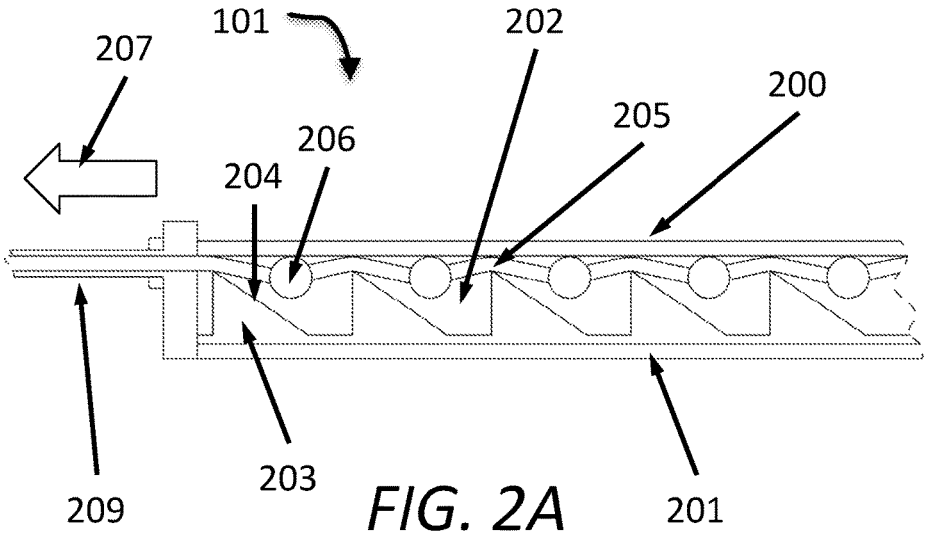
FIG. 2A is a schematic diagram illustrating an embodiment of a rail as disclosed herein.
Figure 2B:
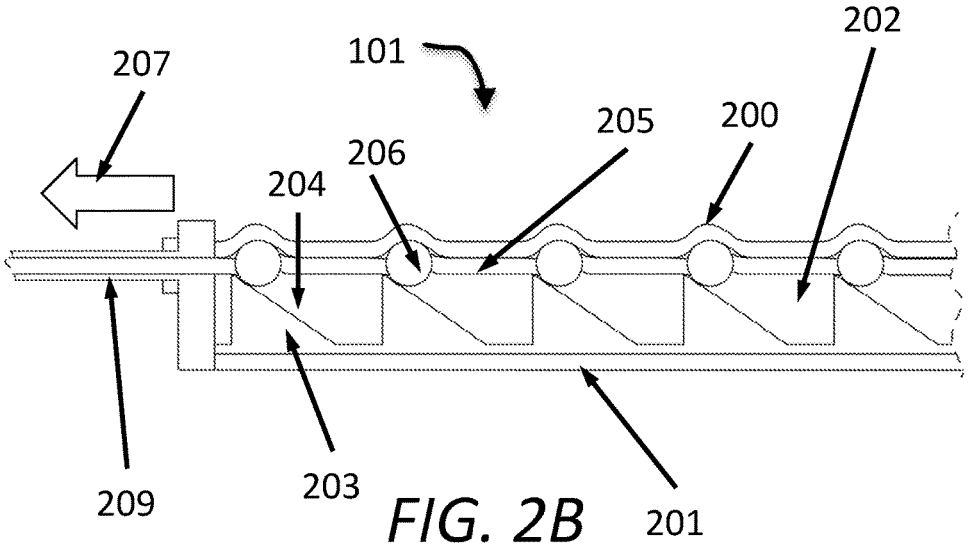
FIG. 2B is a schematic diagram illustrating an embodiment of a rail as disclosed herein.
Figure 2C:
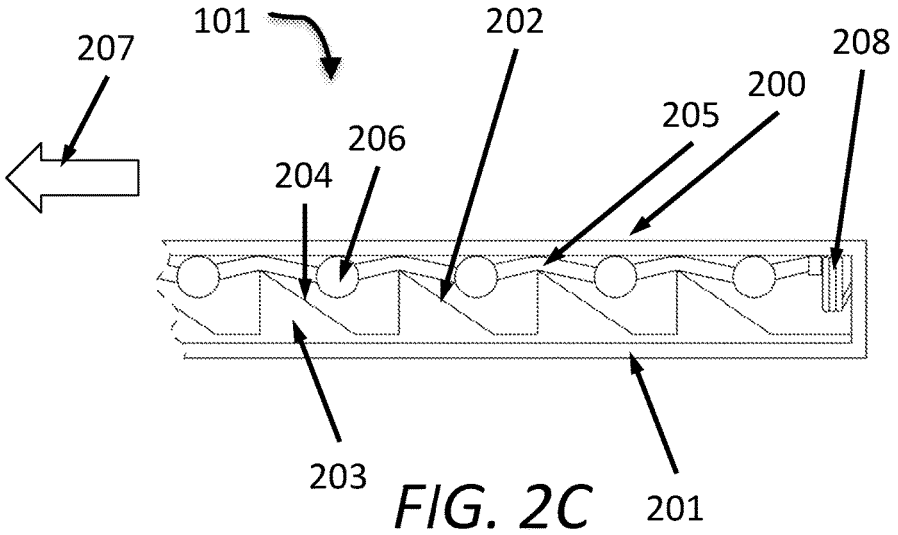
FIG. 2C is a schematic diagram illustrating an embodiment of a rail as disclosed herein.
Figure 2D:
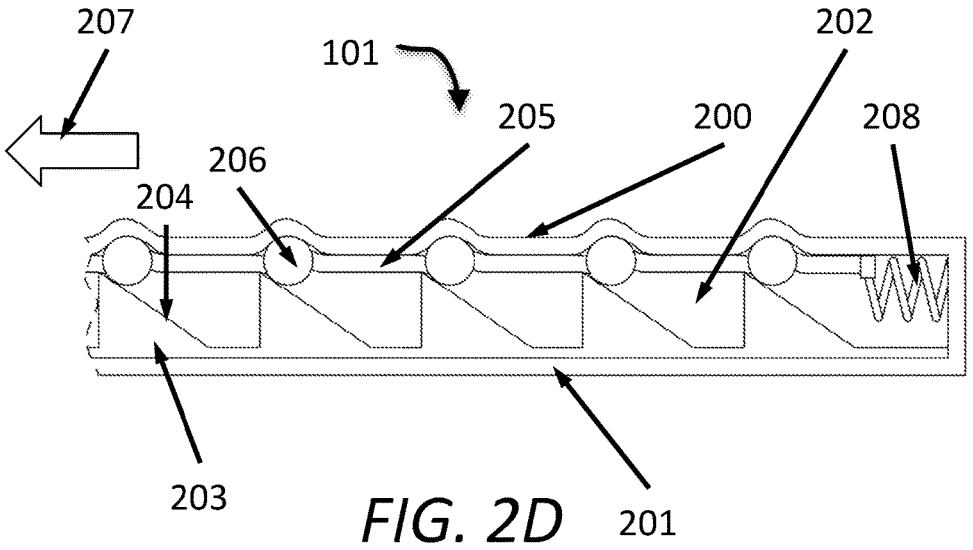
FIG. 2D is a schematic diagram illustrating an embodiment of a rail as disclosed herein.
Figure 2E:
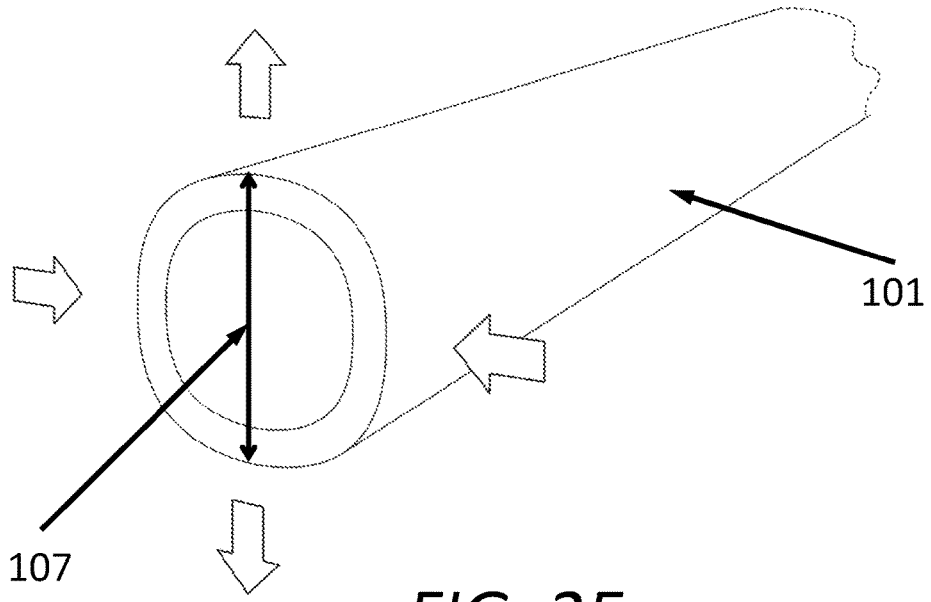
FIG. 2E is a schematic diagram illustrating an embodiment of a rail as disclosed herein.
Figure 2F:
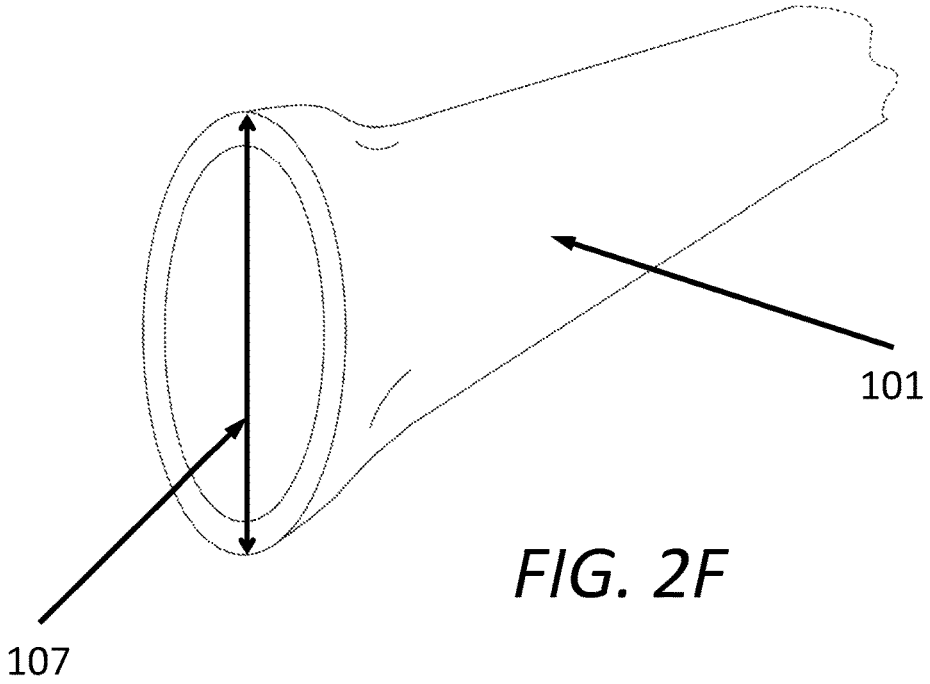
FIG. 2F is a schematic diagram illustrating an embodiment of a rail as disclosed herein.
Figure 2G:
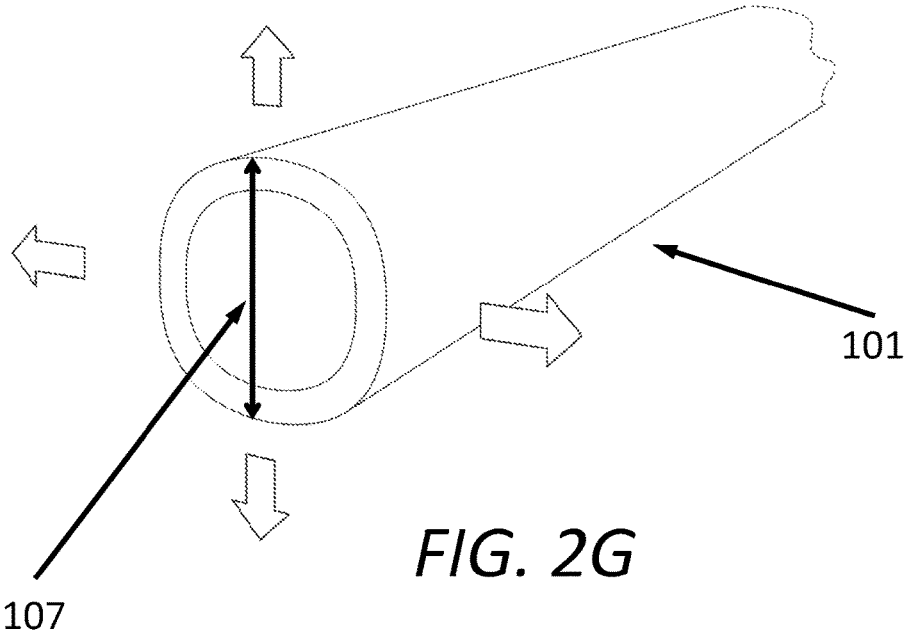
FIG. 2G is a schematic diagram illustrating an embodiment of a rail as disclosed herein.
Figure 2H:
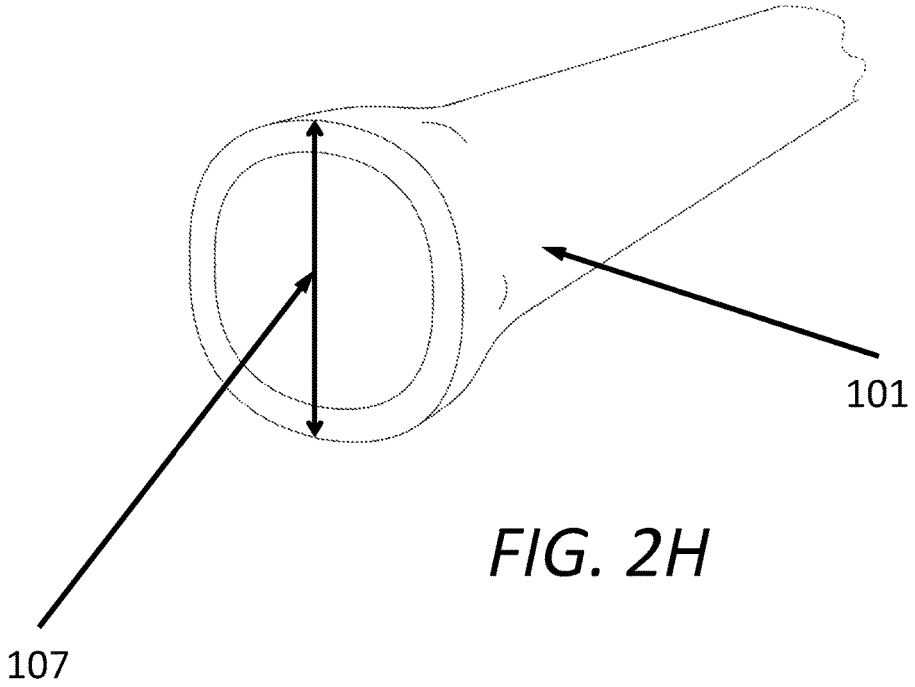
FIG. 2H is a schematic diagram illustrating an embodiment of a rail as disclosed herein.

As shown in FIGS. 2C-D, the mechanism 202 may include a biasing means 208 having a bias that tends to resist movement of the actuator 205 in the first direction 207. The biasing means 208 may be a spring, or a piece of elastic material. The biasing means 208 may act as a return spring, so that when a force pulling the actuator 205 in the first direction 207 is released, the biasing means 208 will pull the actuator 205 in a second direction that is the opposite direction from the first direction; as a result, the at least one bead 206 may travel back down the at least one wedge cam 203 and the rail 101 may return to the first state.

Figure 3:
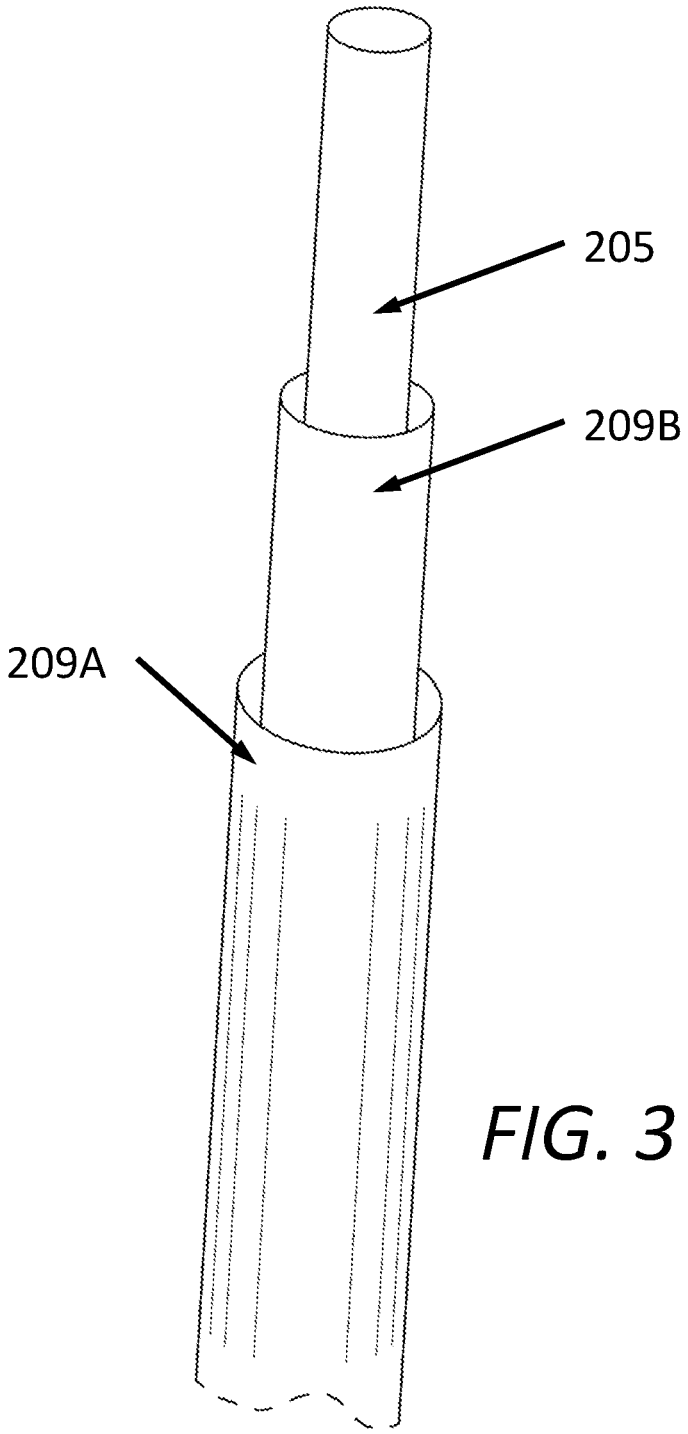
FIG. 3 is a schematic diagram illustrating an embodiment of a portion of a sheath and actuator as disclosed herein.

In some embodiments, as shown for instance in FIGS. 2A-B, a portion of the actuator 205 projects away from the rail 101; for instance, where the rail 101 is a tube, the actuator may exit the tube. The locking slider assembly 100 may include a sheath 209 containing the portion of the actuator 205 that projects away from the rail 101. The sheath 209 may be constructed from any material or combination of materials suitable for the construction of the rail 101. The sheath 209 may be flexible. The sheath 209 may be flexible but inelastic; the sheath 209 may function similarly to the sheath of a Bowden cable. For instance, as shown in FIG. 3, the sheath may include an outer layer 209*a*; the outer layer may be flexible, but sufficiently inelastic to resist longitudinal compression, so that when a mechanism attached to an end of the outer layer 209*a* pulls or pushes the actuator 205 while pulling or pushing the outer layer 209*a* in the other direction, in a manner analogous to a bicycle brake. The outer layer 209*a* may contain winding or twined wires, or polymer material having similar properties, to add stiffness to the outer layer 209*a*. Viewing FIGS. 2A-B again, the outer layer 209*a* may be attached to the end of the rail 101 by a nut 210. The nut 210 may be adjustable to move the end of the outer layer 209*a*, modifying the length of the outer layer 209*a*; lengthening the outer layer 209*a* may have the effect of adding tension to the actuator 205, while shortening the outer layer 209*a* may have the effect of reducing tension on the actuator 205. The sheath 209 may also include an inner layer 209*b*. The inner layer 209*b* may have low friction, to make the actuator move more easily within the sheath 209.

Figure 4A:
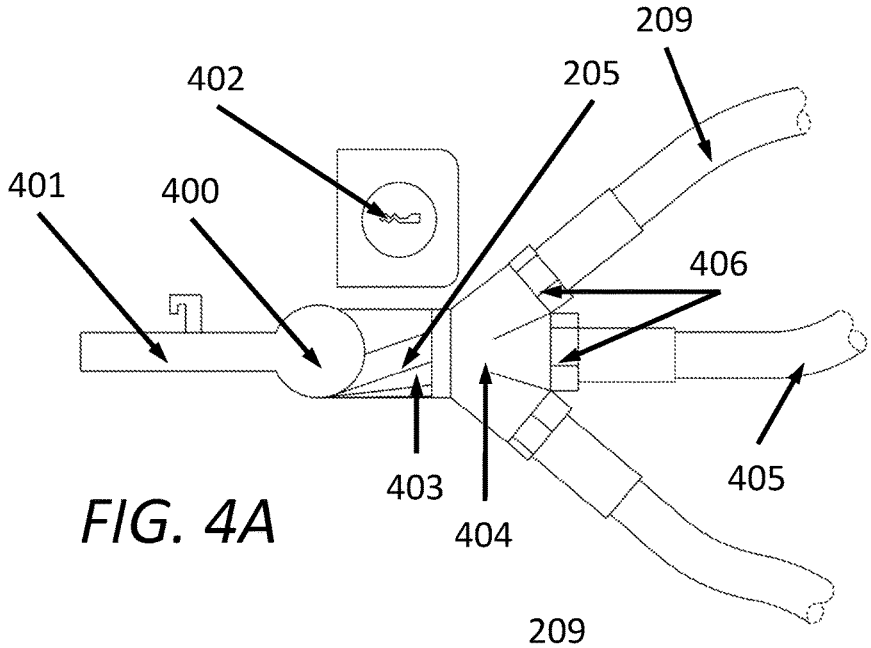
FIG. 4A is a schematic diagram illustrating an embodiment of a spool as disclosed herein.
Figure 4B:
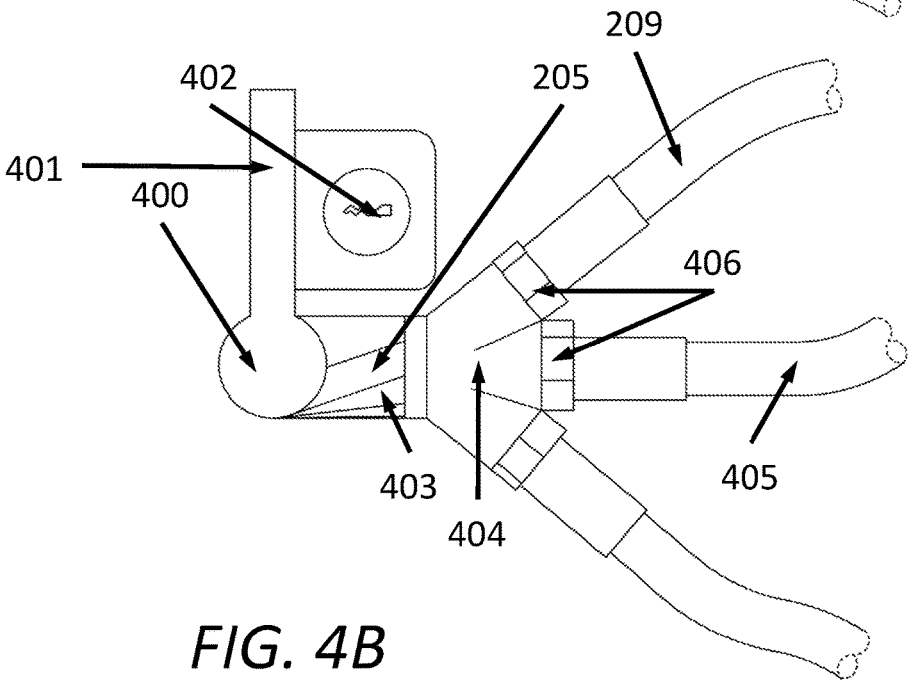
FIG. 4B is a schematic diagram illustrating an embodiment of a spool as disclosed herein.
Figure 4C:
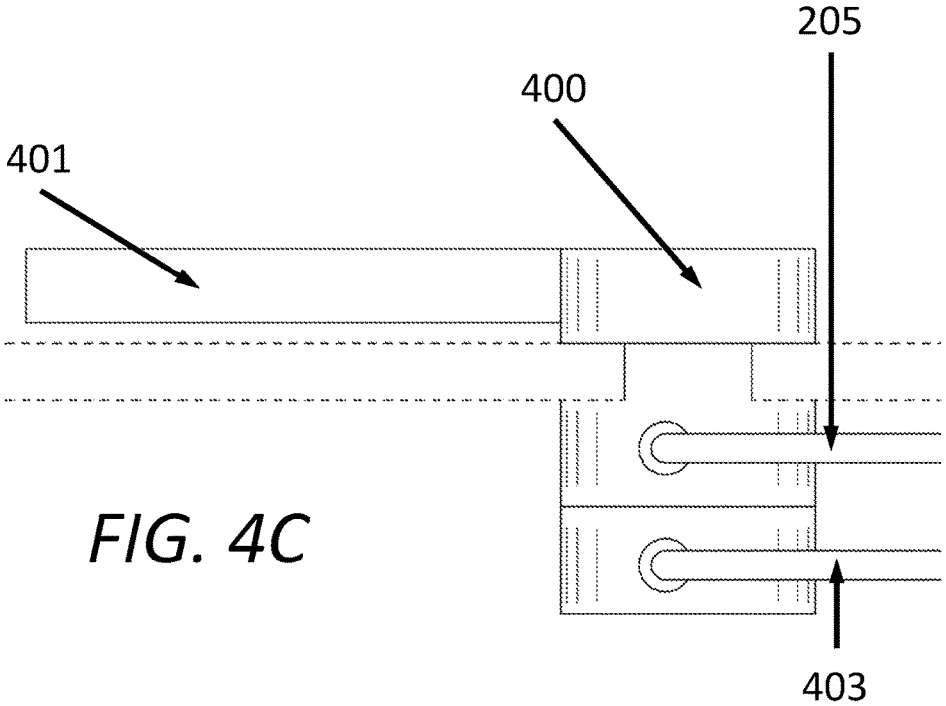
FIG. 4C is a schematic diagram illustrating an embodiment of a spool as disclosed herein.
Figure 4D:
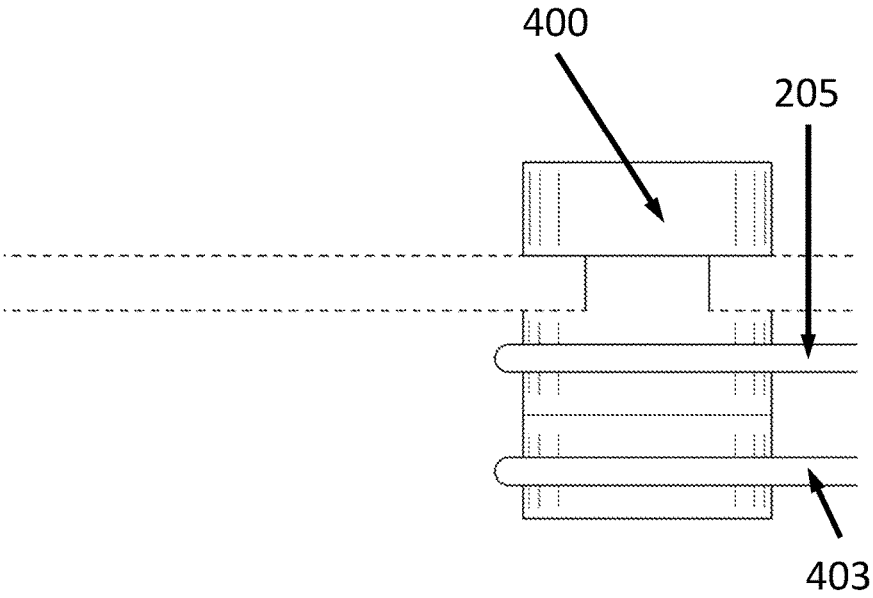
FIG. 4D is a schematic diagram illustrating an embodiment of a spool as disclosed herein.

Turning now to FIGS. 4A-B, the assembly 100 may include a spool 400 to which one end of the actuator 205 is fixed, so that rotating the spool to a locking position causes the actuator 205 to slide in the first direction. The spool 400 may be substantially cylindrical, so that the actuator 205 winds onto the spoon in a similar manner to a cable on a winch or a sewing thread on a sewing thread spool. In some embodiments, rotating the spool from the unlocked position shown in FIG. 4A to the locked position shown in FIG. 4B causes the actuator 205 to wind onto the spool, pulling the actuator 205 in the first direction, and putting the rail 101 in the second state. This is illustrated for example in FIGS. 4C-D: FIG. 4C illustrates an embodiment of the spool 400 as seen from the side with an end the actuator 205 attached to it, and FIG. 4C illustrates the same embodiment with the spool 400 rotated, and the actuator 205 wound around the substantially cylindrical spool, pulling the actuator 205 in the desired direction. A user may turn the spool 400 to the locking position or the unlocking position by manipulating a lever 401 or similar manual interface device. In some embodiments, the assembly 100 includes a latch 402 that secures the spool 400 in the locking position. The latch 402 may attach to a projection from the lever 401. The latch 402 may be opened by a button or switch; alternatively the latch 402 may include a lock, which may function in any suitable way, and may include, without limitation, a combination lock or a lock that accepts a key.

Figure 5A:
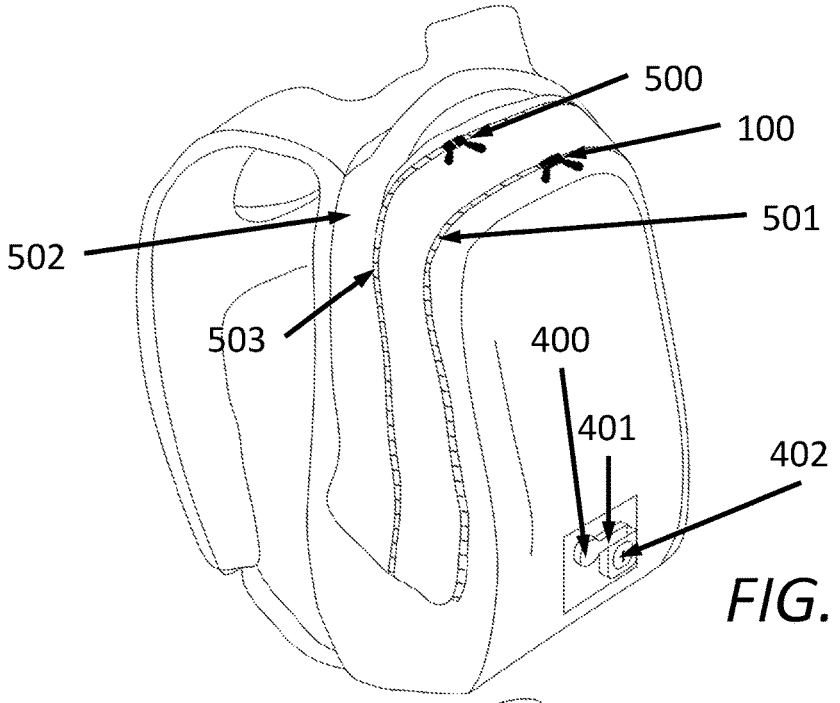
FIG. 5A is a schematic diagram illustrating an embodiment of a backpack incorporating an embodiment of the locking slider assembly as disclosed herein.
Figure 5B:
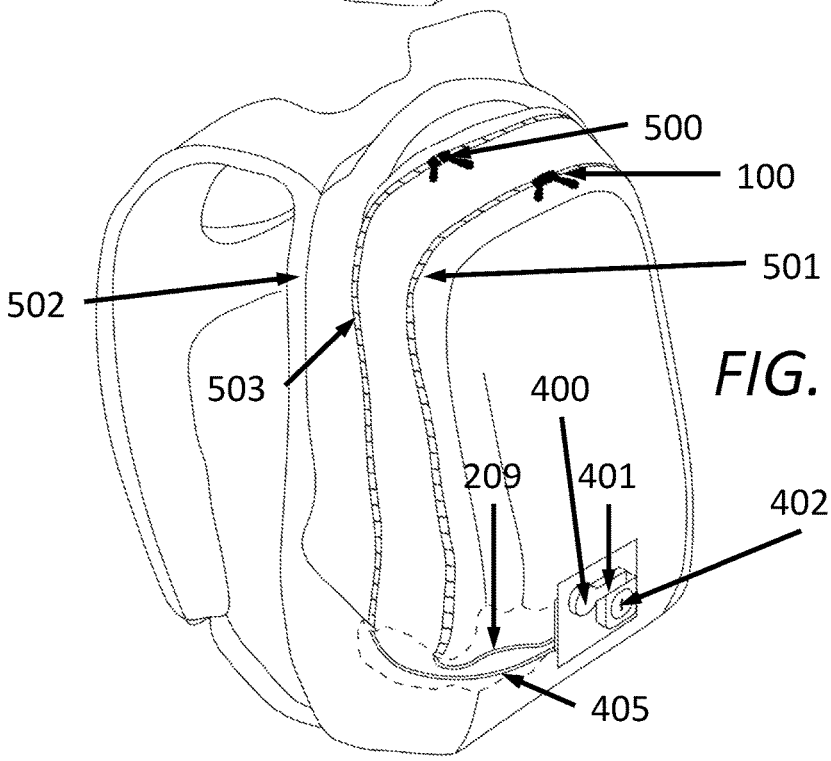
FIG. 5B is a schematic cutaway diagram illustrating an embodiment of a backpack incorporating an embodiment of the locking slider assembly as disclosed herein.
Figure 5C:
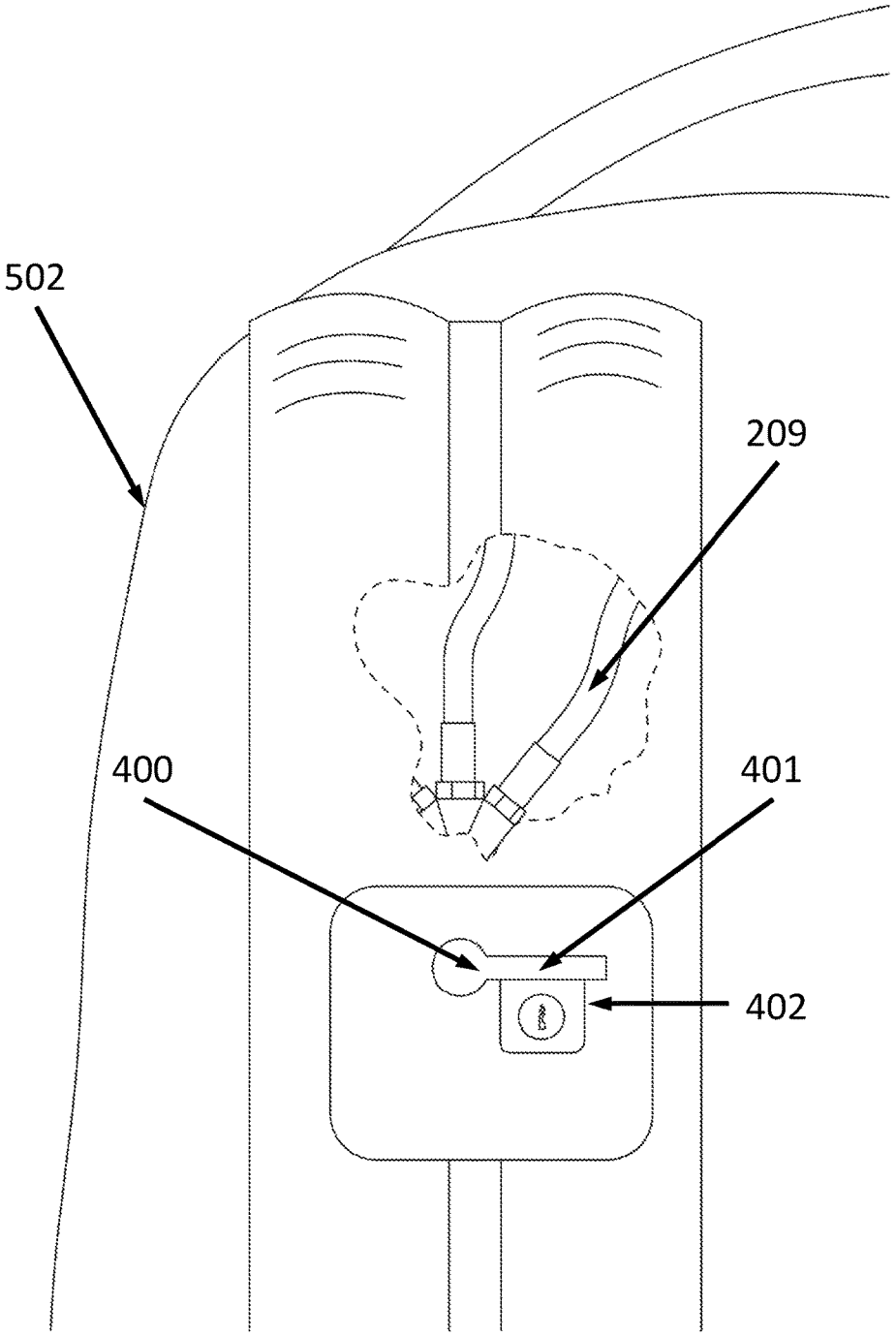
FIG. 5C is a schematic diagram illustrating an embodiment of a backpack incorporating an embodiment of the locking slider assembly as disclosed herein.
Figure 5D:
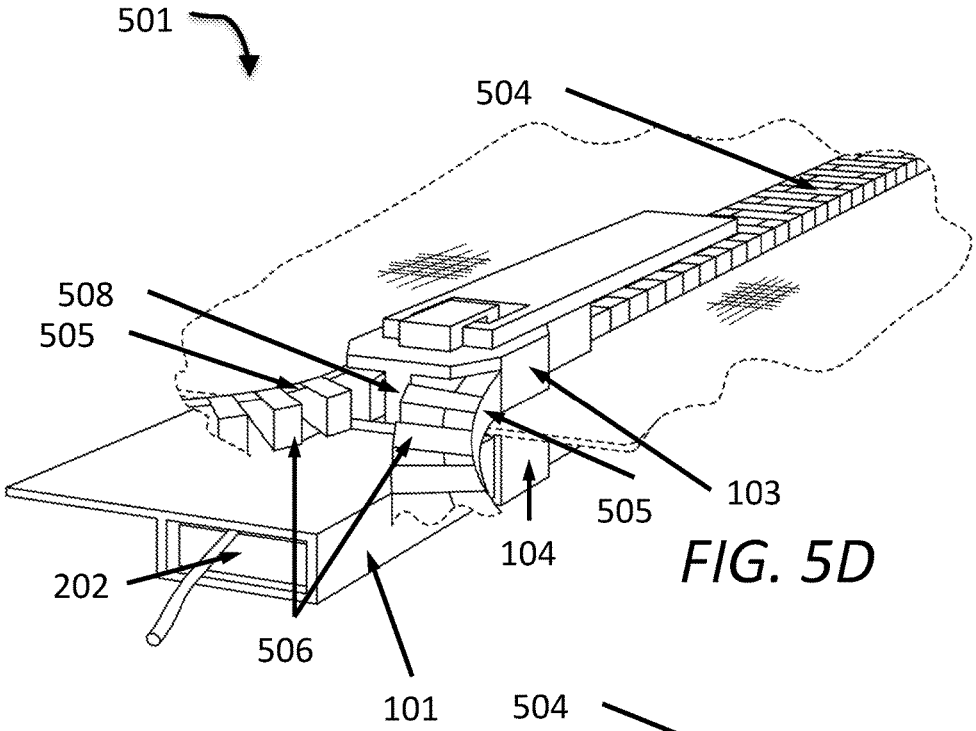
FIG. 5D is a schematic diagram illustrating an embodiment of a slide fastener incorporating an embodiment of the locking slider assembly as disclosed herein.
Figure 5E:
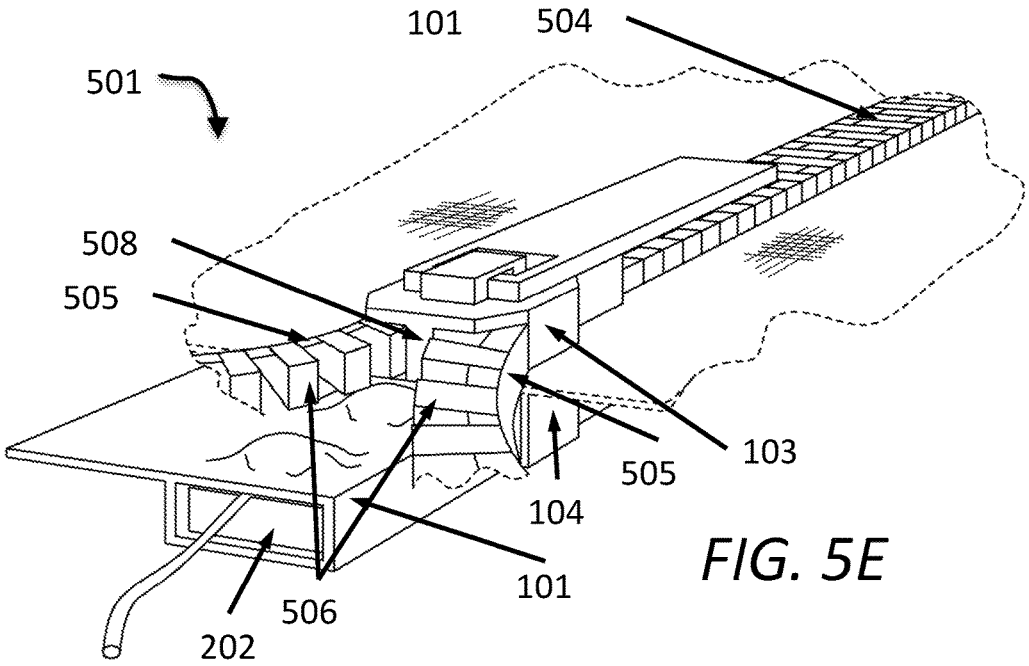
FIG. 5E is a schematic diagram illustrating an embodiment of a slide fastener incorporating an embodiment of the locking slider assembly as disclosed herein.

In some embodiments, a second actuator 403 is also attached to the spool 400; the second actuator 403 may be attached so that turning the spool to the locking position pulls the second actuator toward the spool. In some embodiments, as shown for example in FIGS. 5A-B, the second actuator 403 may be part of a second assembly 500; for instance, the first assembly 100 may be included in a first zipper 501 on a backpack 502, and the second assembly 500 may be included in a second zipper 503. As shown in FIG. 5C, the spool 400 may be mounted on a shoulder strap of the backpack 502, with the sheathed cable or cables 209 running through the strap into the backpack 502, for instance to connect with slide fasteners that close the backpack. FIGS. 5D-E illustrate how the assembly 100 or the second assembly 500 may be incorporated in a slide fastener, such as a zipper, as set forth in further detail below. The second assembly 500 may any assembly suitable for use as the first assembly 100 as described above in connection with FIGS. 1A-4D. The spool may have three or more actuators attached to it. Returning to FIGS. 4A-B, the assembly 100 may include a splitter 404 that divides the actuator and the second actuator. The sheath 209 may attach to the splitter; a second sheath 405 may attach to the splitter, containing the second actuator 403 as described above. Each sheath may attach to the splitter by way of a nut 406; as described above in connection with FIGS. 2A-3, the nuts 406 may be tightened or loosened to adjust the tension on the actuators 205, 403.

Returning to FIGS. 1A-F, the assembly includes a slider 103. The slider may be made of any rigid material; for instance, the slider 103 may be constructed from metal. The slider 103 includes a slot 104 that fits over the rail 101. The slot 104 may have a cross-sectional shape that is substantially the same as the cross-sectional shape of the rail 101. For instance, where the rail 101 has a substantially rectangular cross-sectional shape as described above in reference to FIGS. 1A-2D, the slot 104 may be substantially rectangular; that is, the slot 104 may have a substantially rectangular shape that is open at one end, such as a substantially rectangular C-shaped profile, with the upper surface 105 forming the underside of the top of the C, and the lower surface 106 forming the top side of the bottom of the C. The slot 104 may fit snugly over the rail 101 when the rail is in the first state. The slot has a first surface 105 and a second surface 106. The first surface 105 and second surface 106 are separated by a distance aligned with the cross-sectional dimension 107 that is greater than the first value of the cross-sectional dimension and less than or equal to the second value of the cross-sectional dimension; for example, the distance between the first surface 105 and second surface 106 may be almost the same height as the first height of the rail 101, when in the first state. When the rail 101 is in the second state, the slot 104 may be stuck between two lumps in the rail; in other embodiments, the rail may hold the slot 104 by creating friction between the slot and the upper and lower surfaces of the rail 101 by expanding within the slot 104 when the rail is in the second state.

Returning to FIGS. 5A-5K, the slider locking assembly 100 may be incorporated in a slide fastener 501. As an example, FIGS. 5C-E illustrate an embodiment of a slide fastener 501 incorporating a slider locking assembly. The slide fastener 501 may include a fastener 504 having two flexible strips 505 and a set of interlocking teeth 506 alternately attached to the two flexible strips. The fastener 504 may be any fastener suitable for use in a slide fastener or zipper. The flexible strips 505 may be constructed from any flexible material as described above in reference to FIGS. 1A-2D. The flexible strips may have any suitable shape for use in a slide fastener. In some embodiments, the flexible strips 505 are attached to two sheets or panels 507; the sheets or panels 507 may be part of a garment, bag, backpack, luggage item, or other product on which a slide fastener of zipper is useful for joining the edges of two sheets or panels. The sheets or panels may be constructed of any flexible or rigid materials as described above in reference to FIGS. 1A-2D. The teeth 506 may have any form suitable for use in a slide fastener; the teeth may be substantially rectangular. The teeth 506 may have interlocking projections and indentations. The teeth 506 may have regular or irregular polyhedral forms that interlock. The teeth 506 may be formed individually from rigid material such as metal or plastic and attached independently to the flexible strips 505. In other embodiments, the teeth 506 are formed from a coiled filament or wire of material such as nylon, and flattened at certain points to enable them to interlock. Persons skilled in the art will be aware of many ways to construct fasteners having interlocking teeth attached to strips of flexible material.

The slide fastener 501 may include a rail 101 having a travel direction, the rail switchable between a first state in which the rail has a first height substantially orthogonal to the travel direction and a second state in which the rail has a second height substantially orthogonal to the travel direction, the second height greater than the first height. The rail 101 may be any rail as described above in reference to FIGS. 1A-2D.

Figure 5F:
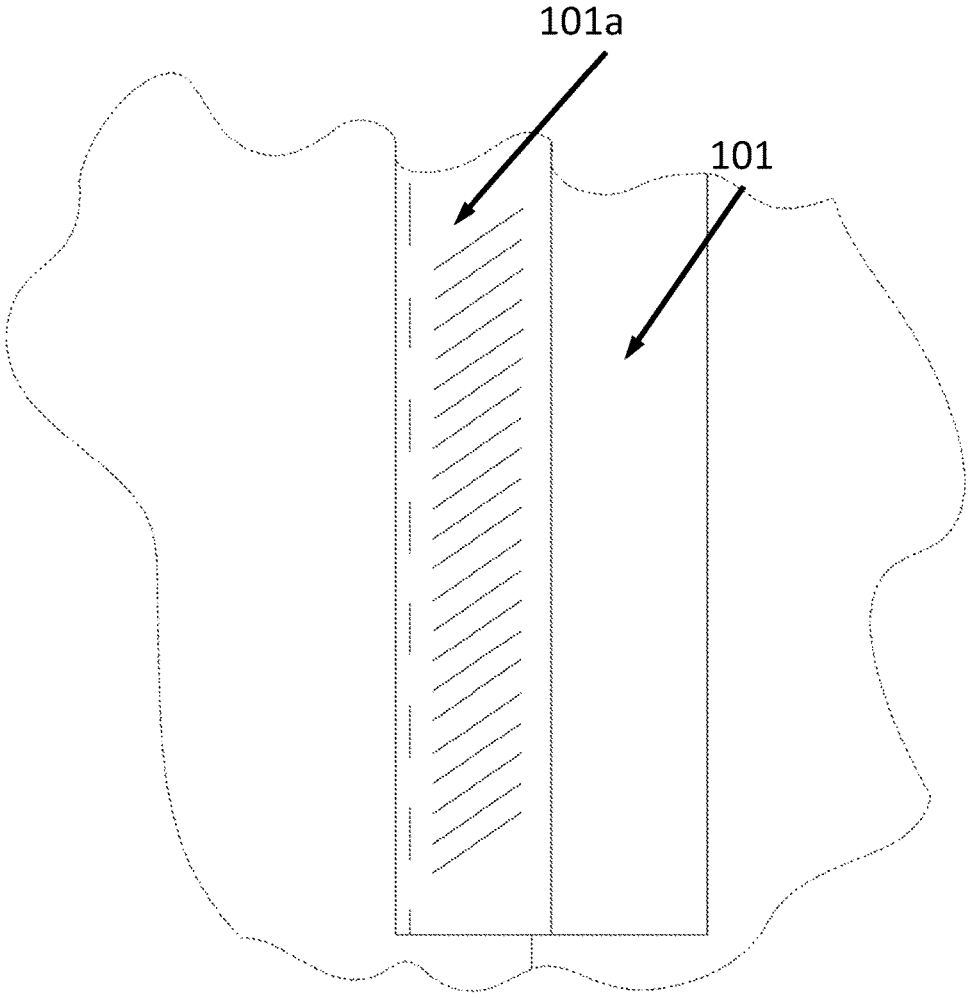
FIG. 5F is a schematic diagram showing an embodiment of a portion of a rail incorporated in a portable container.
Figure 5G:
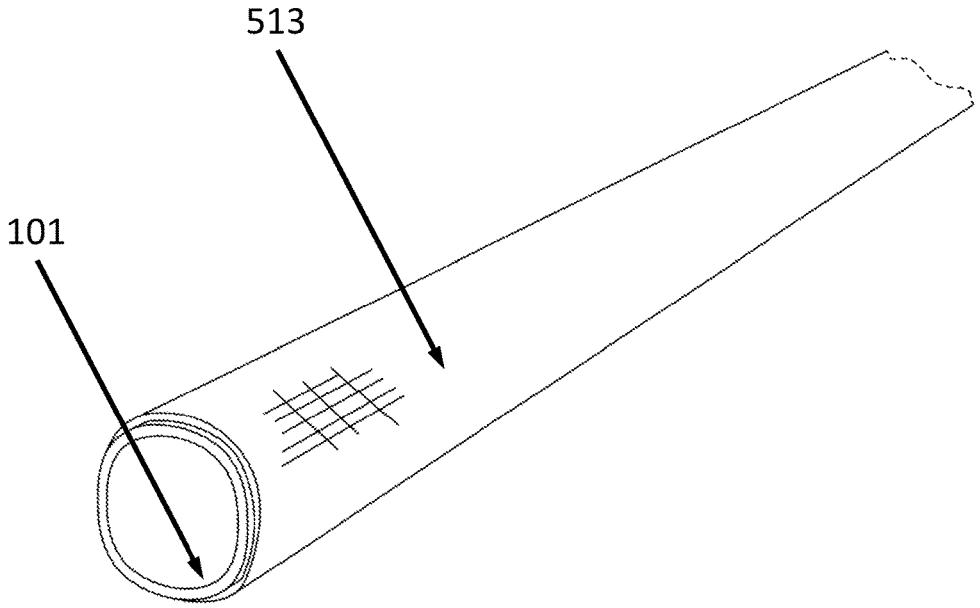
FIG. 5G is a schematic diagram showing an embodiment of a portion of a rail incorporated in a flexible sleeve.
Figure 5H:
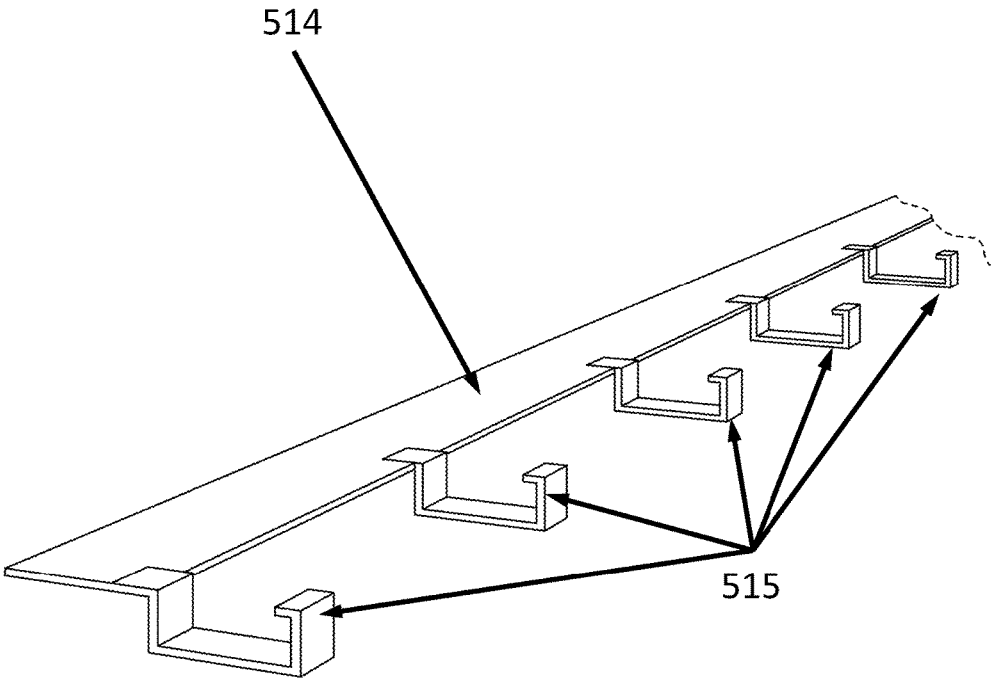
FIG. 5H is a schematic diagram showing an embodiment of a set of clips attached to an edge of an opening in a portable container.

The rail 101 may be manufactured separately from the fastener 504, and subsequently attached to the fastener 504; for instance, as shown in FIG. 5F, the rail 101 may have a projecting strip 101*a* that may be attached to one of the flexible strips or to one of the sheets or panels 507 to which the flexible strips are attached. The projecting strip 101*a* may be attached by any suitable process, including without limitation adhesion, heat sealing, or sewing. In other embodiments, as shown in FIG. 5G, the rail is 101 is enveloped in a sleeve 513 of flexible material. The sleeve 513 may be constructed of any flexible material as described above. In some embodiments, where the rail 101 includes members that extend away from the rail 101 as described in further detail below, the sleeve 513 is constructed to allow the members to pass through the sleeve 513; for instance, the sleeve 513 may have openings located so that the members can pass through the openings. In other embodiments, the sleeve 513 is constructed of a material, such as a mesh, that will allow members to pass through the material. Alternatively, the sleeve 513 may be constructed of elastic material that allows the rail 101 or members included in the rail 101 to expand, extend, or otherwise modify the profile of the rail 101 while the rail 101 is contained in the sleeve 513. The sleeve 513 may be attached to the slide fastener or to a portable container similarly to the projecting strip described above.

In other embodiments, for instance as shown in FIGS. H-I the rail 101 is engaged to a portion 514 of the portable container, such as an edge of an opening to be secured by a slide fastener, by at least one clip 515. The at least one clip 515 may be constructed from any material or combination of materials suitable for the construction of the slider 103 or follower 104. The at least one clip 515 may be substantially rigid. The at least one clip 515 may be slightly elastic to allow the at least one clip 515 to deform to admit the rail 101; as a result, when the rail 101 is inserted in the at least one clip 515, as shown for instance in FIG. 5I, the at least one clip 515 may exert a recoil force gripping the rail 101. The at least one clip 515 may be shaped to complement the outline of the rail 101, so that the rail 101 fits snugly within the at least one clip 515. The follower and rail 101 may be formed so that the follower 101 can contact the rail 101 when the latter is engaged in the at least one clip 515; for instance, the follower may rest on top of the rail 101 where each clip 515 has a gap, or may insert into a slit in the rail 101. The at least one clip 515 may include a plurality of clips.

The rail 101 may be attached on the underside of the slide fastener 501; that is, where the slide fastener 501 closes an opening in an object, such as a backpack, luggage item, pocket, or garment, which has an interior or exterior, the rail 101 may be attached on the interior side of the slide fastener 501. The rail 101 may be attached to run parallel to the fastener 504 when the teeth of the fastener 504 are interlocked, as shown in FIGS. 5C-D.

Figure 5I:
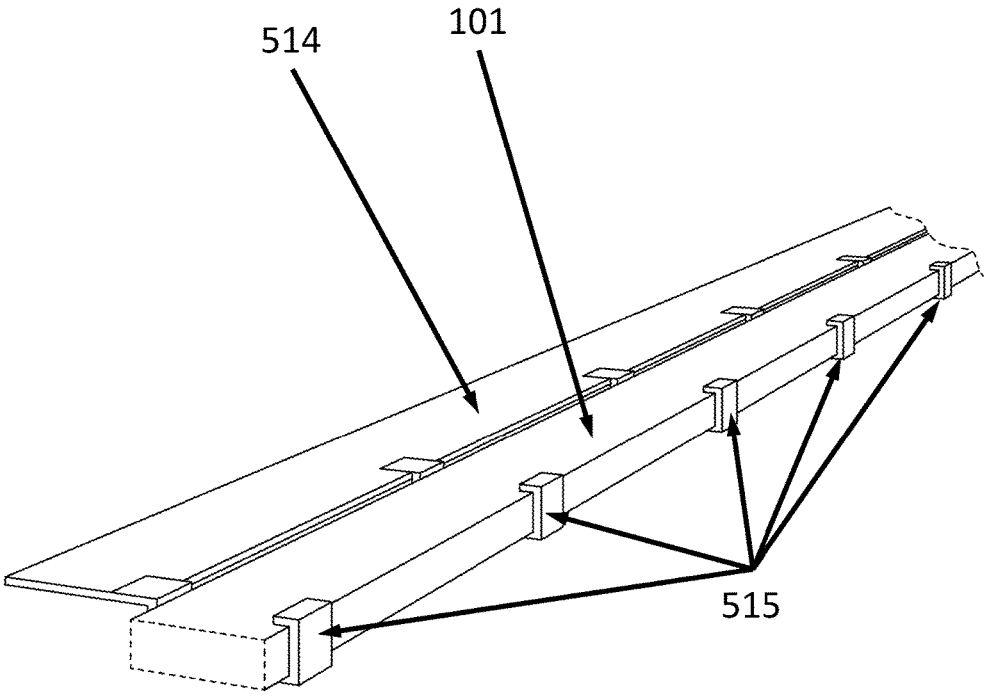
FIG. 5I is a schematic diagram showing an embodiment of a portion of a rail attached to set of clips attached to an edge of an opening in a portable container.
Figure 5J:
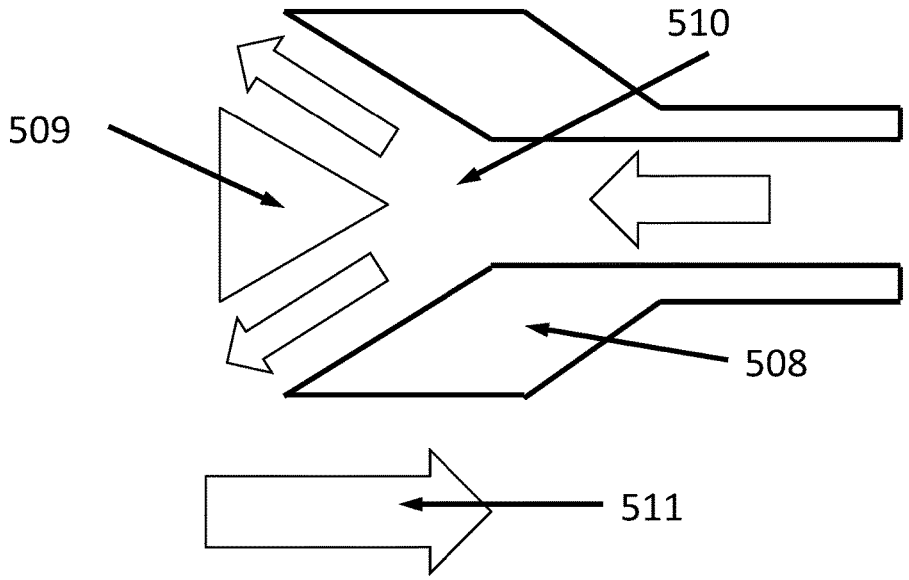
FIG. 5J is a schematic diagram illustrating an embodiment of a slider mechanism as disclosed herein.
Figure 5K:
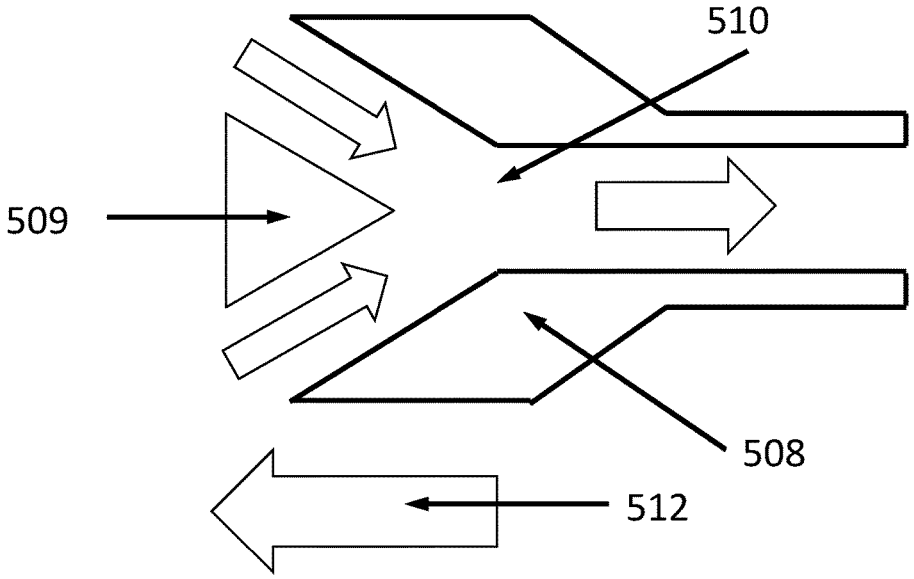
FIG. 5K is a schematic diagram illustrating an embodiment of a slider mechanism as disclosed herein.

The slide fastener 501 may include a slider 103. The slider 103 may include a slot 104 that fits over the rail 101, the slot 104 having an upper surface over the rail and a lower surface under the rail, the slot having a distance between the upper surface and lower surface, the distance being greater than the first height and less than the second height, as described above in reference to FIGS. 1A-2D. The slider 103 may be slidably engaged to the fastener 504. The slider 103 may have a mechanism 508 that separates the interlocking teeth when the slider slides in a first direction and interlocks the interlocking teeth when the slider slides in a second direction. As illustrated in FIGS. 5J-I, the mechanism 508 may combine a wedge 509 with a y-shaped junction 510. When the slider, and therefore the mechanism 508, travels in the first direction 511, the teeth may move in the opposite direction as illustrated in FIG. 5F; the wedge 509 may part the teeth so that they pass through the two parted branches of the Y-junction 510. When the slider, and therefore the mechanism 508, travel in the second direction 512, the teeth may travel through the slider in a direction opposite to the second direction 512, and the Y-junction 510 may force the teeth to intermesh as they enter the stem of the Y-shaped passage 510. Persons skilled in the art will be aware of various ways to implement such a mechanism.

In some embodiments, the incorporation of the locking slider assembly 100 in the slide fastener 501 results in a slide fastener 501 that may be locked, preventing the slider 103 from moving along the fastener 504 and parting or enmeshing the teeth, when the rail 101 is in the second state. Thus, a user may be able to lock the slide fastener 504 when it is entirely or partially closed; the user may do so using the spool 400 and handle 401 as illustrated in FIGS. 4A-B and 5A-B. The user may latch the spool 400 so that the slide fastener 501 cannot be opened until the spool 400 is unlatched; where the latch incorporates a lock, the slide fastener 501 may be impossible to open in the conventional way until the spool is unlocked. As a result, the user may be able to secure the slide fastener 501 thoroughly, quickly, and easily, protecting any valuable object enclosed by the slide fastener 501.

Figure 6:
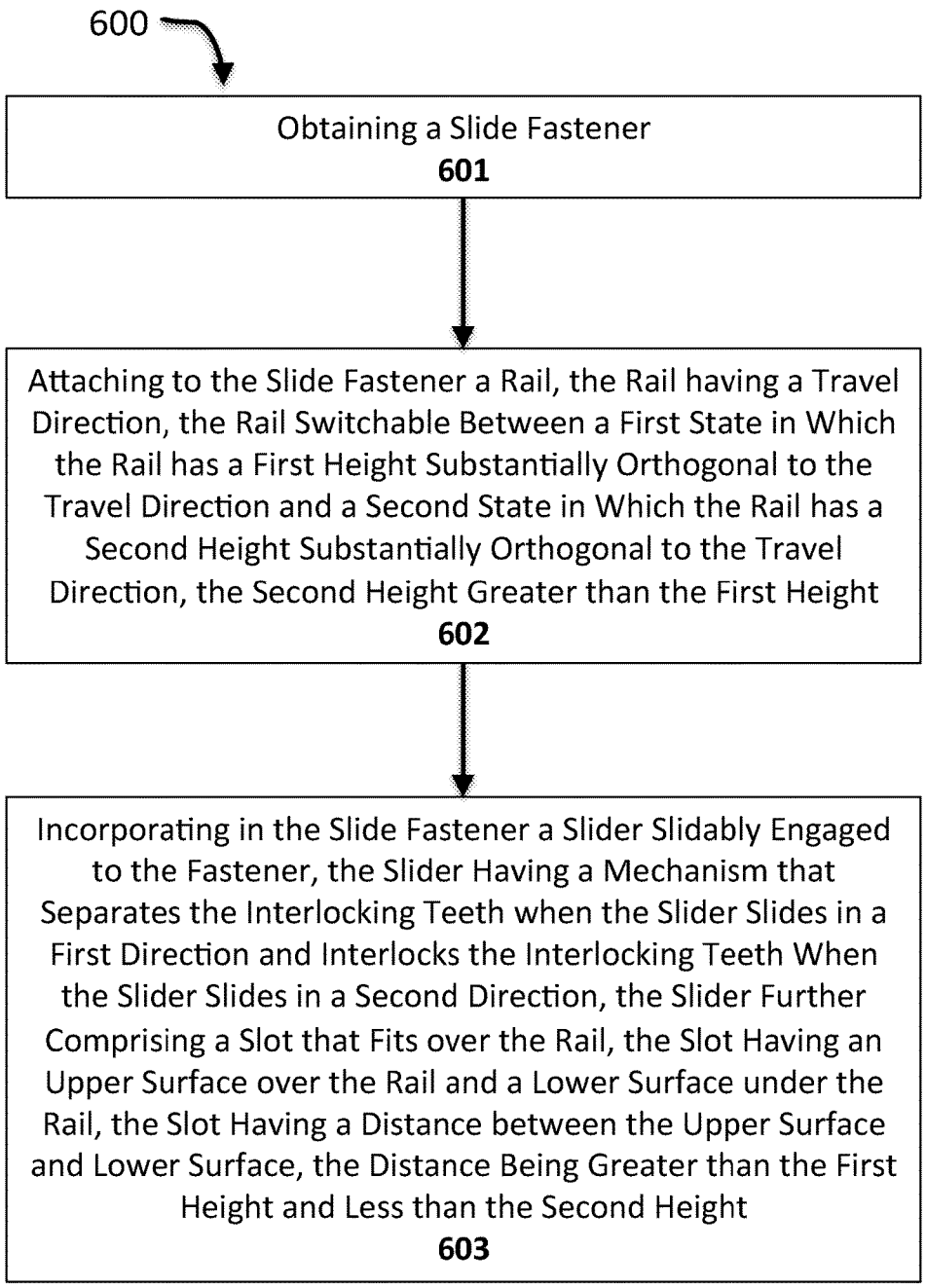
FIG. 6 is a flow diagram illustrating one embodiment of a method for manufacturing a slide fastener incorporating an embodiment of the locking slider assembly as disclosed herein.

FIG. 6 illustrates some embodiments of a method 600 for manufacturing a slide fastener having a locking slider assembly. The method 600 includes obtaining a slide fastener (601). The method 600 includes attaching to the slide fastener a rail, the rail having a travel direction, the rail switchable between a first state in which the rail has a first height substantially orthogonal to the travel direction and a second state in which the rail has a second height substantially orthogonal to the travel direction, the second height greater than the first height (602). The method 600 includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having an upper surface over the rail and a lower surface under the rail, the slot having a distance between the upper surface and lower surface, the distance being greater than the first height and less than the second height.

Referring to FIG. 6 in greater detail, and by reference to FIGS. 1A-5G, the method 600 includes obtaining a slide fastener (601). The slide fastener may be any slide fastener as described above in connection with FIGS. 5A-G. In some embodiments, obtaining the slide fastener involves purchasing or otherwise sourcing a slide fastener from another party; the slide fastener thus obtained may include the fastener 504. In some embodiments, the slide fastener thus sourced includes a slider having a mechanism 508 as described above for parting or enmeshing the interlocking teeth; in other embodiments the slide fastener 501 includes only the fastener 504. In other embodiments, obtaining the slide fastener 501 includes manufacturing the slide fastener 501 or one or more components of the slide fastener. The method 600 may include incorporating the slide fastener 501 in a product such as a backpack, luggage item, handbag, or article of clothing; the flexible strips 505 may be sewn or otherwise attached to the product.

The method 600 includes attaching to the slide fastener a rail, the rail having a travel direction, the rail switchable between a first state in which the rail has a first height substantially orthogonal to the travel direction and a second state in which the rail has a second height substantially orthogonal to the travel direction, the second height greater than the first height (602). The rail 101 may be any rail 101 as described above in reference to FIGS. 1A-5G. In some embodiments, this includes manufacturing the rail 101. The rail 101 may be extruded or otherwise formed from polymer material in a manner analogous to the formation of plastic or rubber tubing. The rail 101 may be attached to the slide fastener 501 as shown in FIGS. 5A-G; the rail 101 may be attached before or after the slide fastener 501 is incorporated in the product.

The method 600 may include incorporating the mechanism 202 in the rail; where the rail 202 includes a tube, this may include inserting the wedge cams 203 in the rail 101. This may include inserting a strip bearing the wedge cams 203 inside the rail; the strip or individual wedge cams 203 may be adhered or otherwise attached to the interior surface of the tube. The actuator 205 may be inserted over the wedge cams 203 in the tube; in some embodiments the actuator 205 and wedge cams 203 are inserted together. The method 600 may include placing the biasing means 208 at one end of the rail; an end cap or other element bearing the biasing means may be attached.

The method 600 includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having an upper surface over the rail and a lower surface under the rail, the slot having a distance between the upper surface and lower surface, the distance being greater than the first height and less than the second height. The slider 103 may be any slider 103 as described above in reference to FIGS. 1A-5G. In some embodiments, incorporating the slider 103 involves attaching a slot 104 to an existing slider 103, such as a slider that came with the slide fastener 501 if the slide fastener is sourced from another party; in other embodiments, the slider 103 with the slot 104 is manufactured by methods that may include without limitation molding, machining, or rapid prototyping. Incorporating the slider 103 may include inserting the teeth 506 of the fastener 504 in the mechanism of the slider 103. Incorporating the slider 103 may include inserting the rail 101 in the slot of the slider 103.

The method may include attaching the end of the actuator to the spool 400; in some embodiments, the spool is manufactured, for instance by molding, machining, or rapid prototyping. The spool 400 and latch 402 may be assembled together; the spool 400 and latch 402 may be incorporated in the product before or after they are assembled together. The spool 400 and latch 402 may be incorporated in the product before or after the end of the actuator 205 is attached to the spool.

The method may include inserting the actuator in a sheath 209. The actuator may be tensioned as described above by adjusting one or more nuts on the ends of the sheath. The sheath 209 may be attached to the rail by a nut. The sheath 209 may be attached to the spool 400 by way of a splitter 500 as described above.

Figure 7A:
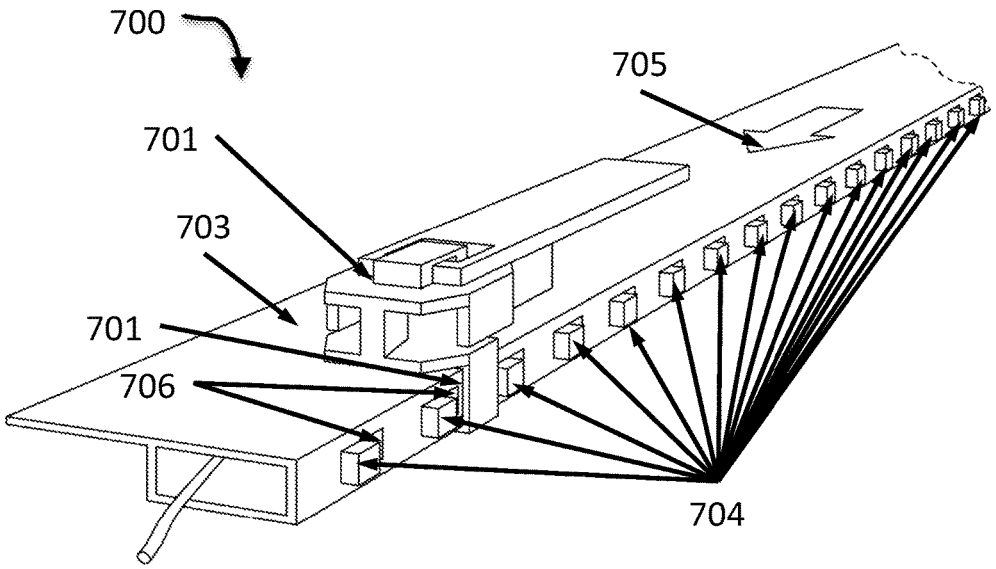
FIG. 7A is a schematic diagram illustrating an embodiment of a locking slider assembly as disclosed herein.
Figure 7B:
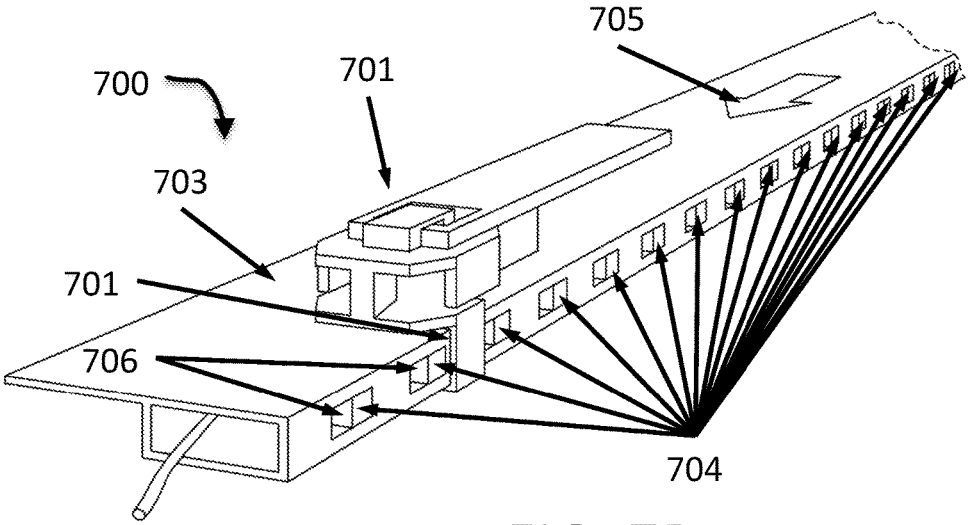
FIG. 7B is a schematic diagram illustrating an embodiment of a locking slider assembly as disclosed herein.

In some embodiments, the profile of the rail is modified by causing a member to extend from the rail 102 when the rail is in a first state, and retract when the rail 102 is in a second state. In some embodiments, the member that extends from the rail is substantially rigid. For instance, FIGS. 7A-B depict some embodiments of a locking slider assembly 700. As an overview, the locking slider assembly includes a slider 701. The slider includes a slot 702. The locking slider assembly includes a rail 703 slidably inserted through the slot 702 of the slider 701. The rail 703 includes at least one tooth 704. The at least one tooth 704 is movable between an extended state in which the tooth prevents the slot 702 from moving in at least one direction 705 along the rail, as illustrated in FIG. 7A, and a retracted state in which the slot 702 can slide past the at least one tooth 704, as illustrated in FIG. 7B.

Figure 8:
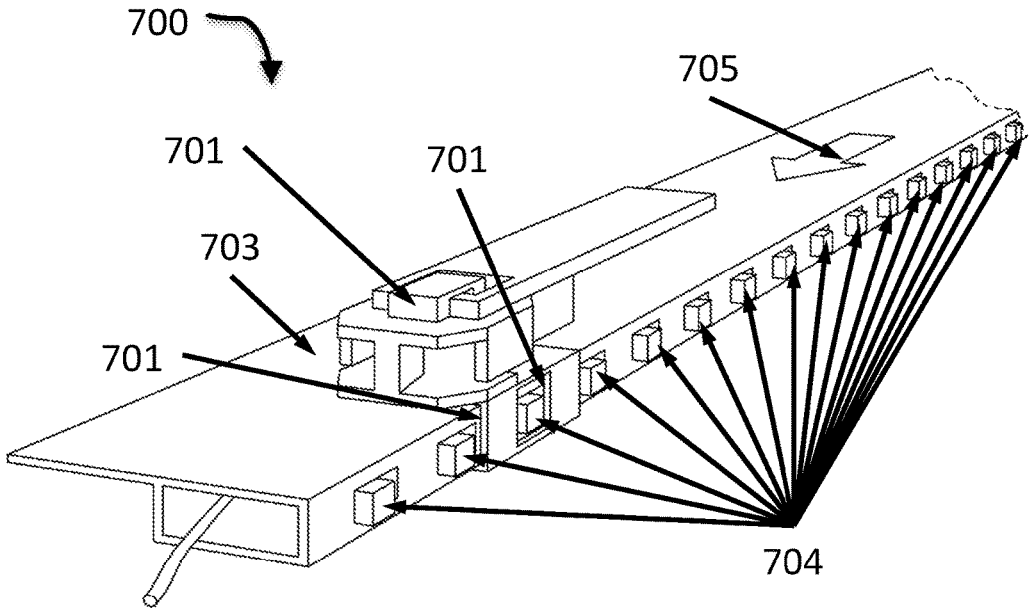
FIG. 8 is a schematic diagram illustrating an embodiment of a locking slider assembly as disclosed herein.

Viewing FIGS. 7A-B in greater detail, the locking slider assembly 700 includes a slider 701. The slider 701 may be any item suitable for use as a slider 103 as described above in connection with FIGS. 1A-6. The slider 701 includes a slot 702 into which the rail 703 is slidably inserted; the slot 701 may be any feature suitable for use as a slot 104 as described above in relation to FIGS. 1A-6. For instance, the slot 702 may be formed by a substantially C-shaped projection attached to the slider 701. In some embodiments the slot 701 fits snugly over the rail 703. In some embodiments, as illustrated in FIG. 8, the slider 701 further includes a cavity 801 into which the at least one tooth 704 inserts when in the extended position; the cavity 801 may be a hole straight through the projection forming the slot, or may be formed by a depression in an internal surface of the slot 702. The cavity 800 may have any shape suitable for accepting the portion of the at least one tooth 704 that inserts into the cavity 800 when the at least one tooth 704 is in the extended position; for example, the cavity may have any cross-sectional form usable for the cross-sectional form of the at least one tooth 704 as described in further detail below.

The assembly 700 includes a rail 703. The rail 703 may be any feature suitable for use as a rail 101 as described above in connection with FIGS. 1A-6. The rail 703 is slidably inserted in the slot 702; the slot 702 and slider 701 may be free to slide along the rail in a longitudinal direction 705 or its opposite direction. The rail 703 includes at least one tooth 704. The at least one tooth 704 is movable between an extended state in which the tooth prevents the slot 702 from moving in at least one direction 705 along the rail, as illustrated in FIG. 7A, and a retracted state in which the slot 702 can slide past the at least one tooth 704, as illustrated in FIG. 7B.

The at least one tooth 704 may be any member that projects into the path of travel of the slider 701, when in the extended position, to prevent the slider 701 from traveling in at least one direction. The at least one tooth 704 may be constructed of any material or combination of materials suitable for the construction of the slider 701 or the rail 703. The at least one tooth 704 may have any three-dimensional shape, including any polyhedral or spheroidal shape, or any combination of such forms. The at least one tooth 704 may have a cross-section transverse to the direction of motion of the tooth between the first and second positions; the cross-section may have any polygonal form, curved form, or combination thereof, including without limitation rectangular, square, circular, or elliptical forms, with rounded corners, straight sections, and the like. Although in the exemplary illustrations provided in the figures, the at least one tooth 704 projects in only one direction, the at least one tooth 704 may include teeth that project in two or more directions; moreover, the at least one tooth 704 may project in any direction from the rail 703, including upward, downward, sideways, and so forth.

Figure 9A:
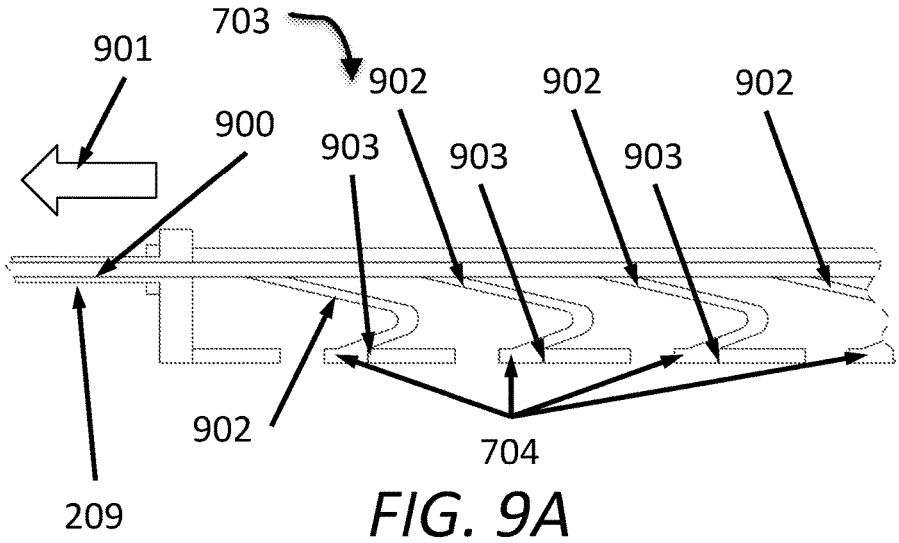
FIG. 9A is a schematic diagram illustrating an embodiment of a rail as disclosed herein.
Figure 9B:
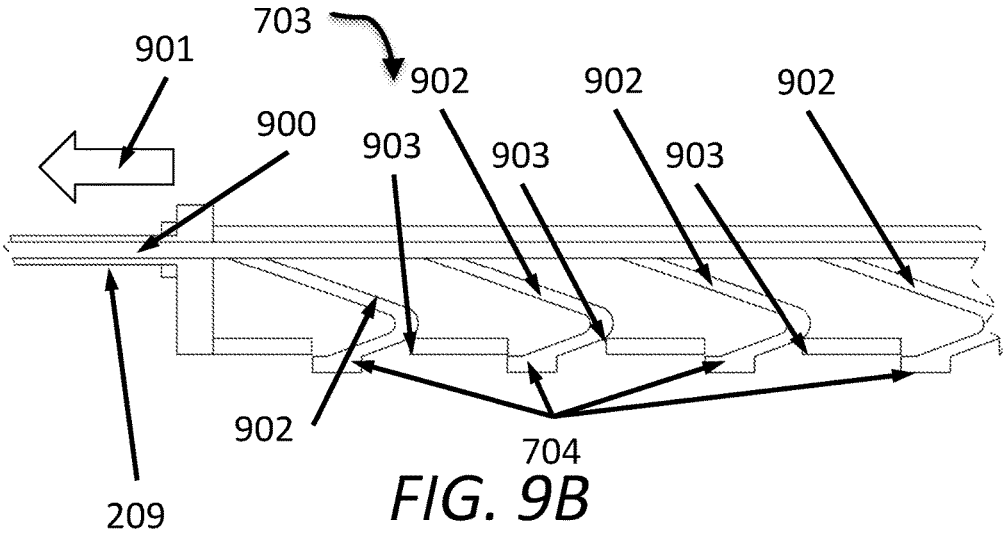
FIG. 9B is a schematic diagram illustrating an embodiment of a rail as disclosed herein.

In some embodiments, as illustrated for example in the partial longitudinal cross-section in FIGS. 9A-B the rail 703 also includes an actuator 900. The actuator 900 may be any component suitable for use as an actuator 205 as described above in reference FIGS. 1A-6. In some embodiments, the at least one tooth 704 is mounted on the actuator 205; for instance, the at least one tooth 704 may be attached directly or indirectly to the actuator 205 so that when the actuator moves in one or more directions the at least one tooth 704 also moves in those directions. The rail 703, at least one tooth 704, and actuator 900 may be formed that when the actuator 900 slides in a first direction 901 the at least one tooth 704 is forced into the extended position, as shown for example in FIG. 9B, and when the actuator 900 slides in a second direction, which may be opposite to the first direction 901, the at least one tooth 704 is forced into the retracted position, as illustrated for instance in FIG. 9A. The mechanism whereby the at least one tooth 704 is forced into the extended position may be a wedge cam mechanism such as that described above in reference to FIGS. 1A-6. In other embodiments, at least one tooth 704 is mounted on the actuator 900 by a biasing means 902; for instance, the at least one tooth 704 may be attached to at least one biasing means 902 that is attached in turn to the actuator. The biasing means 902 may be any kind of spring or other elastic component. The biasing means 902 may have a bias that urges the at least one tooth into the extended state; for instance, the biasing means 902 may be inserted into the rail by deforming the biasing means 902, causing the biasing means 902 to exert a recoil force tending to urge the at least one tooth 704 away from the rail 703 and into the extended position.

The mechanism to force the at least one tooth 704 into the retracted position when the actuator 900 is moved in the second direction may include a biasing means (not shown); for instance, where the at least one tooth 704 is forced into the extended position by traveling up a wedge cam, a biasing means may force the at least one tooth 704 back into the retracted position when the at least one tooth 704 is moved in the second direction. In other embodiments, the rail 703 also includes at least one surface 903 against which the at least one tooth 704 is forced when the actuator 900 is moved in the second direction, the at least one surface 903 and at the least one tooth 704 are formed so that forcing the at least one tooth 704 against the at least one surface 903 moves the at least one tooth 704 into the retracted position. For example, as shown in FIGS. 9A-B, the at least one tooth 704 may have an angled surface that when forced against a surface 903 of the rail 703, causes the surface 903 of the rail 703 to exert a force on the at least one tooth 704 toward the retracted position. The at least one surface 903 may be the edge of an opening in the rail 703 out of which the tooth 704 projects when in the extended position.

The actuator 900 may be moved in the first or second direction using a spool to which one end of the actuator 900 is fixed, so that rotating the spool to a locking position causes the actuator to slide in the first direction, as illustrated and described in reference to FIGS. 4A-5C above. The spool may have a latch that secures the spool in the locking position, as described above in reference to FIGS. 4A-5C. Likewise, as described above in reference to FIGS. 4A-5C, the assembly 700 may include a second locking assembly having a second actuator, and wherein the second actuator is also wound on the spool. The assembly 700 may include a splitter dividing the actuator and the second actuator.

As described in further detail above in reference to FIGS. 3-5C, a portion of the actuator 900 may project away from the rail 703; the assembly 700 may include a sheath 209 containing the portion of the actuator that projects away from the rail 703. The sheath 209 may be flexible.

Returning now to FIGS. 7A-B, the at least one tooth 704 may include a plurality of teeth. For instance, the plurality of teeth may be regularly spaced so that, when in the extended position, the plurality of teeth can prevent the slider 701 from moving away from whatever position the slider 701 currently occupies along the rail 703. In some embodiments, the rail 703 forms a tube with a plurality of openings 706. Each of the plurality of teeth 704 may project through one opening of the plurality of openings 706; in other words, each tooth 704 may retract into an opening 706 when the tooth 704 moves into the retracted position, and may extend out of the opening when in the extended position. An edge of the opening 706 may form a surface against which the tooth is pushed when the actuator 900 moves in the second direction, as described above.

Figure 10:
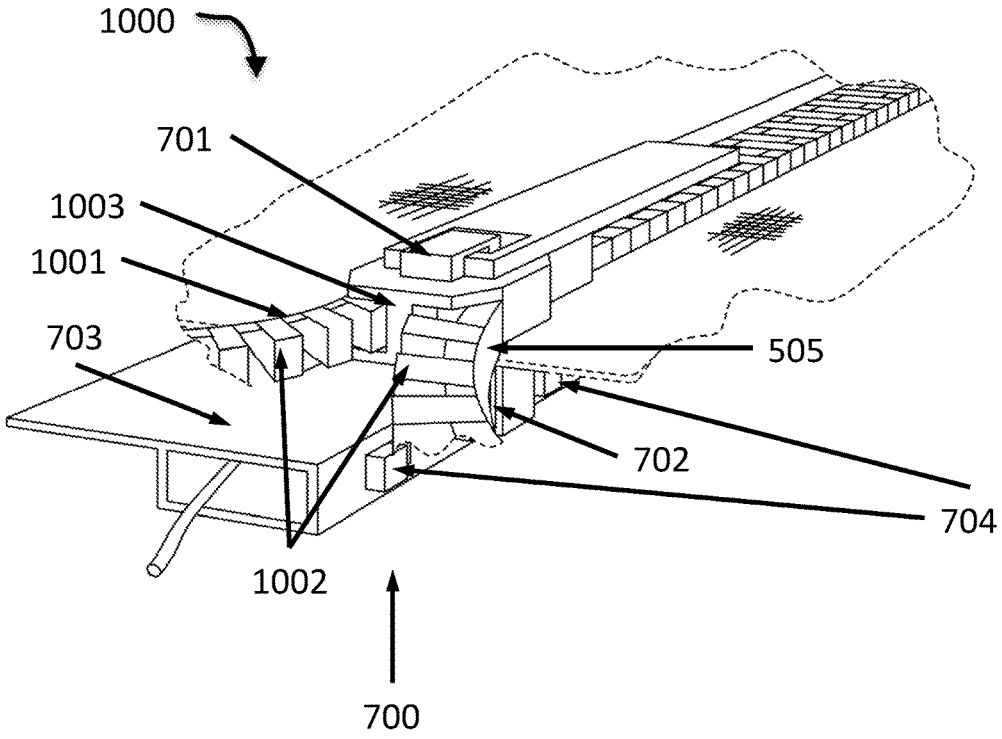
FIG. 10 is a schematic diagram illustrating an embodiment of a locking slider assembly as disclosed herein.

FIG. 10 illustrates a slide fastener 1000 incorporating a locking slider assembly 700 as described above in reference to FIGS. 7A-9B. The slide fastener 1000 includes two flexible strips 1001. The slide fastener 1000 includes a set of interlocking teeth 1002 alternately attached to the two flexible strips 1001. The slide fastener 1000 includes a slider 701 slidably engaged to the fastener 1000, the slider 701 having a mechanism 1003 that separates the interlocking teeth 1002 when the slider 701 slides in a first direction and interlocks the interlocking teeth 1002 when the slider 701 slides in a second direction. The interlocking teeth, 1002 flexible strips 1001, slider 701, and mechanism 1003 may function as described above in connection with FIGS. 1A-6. The slider 701 includes a slot 702 as described above in reference to FIGS. 7A-9B. The fastener 1000 includes a rail 703 slidably inserted through the slot of the slider, the rail having at least one tooth movable between an extended state in which the tooth prevents the slot from moving in at least one direction along the rail, and a retracted state in which the slot can slide past the at least one tooth; this may be implemented as described above in reference to FIGS. 7A-9B.

FIGS. 11A-F illustrate further embodiments in which the profile of the rail is modified by extending and retracting members. In some embodiments, the assembly 100 includes an elongated actuator 1101 inside the rail 101. The assembly 100 may include at least one member 1102 fixed to the actuator. The at least one member 1102 may be flexible; that is, the at least one member may bend or deform elastically when a user moves the slider 103 with an amount of force typical for use with a slide fastener. The at least one member 1102 may be positioned to extend out of the rail 101 when the actuator 1101 moves in a first direction, and to retract into the rail 101 when the actuator 1101 moves in a second direction.

The elongated actuator 1101 may be any component usable for an actuator as described above in connection with FIGS. 1A-10. In some embodiments, the elongated actuator 1101 is inside the rail if the elongated actuator 1101 runs substantially parallel to the rail and is held substantially parallel to the rail 101 by the structure of the rail 101. For instance, where the rail 101 is a tube the actuator 1101 may be inside the rail 101 if the actuator 1101 is inside the tube. Similarly, where the rail 101 has a groove or channel through which the actuator 1101 can pass, the actuator 1101 may be inside the rail 101 if the actuator 101 is in the groove. If the rail 101 is a strip of material, the actuator 1101 may be inside the rail 101 if the actuator runs alongside the rail and is held against the side of the rail 101 by one or more members affixed to the rail 101.

The at least one member 1102 may have any form that allows the at least one member 1102 to move between a position inside the rail and a position outside the rail 101. In some embodiments, the at least one member 1102 is outside the rail 101 if it extends into the path the follower 104 takes when sliding along the rail 101; the at least one member 1102 may be inside the rail 101 if the at least one member 1102 does not extend into the path the follower 104 takes when sliding along the rail 101. Alternatively, the at least one member 1102 may be outside the rail 101 if it acts to stop the follower 104 from sliding along the rail as described in further detail below; if the at least one member 1102 does not act to stop the follower 104 from sliding along the rail 101, the at least one member 1102 may be inside the rail 101. In some embodiments, the at least one member 1102 is a tooth that projects out of the opening to block the follower 104, as described above in reference to FIGS. 7A-10.

In other embodiments, where the rail 101 has an outside surface, the at least one member 1102 extends along the outside surface of the rail 101 when in the extended position. As a result, in some embodiments, the at least one member 1102 wedges between the follower 104 and the rail 101 when in the extended position; the at least one member 1102 may thus effectively increase the perimeter of the rail, making it far more difficult for the follower 104 to travel over the rail, and effectively locking the slider in place. The at least one member 1102 may be flexible or rigid. Where the at least one member 1102 is flexible, as shown for example in FIGS. 11A-D, the at least one member 1102 may extend along the exterior surface of the rail 101 if the at least one member 1102 is positioned so that it will tend to lie against the exterior surface of the rail 101 when the follower 104 is moved against the at least one member 1102 by a user. The at least one member 1102 may have any flexible form, including without limitations one or more bristles, one or more strips of any shape, one or more sheets of any shape, one or more wires, one or more springs such as leaf springs, one or more pieces of rope, string, twine, cable, or monofilament, a piece of lanyard material, or a flexible rod, stick, polyhedral form, or curved form.

Where the at least one member 1102 is rigid, the at least one member 1102 may have any rigid form capable of moving between the extended and retracted positions. For example, and without limitation, the at least one member 1102 may have a stick or rod-like form, a form with any polyhedral or curved features, a plate or rigid sheet-like or scale-like form, or any other form. As an example, a portion of the at least one member 1102 near to the distal end that extends beyond the rail may have an angled surface that runs parallel to the surface of the rail 101 when the at least one member 1102 is retracted; as a result, surface of the member 1102 may lie flush with the outer surface of the rail 101 when the at least one member 1102 is retracted, as illustrated for example in FIG. 11E. The at least one member 1101 may include a plurality of members; for instance, two or more members may extend out of the rail at a particular locus along the rail, and members may extend from the rail at various loci, which may be regularly spaced, locking the slider wherever it is found along the rail.

The at least one member 1102 is fixed to the actuator. In some embodiments, the at least one member 1102 is fixed to the actuator 1101 if a proximal end of the at least one member 1102 is attached to the actuator 1101 in such a way that moving the actuator 1101 in a direction forces the distal end to move by substantially the same amount in the same directions. The distal end may be connected to the actuator by any means consistent with the movement of the at least one member 1102 between extended and retracted states in response to the movement of the actuator 1101. Where the at least one member 1102 is flexible, the distal end may be attached to the actuator 1101 in a way that does not allow the distal end to pivot; for instance, the distal end may be adhered to the actuator 1101 or inserted in the actuator 1101. Where the at least one member 1102 is rigid, the distal end may be connected to the actuator 1101 in a manner that allows the at least one member 1102 to pivot; for instance, the distal end may be attached to the actuator 1101 via a joint such as a hinge, ball joint or the like, or using a piece of elastic material.

The at least one actuator 1101 may have any form that allows it to displace linearly and move the at least one member 1102 between the extended and retracted states. For instance, the at least one actuator 1101 may have any form or composition suitable for an actuator 205 as described above. In some embodiments, the actuator 1101 includes one or more beads 1104 strung on a flexible member such as a string, wire, filament, or cable that is part of the actuator 1101. The at least one bead 1104 may be rigid. In some embodiments, the at least one bead 1104 includes at least one member bead 1105 to which the at least one member 1102 is fixed. The at least one member 1102 may be affixed member bead 1105 by any suitable means described above for attaching the at least one member 1102 to the actuator 1101. In some embodiments, the at least one member 1102 and the at least one member bead 1105 are formed together in a manufacturing process; the at least one member 1101 and at least one member bead 1105 may form a monolithic whole. The at least one bead 1104 may also include at least one spacer bead 1106 to which the at least one member 1102 is not attached. The actuator 1101 may include any pattern of spacer beads and member beads; for instance, the actuator 1101 may include alternating spacer beads 1106 and member beads 1105, solely member beads 1105, a pattern of two spacer beads 1106 alternating with a single member bead 1105, or various different sequences of spacer beads 1106 and member beads 1105. The spacer beads 1106 and member beads 1105 may be arranged so that the at least one member 1102 is positioned to extend out of openings in the rail, while not being present where there are no openings in the rail 101. The at least one bead 1104 may be affixed to the flexible member of the actuator by any suitable means, such as adhesion, fastening with fasteners, fastening with caps or other elements that wedge between the at least one bead and the flexible member, and the like.

The at least one member 1102 may move to an extended position out of the rail 101 when the actuator 1101 moves in a first direction and to a retracted position inside of the rail 101 when the actuator 1101 moves in a second direction. In some embodiments, the at least one member 1102 is urged into either the extended or retracted position by a biasing means, such as a spring or an elastic element. The biasing means may also be the at least one member 1102 itself; in other words, part or all of the at least one member 1102 may be elastic, and thus act as a biasing means. As an example, the biasing means may be moved away from its equilibrium position when the member 1102 is in the retracted position, and thus exert a recoil force to push the at least one member 1102 toward the extended position if the member is not blocked by some other element, as illustrated for example in FIGS. 11C-D. Likewise, the biasing means may be pushed away from equilibrium when the at least one member 1102 is in the extended position, exerting a recoil force to urge the at least one member back toward the retracted position if no other element is blocking the at least one member 1102; one flexible member is shown thus deformed in FIG. 11D.

The assembly 1000 may include one or more components that contact the at least one member 1102 to force the at least one member 1102 into one or both of the retracted or extended positions. The one or more components may include one or more features of the rail 101. For example, the rail 101 may include a retraction fulcrum 1107 against which the at least one member 1102 pushes when the actuator 1101 is moved in the second direction, forcing the at least one member 1102 toward the retracted position. The retraction fulcrum 1107 may be a surface having any form. In some embodiments, the retraction fulcrum 1107 may be angled; for instance, the retraction fulcrum 1107 may form a wedge past which the at least one member 1102 may slide when the actuator 1101 moves in the second direction. The rail 101 may be include an extension fulcrum 1108 against which the at least one member 1102 is forced when the actuator 1101 moves in the first direction. The extension fulcrum 1108 may include a surface having any form; for instance, the extension fulcrum 1108 may form a wedge past which the at least one member 1102 may slide when the actuator 1101 moves in the first direction. The retraction fulcrum 1107 and the extension fulcrum 1108 may be edges of an opening in the rail 101, for instance as shown in FIGS. 11C-11F. The at least one member 1101 may thus extend out through the opening and retract into the opening.

In some embodiments, as shown for example in FIGS. 11G-H, the at least one member 1102 projects into a slot 1109 into which an extension 1110 of the follower 104 inserts; as a result when the at least one member 1102 is extended as shown in FIG. 11G, the at least one member 1102 may block the extension 1110 from moving through the slot 1109, preventing the slider 103 from sliding, while when the at least one member 1102 is retracted as shown in FIG. 1111, the extension 1110 is free to slide through the slot 1109 and thus the slider 103 is free to slide along the rail 101.

Figure 11I:
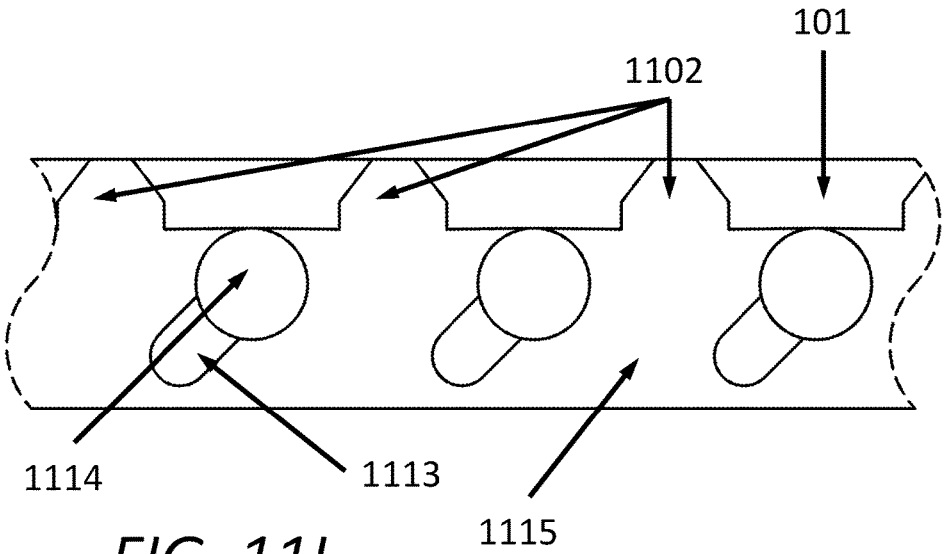
FIG. 11I is a schematic diagram showing an embodiment of part of a rail.
Figure 11J:
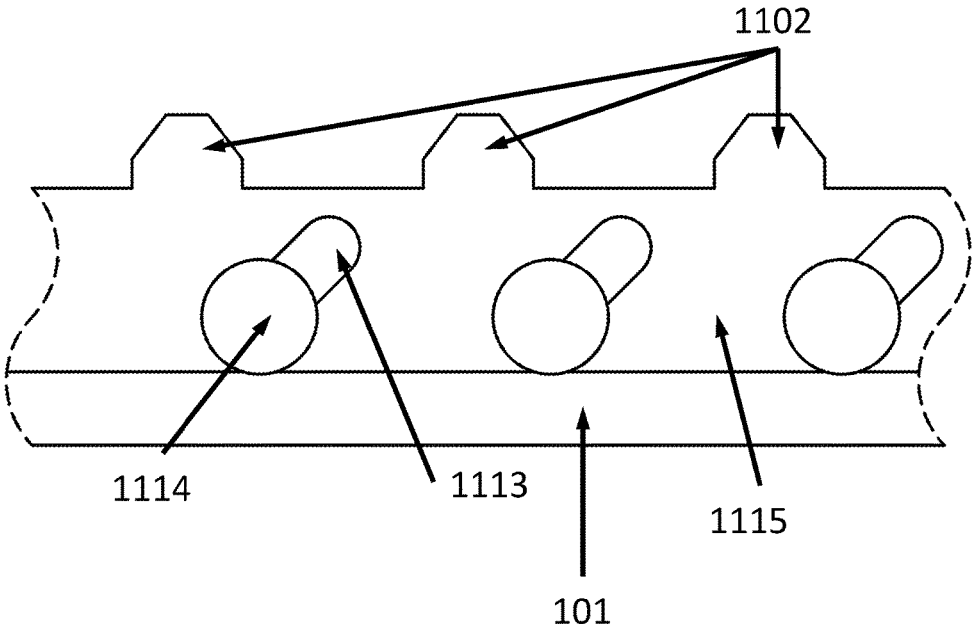
FIG. 11J is a schematic diagram showing an embodiment of part of a rail.

In some embodiments, as illustrated for example in FIGS. 11I-J the at least on member 1102 includes an angled slot 1113 into which a pin 1104 fixed to the rail 101 is inserted; as a result, when the at least one member 1102 moves in a first direction relative to the rail, the slot travels up the pin 1114, causing the members to extend as shown for example in FIG. 11J, and when the member 1102 is moved in a second direction, the slot travels down the pin 1114, causing the at least one member 1102 to retract. In other words, the angled slot 1113 may act as a wedge cam, and the pin 1114 may act as a follower. The angled slot 1113 may alternatively be on the rail 101, while the pin 1114 may be attached to the at least one member 1102. In some embodiments, the at least one member 1102 is a plurality of members. The plurality of members 1102 may be connected by a plate or strip 1115 of material having one or more slots 1113 in which are fitted one or more pins 1114; there may be a plurality of slots and pins. In some embodiments, the plate or strip 1115 extends substantially along the rail 101, in other words, the plate or strip 1115 may act as an actuator as described above. In other embodiments, the plate or strip 1115 does not run the length of the rail, but is attached to any actuator as described above, and moved by the actuator.

Figure 11K:
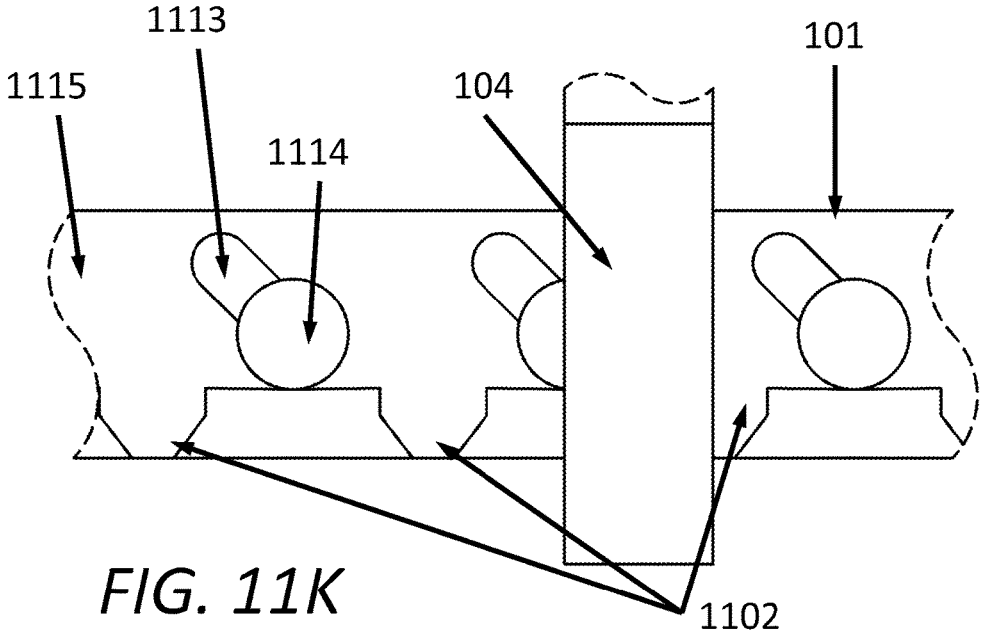
FIG. 11K is a schematic diagram showing a detail of an embodiment the locking slider arrangement.
Figure 11L:
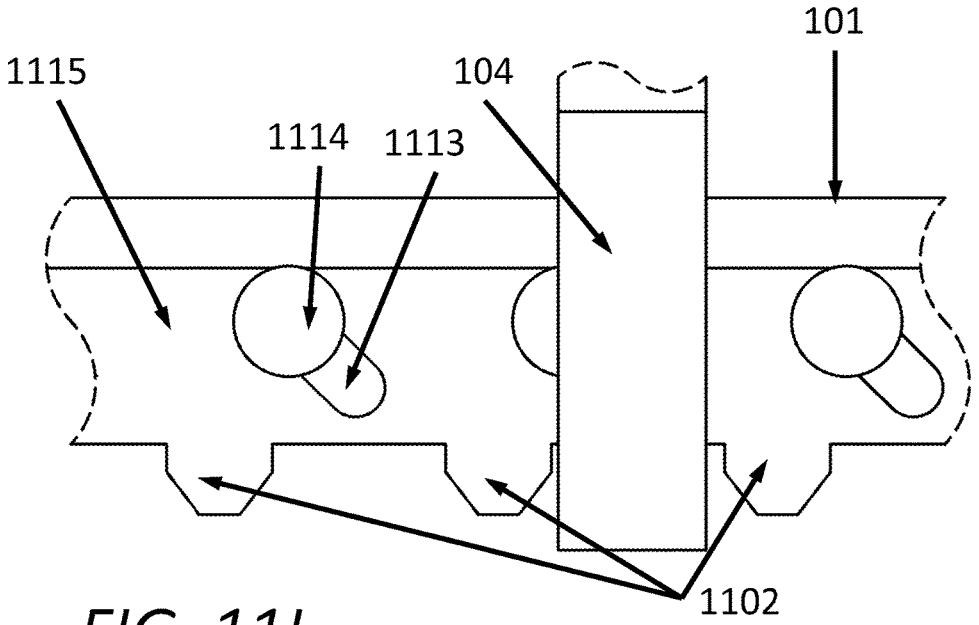
FIG. 11L is a schematic diagram showing a detail of an embodiment the locking slider arrangement.
Figure 11M:
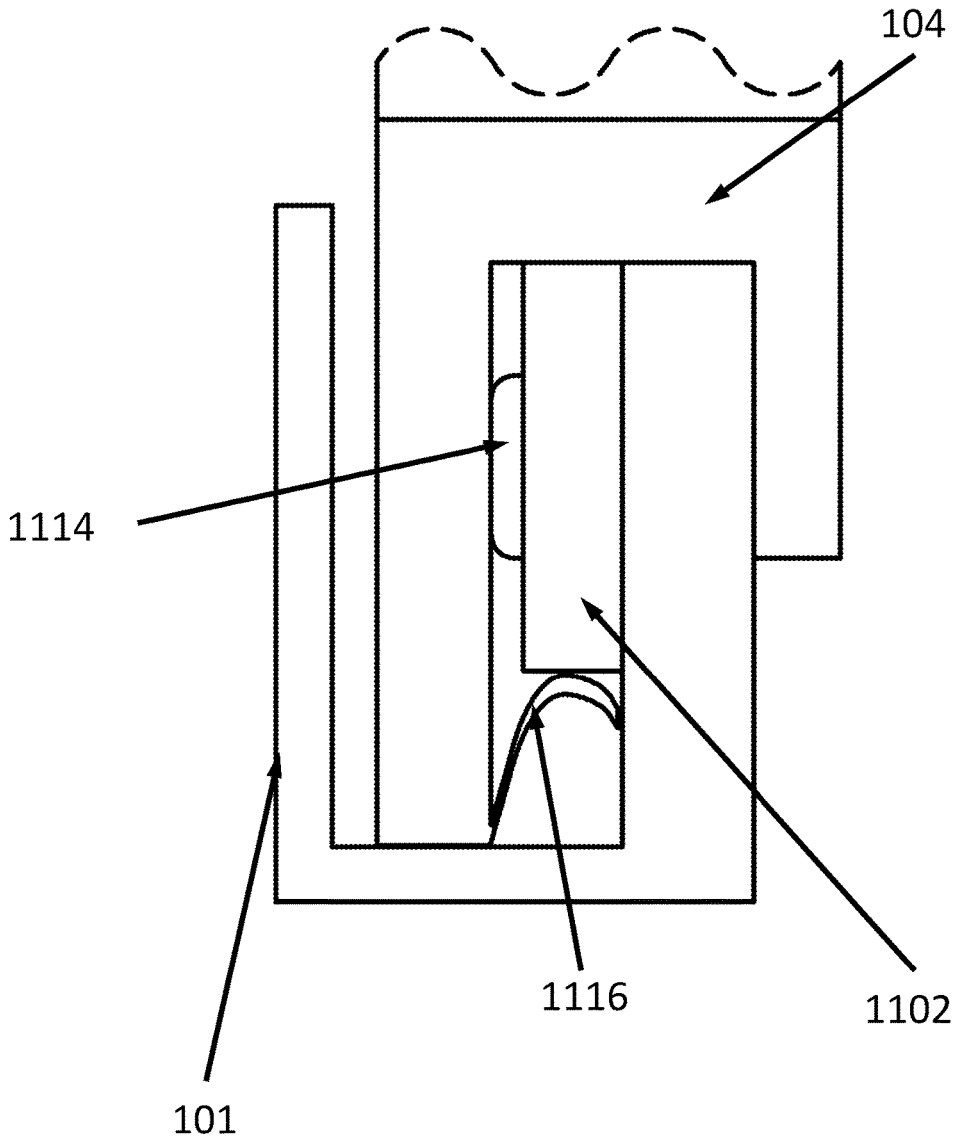
FIG. 11M is a schematic cross-section showing a detail of an embodiment the locking slider arrangement.
Figure 11N:
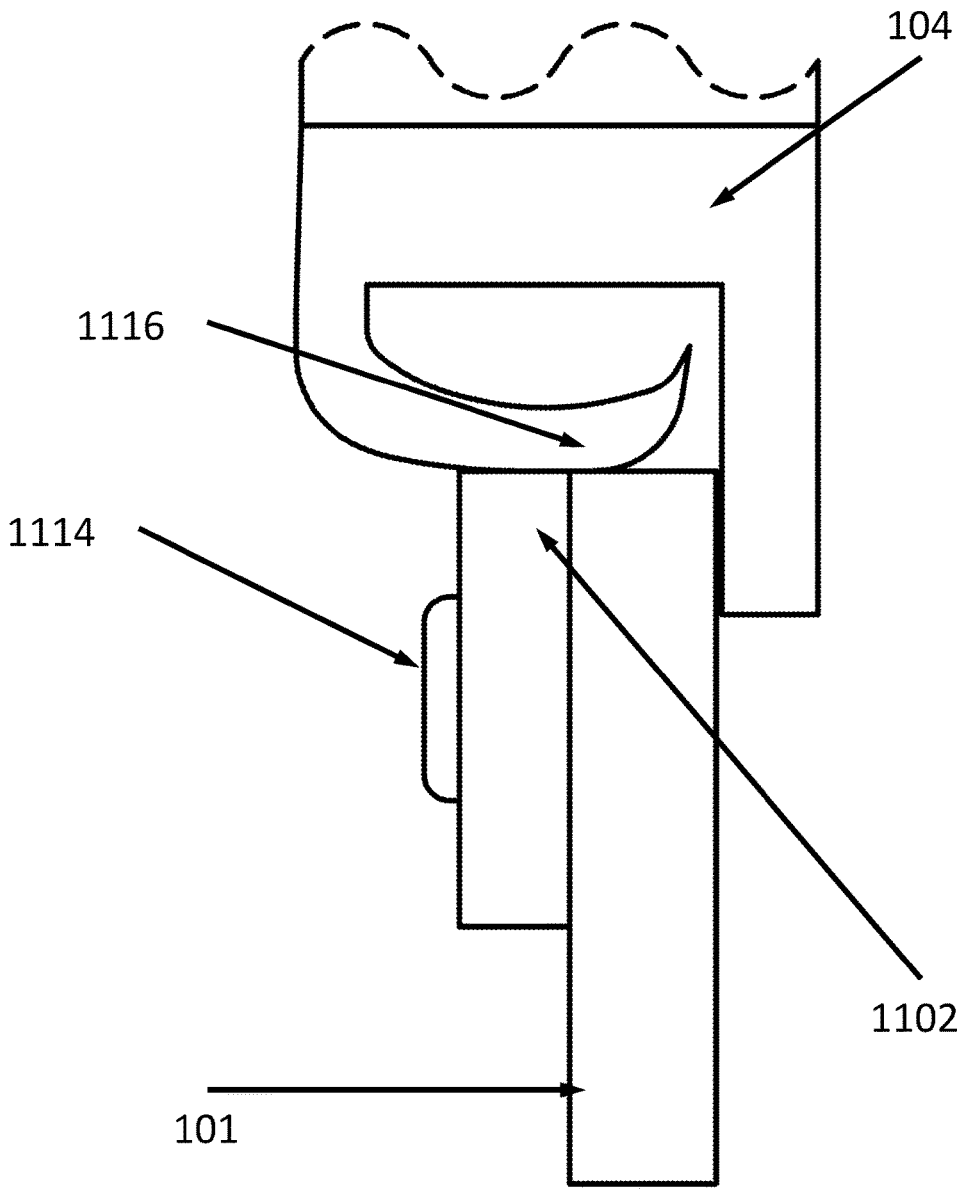
FIG. 11N is a schematic cross-section showing a detail of an embodiment the locking slider arrangement.

In FIGS. 11I-J, the plurality of members 1102 are shown extending upward toward the slider. In some embodiments, as illustrated for example in FIGS. 11K-M, the plurality of members 1102 extend downward, away from the slider. The follower 1104 may have a portion that extends downward and across where the plurality of members 1102 extend, so that the plurality of members 1102 when extended block the portion of the follower 104 from sliding along the rail 101; an example of this is shown in FIG. 11M. In some embodiments where the rail 101 has a slit, the plurality of members 1102 may be housed within the slit, and the extension of the follower 104 may extend into the slit. The follower 104 may have a biased portion 1116 that contacts the plurality of members 1102; thus, when the plurality of members 1102 are extended, the biased portion 1116 may produce a recoil force urging the biased portion 1116 between the extended plurality of members 1102. As a result, as soon as the slider 103 is moved sufficiently to put the biased portion 1116 in a space between two of the extended members, the biased portion 1116 may end up locked between the extended members 1102 even if the members 1102 come up right under the biased portion; this may ensure that the mechanism substantially always succeeds in locking the slider in place. Likewise, the elasticity of the biased portion 1116 may permit the at least one member 1102 to be moved into the extended position even when the follower 104 is in a position to block the extension of the at least one member 1102. The biased portion 1116 may be combined with any other embodiment described herein, or any combination of features described in this herein, to accomplish the same purpose. For instance, as shown in FIG. 11N, the biased portion 1116 may also be used to contact the at least one member 1102 when the at least one member projects upward toward the slider 103.

Figure 11O:
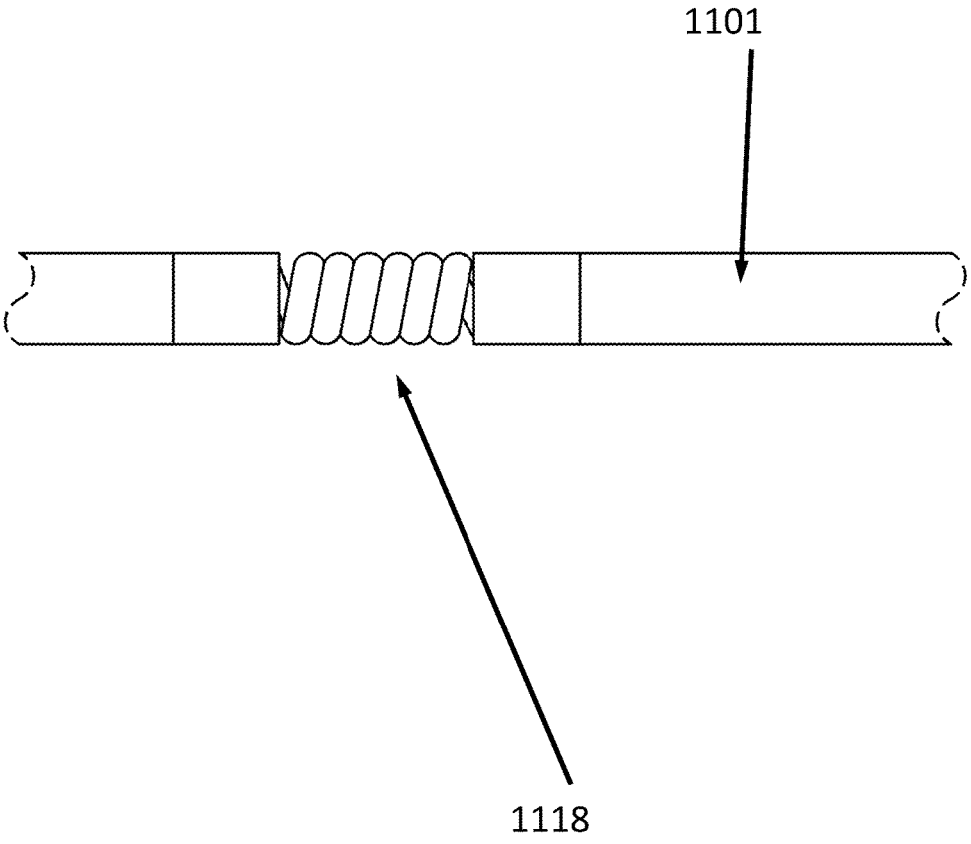
FIG. 11O is a schematic cross-section showing a detail of an embodiment of an actuator.

The object accomplished by the use of the biased portion 1116 is accomplished in other embodiments by the inclusion of an elastic portion 1118 in the actuator 1101, as shown for instance in FIG. 11O. Where the extension of the at least one member 1102 is blocked by the follower, this elastic portion 1118 may store the motion of the actuator as recoil force that tends to urge the at least one member 1102 into the extended position by any mechanism described above, so that when the slider 103 is moved to a position in which the follower 104 may insert in a gap between the at least one member 1102, the at least one member 1102 will extend into the gap, locking the slider assembly 1000.

Figure 11P:
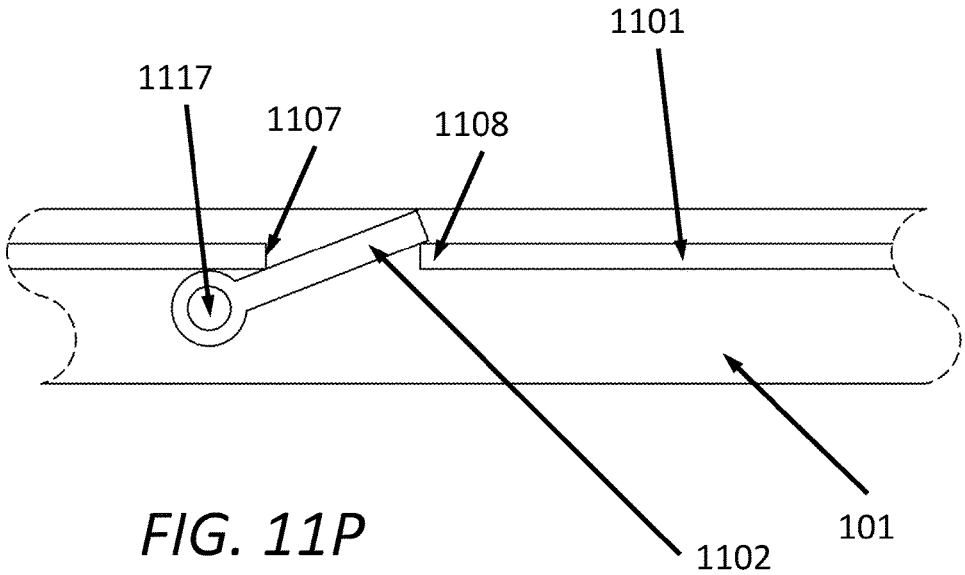
FIG. 11P is a schematic diagram showing a detail of an embodiment the locking slider arrangement.
Figure 11Q:
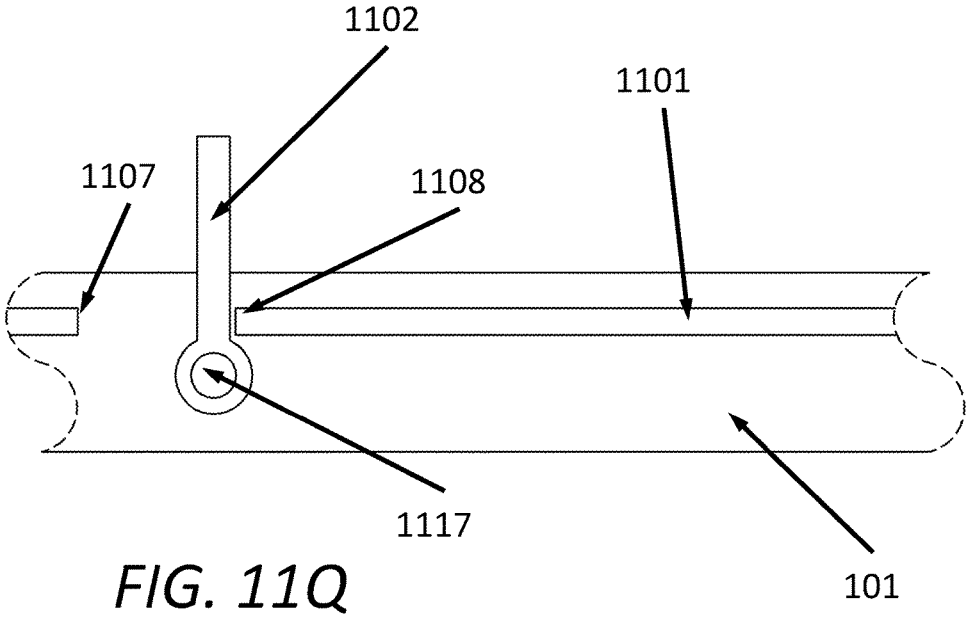
FIG. 11Q is a schematic diagram showing a detail of an embodiment the locking slider arrangement.

Viewing FIGS. 11P-O, in some embodiments, the at least one member 1102 is attached to the rail 1101 by a fixed fulcrum 1117. As a result, the at least one member 1102 may be free to rotate about the fixed fulcrum 1117 between a retracted position, shown for instance in FIG. 11P, and an extended position, as shown for example in FIG. 11Q. In some embodiments, the actuator 1101 is not fixed to the at least one member 1102 or to the rail 101, but is slidably engaged to both. The actuator 1101 (shown in cross-section in FIGS. 11P-O), may have a retraction fulcrum 1107 or an extension fulcrum 1108 as described above, to move the at least one member 1102 between the retracted position and the extended position, as described above. The extension fulcrum 1108 or retraction fulcrum 1107 or both may be the edges of an opening in the actuator, or may be members that extend from the actuator across the at least one member 1102.

In other embodiments, as illustrated for example in FIGS. 12A-12E, the profile of the rail 101 is modified by inflating a portion of the rail 101. For instance, in some embodiments the rail 101 includes a tube 1200 of elastic material, containing fluid, and at least one pressure actuator 1201 operable to increase pressure of the fluid within the rail so that the rail expands to prevent the follower from sliding along the rail.

The tube 1200 may be composed of any material or combination of materials that cause at least one portion of the tube 1200 to be elastic. The entire tube 1200 may be made of an elastic material such as rubber, silicone, or other elastic polymers, whether natural or synthetic. In other embodiments, the tube 1200 includes both relatively inelastic portions and relatively elastic portions, so that the latter tend to expand when pressure within the tube is increased, while the former do not appreciably expand. As a non-limiting example, the tube 1200 may include one or more elastic bladders 1202 connected by relatively inelastic tubing; the bladders 1202 may expand when pressure is increased within the tube 1200, modifying the profile of the rail 101 to block the movement of the slider 103. The tube 1200 may be partially covered by additional material; for instance, the tube 1200 may be inserted into the rail 101, so that the slider 103 never comes in contact with the tube 1200. The rail 101 itself may be flexible enough to change its profile when the tube is 1200 expands. Alternatively, the rail 101 may have sections that are movable with respect to the rest of the rail 101 and may be displaced by the tube 1200, for instance by the bladders 1202 when expanded. The surface of the tube 1200 may itself be thicker or otherwise reinforced where expanded portions come into contact with the slider 103.

The tube 1200 is filled with a fluid. The fluid may be any material that behaves as a liquid or gas when impelled by the pressure actuator 1201. As non-limiting example, the fluid may be a gas, such as air, a liquid, or a non-Newtonian fluid that behaves like a liquid when impelled by the pressure actuator 1201. Tube 1200 and pressure actuator 1201 may be sealed together so fluid does not escape; in some embodiments, the tube 1200 and pressure actuator 1201 are hermetically sealed.

The pressure actuator 1201 may be any device that can increase and decrease the pressure of the fluid to cause the tube 1200 to expand and contract. The pressure actuator

1201 may include, without limitation a pump, an impeller, or a piston. The pressure actuator 1201 may include a user control 1203 that activates the pressure actuator 1201 to inflate the tube 1200 or to deflate the tube 1200. The user control 1203 may be a any component usable by a user to activate the pressure activator 1201, including without limitation one or more buttons, one or more switches, one or more push-rods, one or more levers, or one or more cranks. The pressure actuator 1201 may be electrically powered; for instance, the pressure actuator may be powered by a battery (not shown) incorporated in the assembly. The pressure actuator 1201 may be manually powered.

Figure 13A:
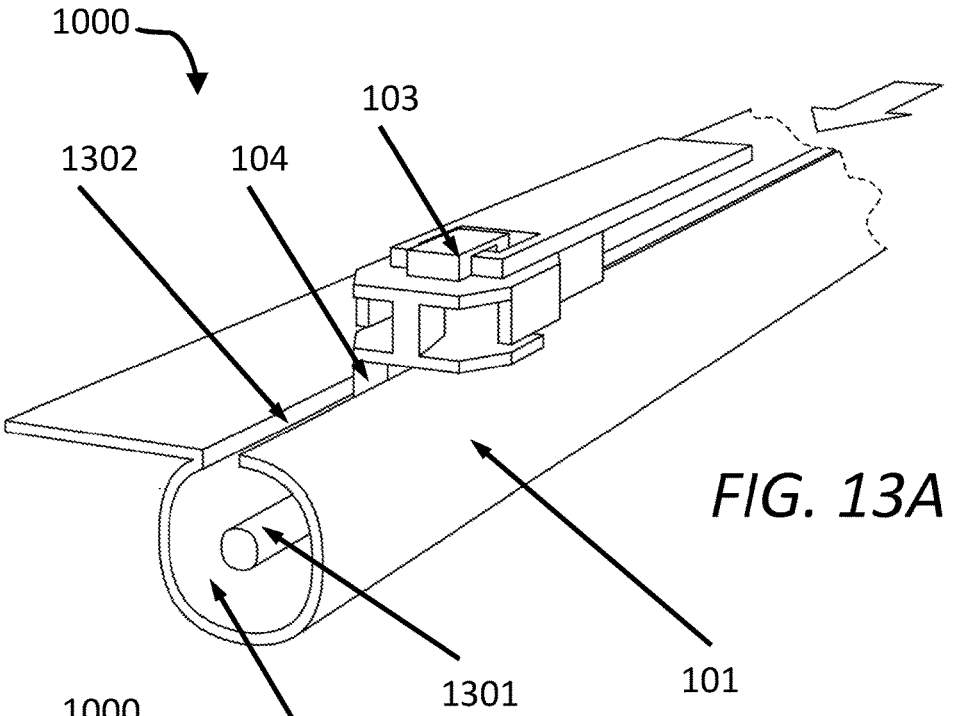
FIG. 13A is a schematic diagram illustrating an embodiment of a locking slider assembly as disclosed herein.
Figure 13B:
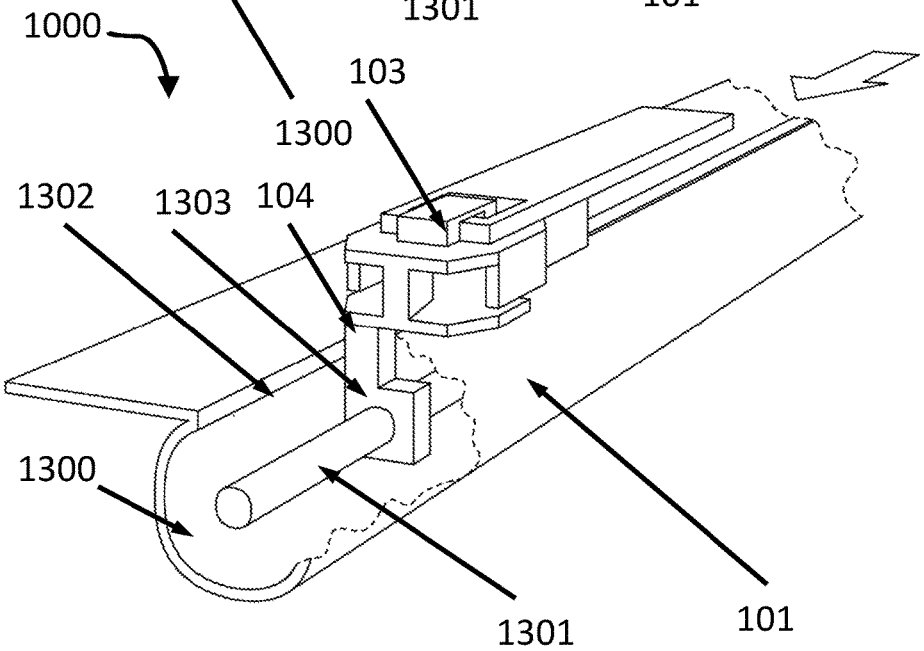
FIG. 13B is a schematic diagram illustrating an embodiment of a locking slider assembly as disclosed herein.
Figure 13C:
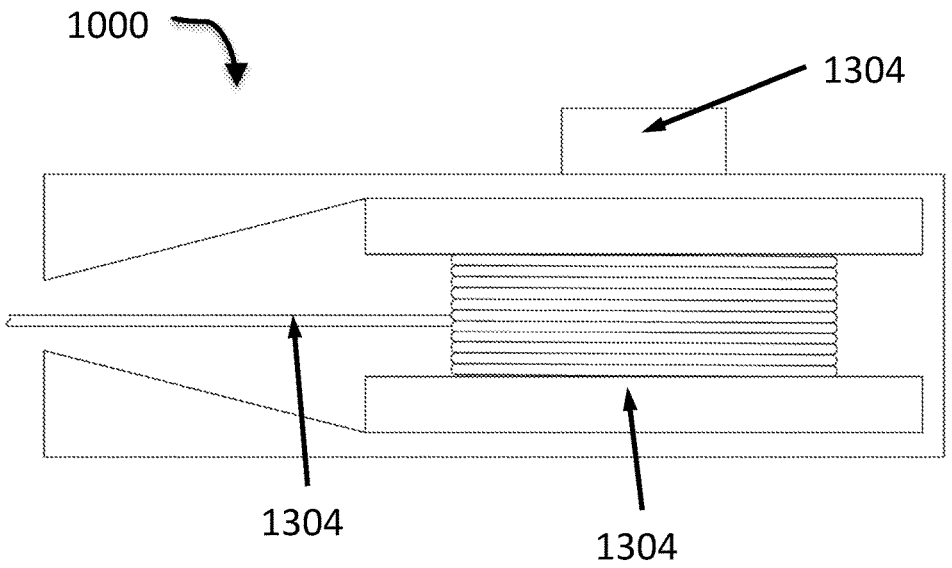
FIG. 13C is a schematic diagram illustrating an embodiment of a locking spool.

FIGS. 13A-C illustrate an example of an alternative embodiment of the assembly 1000. In the alternative embodiment, the rail 101 has an interior space 1300, containing a line 1301. In the alternative embodiment, the follower 104 includes a member 1303 affixed to the line 1301. In some embodiments, the line 1301 may have a first state in which the line 1301 is free to move longitudinally within the rail 101 and a second state in which the line 1301 is not free to move longitudinally within the rail 101; as a result, when the line 1301 is in the first state the slider 103 may be able to slide relative to the rail 101, and when the line 1301 is in the second state the slider 103 may not be able to slide relative to the rail 101.

The rail 101 has an internal space 1300. The internal space 1300 may be an area that is substantially enclosed by the rail 101. For instance, where the rail 101 is a circular or rectangular tube, the internal space 1300 may be the lumen of the tube. Where the rail 101 is a tube with an opening or slit, the internal 1300 may likewise be the interior of the tube. The internal space 1300 may alternatively be a groove in the rail 101 that is large enough to admit the actuator. In some embodiments, the rail 101 has a longitudinal slit 1302 that connects the internal space to the exterior of the rail 101. The longitudinal slit 1302 may run the length of the rail allowing the member 1303 to access the actuator within the rail 101; for instance, if the rail 101 is a tube, the slit 1302 may enable the member 1303 to project into the rail 101 to contact the actuator 1301, while allowing the member 1303 and the slider 103 to slide along the rail 101.

The assembly 1000 may include a line 1301. The line 1301 may be any component suitable for use as an actuator 205 as described above. As a non-limiting example, the line 1301 may be a flexible elongated member such as a monofilament, cable, wire, string, chain, or the like. The line 1301 may be housed within the internal space of the rail 101. In some embodiments the line 1301 has a first state in which the line 1301 is free to move in a longitudinal direction within the rail 101; the longitudinal direction may be the same as the direction of motion along the rail described above in reference to FIG. 1A. In some embodiments, the line 1301 is wound on at least one spool 1304; the spool 1304 may be any device useable as a spool 404 as described above. The at least one spool 1304 may have a spool lock 1305 that prevents the at least one spool 1304 from rotating when the spool lock 1305 is engaged. The spool lock 1304 may function in a manner analogous to a stop used to arrest the retraction of a measuring tape spool or the like. The at least one spool 1304 may have a spring or other biasing means (not shown) that causes the spool to retract when the line is moved toward the spool by the member 1303 when the user moves the slider 103 along the rail. When the spool lock 1305 is engaged, it may be impossible or very difficult for the line 1301 to be moved, making it impossible or very difficult to slide the slider.

Figure 14A:
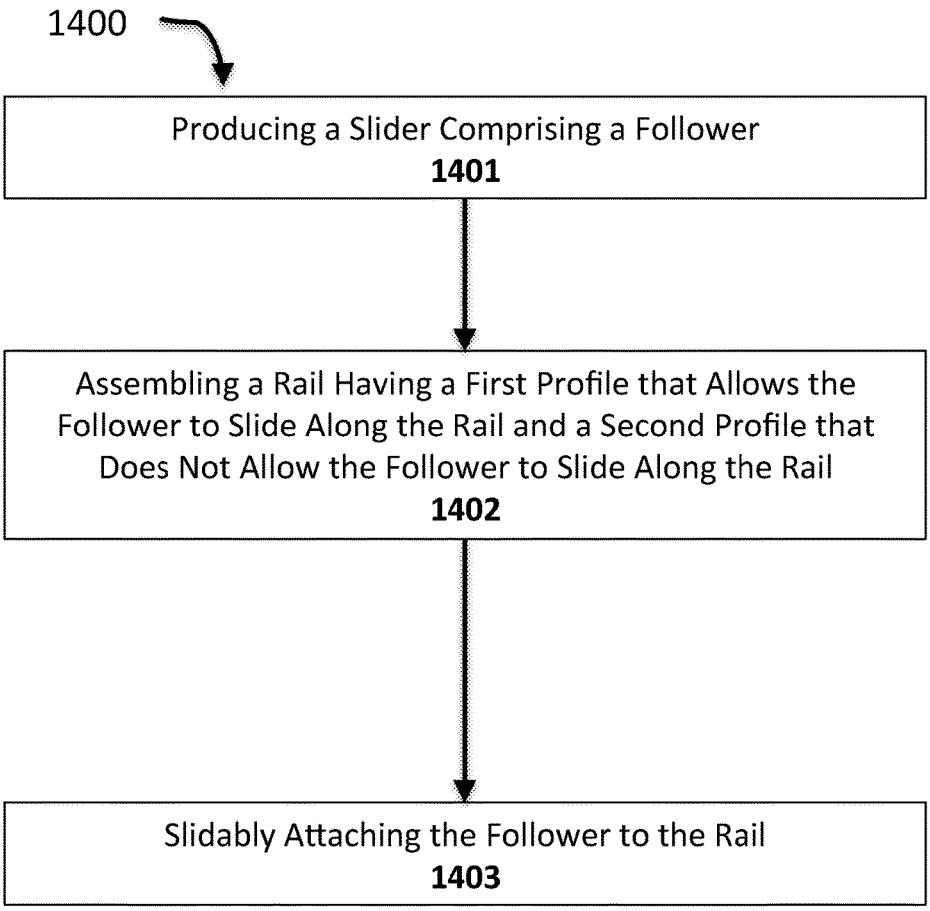
FIG. 14A is a flow diagram illustrating one embodiment of a method for manufacturing a locking slider assembly as disclosed herein.

FIG. 14 illustrates some embodiments of a method 1400 for manufacturing a slide fastener having a locking slider assembly. The method 1400 includes producing a slider having a follower (1401). The method 1400 includes assembling a rail having a first profile that allows the follower to slide along the rail and a second profile that does not allow the follower to slide along the rail (1402). The method 1400 includes slidably attaching the follower to the rail (1403).

Referring to FIG. 1400 in greater detail, and by reference to FIGS. 1A-13C, the method 1400 includes producing a slider having a follower (1401). The slider 103 may be produced by any suitable method for producing a slider 103, such as a slider in a slide fastener or zipper. The methods for producing the slider 103 may include, without limitation molding, machining rapid prototyping, joining pieces of metal or plastic together by any method, or any combination thereof. The follower 104 may be made together with the slider 103, for instance by molding the two together in a single mold, forming the two together in a machining process, or producing the two together in a single rapid prototyping process. In other embodiments, the follower 104 is manufactured separately from the slider 103 and then attached to the slider 103. The follower 104 may be attached to the slider 103 in any way described above in FIGS. 1A-13C; for instance the follower 104 may be fixed to the slider. In other embodiments, the follower 104 is attached to the slider using a swivel or somewhat loose connection (not shown) that allows the follower 104 to flex relative to the slider 103 as the slider travels along the rail. In other embodiments, the follower 104 may be constructed by modifying the slider 103; for instance, as shown in FIG. 12A, the slider 103 may be formed to accommodate the rail so that the slider 103 itself functions as the follower.

The method 1400 includes assembling a rail having a first profile that allows the follower to slide along the rail and a second profile that does not allow the follower to slide along the rail (1402). The rail 101 may be formed by any suitable method; for instance, the rail 101 may be formed by extrusion. The rail 101 may be formed by molding. The rail 101 may be formed by molding. The manufacturing process that produces the rail 101 may including cutting away portions of the rail 101; for instance, openings or slits may be cut in an originally tubular rail to form openings or gaps from which members may extend, as described above. The manufacture of the rail 101 may include joining together a plurality of components, each of which may have been produced by molding, extrusion, or any other suitable method.

In some embodiments, an actuator is included in the rail. The actuator may be formed by producing a long flexible component such as a string, cable, monofilament, chain, wire, or other element as described above in reference to FIGS. 1A-13C. One or more beads may be produced by any method suitable for producing the slider 103 as described above. The beads may be beads 206 or beads 1104 as described above; the one or more beads 1104 may include spacer beads 1106. The one or more beads may include member beads 1105. The member beads 1105 may be formed together with one or more members 1101 in a single process; for instance, the member beads 1105 and members 1101 may be molded together. In other embodiments the one or more members 1101 are formed separately from the member beads 1105 and then attached to the member beads 1105. In some embodiments, one end of each member 1101 is fixed to a member bead 1105. In other embodiments, one end of each member 1101 is pivotally attached to a member bead 1105, for instance by way of a joint or pin.

In some embodiments, the one or more beads are attached to the flexible component. The one or more beads may be strung on the flexible component; some or all of the one or more beads may be fixed to the flexible component by adhesion, attachment using head, or by wedging something between the bead and the flexible component. The one or more beads may be molded around the flexible component. The flexible component and one or more beads may be formed together. One or more member beads 1105 may be alternated with one or more spacer beads 1106 to space apart member beads 1105 as needed.

In some embodiments, one or more members 1101 are attached to the actuator. In some embodiments, this is accomplished by attaching member beads 1105 to the flexible component. In other embodiments, the flexible component is formed together with one or more members 1101 in a single process; for instance, the flexible component and members 1101 may be molded together. In other embodiments the one or more members 1101 are formed separately from the flexible component and then attached to flexible component. In some embodiments, one end of each member 1101 is fixed to the flexible component. In other embodiments, one end of each member 1101 is pivotally attached to the flexible component, for instance by way of a joint or pin.

Where the rail 101 includes a tube 1200 that may be inflated as described above; the tube 1200 may be produced by any method described above for producing the rail 101, including molding, extrusion, or other suitable methods. Bladders 1202 may be formed in the tube 1200 during its initial production or subsequently by further processing the tube 1200. The method 1400 may further include inserting the tube into the rail 101.

Components that allow the user to change the rail 101 profile may be included; for instance, where the rail 101 includes an actuator, the actuator may be attached to a spool, for instance as described above in reference to FIG. 6 above. In other embodiments, where the rail 101 includes a tube 1200 that may be inflated, the method 1400 further includes attaching a pressure actuator 1201 to the tube 1200. The pressure actuator 1201 may be hermetically sealed to the tube 1200.

The method 1400 includes slidably attaching the follower to the rail (1403). In some embodiments, this is accomplished as described above in reference to FIG. 6.

Some embodiments of the method also include incorporating the rail in a portable container, such as a backpack, luggage item, handbag, or other item that may include a slide fastener. Where the rail 101 includes a strip 101*a* as shown in FIG. 5F, the strip may be adhered, sewn, stapled, fastened, or otherwise attached to the portable container. Where the rail 101 is included in a sleeve as described above in reference to FIG. 5G, the sleeve may be adhered, sewn, stapled, fastened, or otherwise attached to the portable container.

Figure 14B:
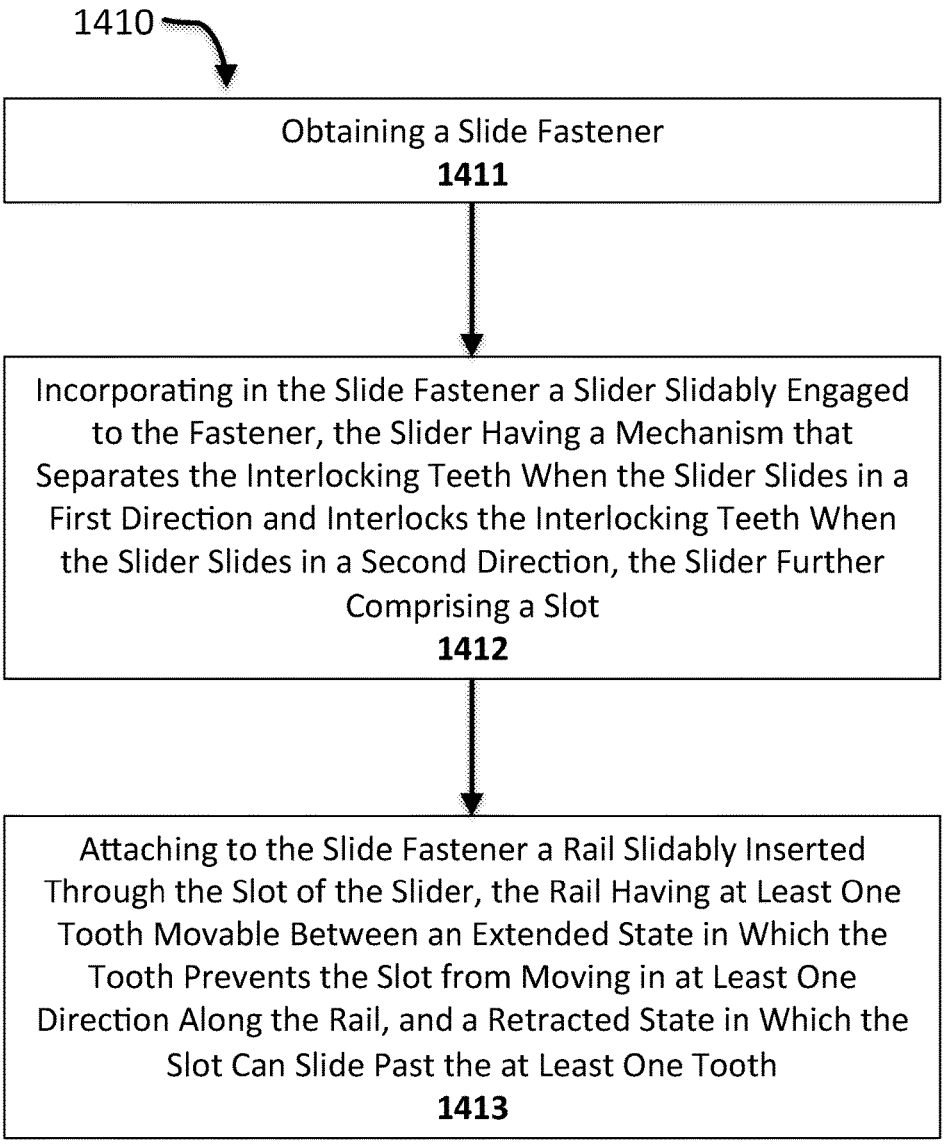
FIG. 14B is a flow diagram illustrating one embodiment of a method for manufacturing a slide fastener incorporating an embodiment of the locking slider assembly as disclosed herein.

FIG. 14B illustrates some embodiments of a method 1410 for manufacturing a slide fastener having a locking slider assembly. The method 1410 includes obtaining a slide fastener (1411). The method 1410 includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot (1412). The method 1410 includes attaching to the slide fastener a rail slidably inserted through the slot of the slider, the rail having at least one tooth movable between an extended state in which the tooth prevents the slot from moving in at least one direction along the rail, and a retracted state in which the slot can slide past the at least one tooth (1413).

Referring to FIG. 1410 in greater detail, and by reference to FIGS. 7A-10, the method 1410 includes obtaining a slide fastener (1411). This may be implemented as described above in reference to FIG. 6.

The method 1410 includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot (1412). This may be implemented as described above in reference to FIG. 6.

The method 1410 includes attaching to the slide fastener a rail slidably inserted through the slot of the slider, the rail having at least one tooth movable between an extended state in which the tooth prevents the slot from moving in at least one direction along the rail, and a retracted state in which the slot can slide past the at least one tooth (1413). This may be implemented as described above in reference to FIGS. 6-10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A locking slider assembly comprising:

a slider comprising a follower; and a rail engaged to the follower, so that the follower can move along the rail when the assembly is in a first state and the follower cannot move along the rail when the assembly is in a second state; and wherein the follower comprises a substantially C-shaped projection attached to the slider.

2. The assembly of claim 1, wherein the follower comprises a substantially rigid member attached to the slider.

3. The assembly of claim 1, wherein the follower fits snugly over the rail.

4. The assembly of claim 1, wherein the follower further comprises a biased portion.

5. The assembly of claim 1, wherein the rail has a first profile that allows the follower to slide along the rail when the assembly is in the first state and a second profile that does not allow the follower to slide along the rail when the assembly is in the second state.

6. The assembly of claim 1, wherein the rail has an exterior surface, and further comprising:

an elongated actuator inside the rail;

at least one member attached to the actuator, the at least one member positioned to extend along the outside surface of the rail when the actuator moves in a first direction, and to retract into the rail through the at least one transverse opening when the actuator moves in a second direction.

7. The assembly of claim 6, wherein the at least one member further comprises a plurality of members.

8. The assembly of claim 6, wherein the at least one member further comprises at least one bristle.

9. The assembly of claim 6, wherein the at least one member further comprises a flexible piece of metal.

10. The assembly of claim 6, wherein the at least one member further comprises a flexible piece of polymer.

11. The assembly of claim 6, wherein the actuator further comprises at least one rigid bead fixedly strung on the actuator.

12. The assembly of claim 11, wherein the at least one rigid bead further comprises a member bead to which the at least one member is attached.

13. The assembly of claim 6, further comprising a biasing means urging the at least one member into at least one of the extended position and the retracted position.

14. The assembly of claim 6, wherein the rail further comprises least one fulcrum that forces the at least one member into the extended position when the actuator is moved in the first direction.

15. The assembly of claim 6, wherein the rail further comprises at least one fulcrum that forces the at least one member into the retracted position when the actuator is moved in the second direction.

16. The assembly of claim 6, wherein the at least one member further comprises a wedge cam, and the rail further comprises a follower.

17. The assembly of claim 1, wherein the rail further comprises a slit, and the follower further comprises an extension that inserts into the slit.

18. The assembly of claim 1, wherein the slider is incorporated in a slide fastener.

19. The assembly of claim 1, wherein the assembly is incorporated in a portable container.

20. A method for manufacturing a locking sliding assembly, the method comprising:

producing a slider comprising a follower;

assembling a rail having a first profile that allows the follower to slide along the rail and a second profile that does not allow the follower to slide along the rail; and slidably attaching the follower to the rail; and incorporating the rail in a portable container by enveloping the rail in a sleeve of flexible material and attaching the sleeve to the portable container.

21. The method of claim 20, wherein the rail further comprises a strip of flexible material, and wherein incorporating the rail in a portable container further comprises attaching the strip of flexible material to the portable container.

22. The method of claim 20, wherein the portable container further comprises at least one clip, and wherein incorporating the rail in a portable container further comprises inserting the rail in the at least one clip.

* * * * *